US007639214B2

(12) United States Patent
Jung et al.

(10) Patent No.: US 7,639,214 B2
(45) Date of Patent: Dec. 29, 2009

(54) PLASMA DISPLAY APPARATUS AND DRIVING METHOD THEREOF

(75) Inventors: Yunkwon Jung, Gumi-si (KR); Seongho Kang, Daegu (KR); Sangjin Yoon, Gyeonggsangbuk-do (KR); Sooseok Sim, Gumi-si (KR)

(73) Assignee: LG Electronics Inc., Seoul (KR)

( * ) Notice: Subject to any disclaimer, the term of this patent is extended or adjusted under 35 U.S.C. 154(b) by 890 days.

(21) Appl. No.: 11/280,224

(22) Filed: Nov. 17, 2005

(65) Prior Publication Data

US 2006/0109209 A1 May 25, 2006

(30) Foreign Application Priority Data

Nov. 19, 2004 (KR) ..... 10-2004-0095455
Sep. 27, 2005 (KR) ..... 10-2005-0090172

(51) Int. Cl.
*G09G 3/28* (2006.01)

(52) U.S. Cl. ..... 345/67; 345/68; 345/208

(58) Field of Classification Search ..... 345/60–69, 345/204–215; 315/169.1–169.4
See application file for complete search history.

(56) References Cited

U.S. PATENT DOCUMENTS 5,317,334 A 5/1994 Sano ..... 345/148
5,420,602 A * 5/1995 Kanazawa ..... 345/67
5,446,344 A 8/1995 Kanazawa ..... 315/169.4
5,656,893 A * 8/1997 Shino et al. ..... 315/169.4
5,659,226 A * 8/1997 Shigeta ..... 313/491
5,790,087 A 8/1998 Shigeta et al. ..... 345/67
6,002,381 A 12/1999 Tomio et al. ..... 345/60
6,262,699 B1 7/2001 Suzuki et al. ..... 345/68
6,448,947 B1 9/2002 Nagai ..... 345/60
6,483,251 B2 11/2002 Setoguchi et al. ..... 315/169.4
6,489,939 B1 12/2002 Asao et al. ..... 345/65
6,677,714 B2 1/2004 Du et al. ..... 315/169.4

(Continued)

FOREIGN PATENT DOCUMENTS

CN 1504982 A 6/2004

(Continued)

OTHER PUBLICATIONS

European Search Report dated Sep. 11, 2006.

(Continued)

*Primary Examiner*—Vijay Shankar
(74) *Attorney, Agent, or Firm*—KED & Associates, LLP

(57) ABSTRACT

The present invention relates to a plasma display apparatus, and more particularly, to a plasma display apparatus and driving method thereof, in which scan electrodes are scanned according to one of a plurality of scan types and a last sustain pulse of sustain pulses applied to scan electrodes or sustain electrodes is controlled. The plasma display apparatus of the present invention comprises a plasma display panel comprising a plurality of scan electrodes, a plurality of sustain electrodes, and a plurality of data electrodes crossing the plurality of scan electrodes and the sustain electrodes, and a controller for scanning the scan electrodes using one of a plurality of scan types in which the order of scanning the plurality of scan electrodes is different in an address period, applies a data pulse to the data electrodes corresponding to one scan type, and controls a difference between an application time point of a last sustain pulse of sustain pulses, which are applied to the scan electrodes or the sustain electrode in a sustain period subsequent to the address period, and a application time point of a reset pulse, which is applied to the scan electrodes in a reset period of a next sub-field, to be greater than a difference between application time points of the two sustain pulses, in at least one of sub-fields of a frame.

20 Claims, 40 Drawing Sheets

U.S. PATENT DOCUMENTS

| | | | | |
|---|---|---|---|---|
| 6,720,940 | B2 | 4/2004 | Awamoto et al. | 345/60 |
| 7,015,648 | B2 | 3/2006 | Son et al. | 315/169.4 |
| 7,068,243 | B2 | 6/2006 | Morimoto | 345/60 |
| 7,271,782 | B2 | 9/2007 | Yoon et al. | 345/60 |
| 7,358,931 | B2 | 4/2008 | Mizobata et al. | 345/60 |
| 7,417,604 | B2 | 8/2008 | Kim | 345/63 |
| 7,508,359 | B2 | 3/2009 | Han | 345/60 |
| 2001/0017605 | A1 | 8/2001 | Hashimoto et al. | 345/60 |
| 2002/0180665 | A1 | 12/2002 | Awamoto et al. | 345/60 |
| 2002/0195963 | A1 | 12/2002 | Tokunaga et al. | 315/169.3 |
| 2003/0080927 | A1 | 5/2003 | Sim et al. | 345/60 |
| 2004/0001036 | A1 | 1/2004 | Takayama et al. | 345/62 |
| 2004/0108975 | A1 | 6/2004 | Araki | 345/63 |
| 2004/0164930 | A1 | 8/2004 | Hashimoto et al. | 345/60 |
| 2005/0088375 | A1 | 4/2005 | Son | 345/60 |
| 2005/0280607 | A1 | 12/2005 | Han | 345/63 |
| 2006/0103599 | A1 | 5/2006 | Cho et al. | 345/67 |

FOREIGN PATENT DOCUMENTS

| | | | |
|---|---|---|---|
| EP | 0 945 844 | A2 | 9/1999 |
| EP | 0 961 258 | A1 | 12/1999 |
| EP | 1 265 212 | B1 | 12/2002 |
| EP | 1 359 563 | A2 | 11/2003 |
| EP | 1 388 841 | A2 | 2/2004 |
| EP | 1 418 563 | A1 | 5/2004 |
| EP | 1 424 679 | A2 | 6/2004 |
| EP | 1 528 531 | A2 | 5/2005 |
| EP | 1 530 192 | A2 | 5/2005 |
| EP | 1 659 558 | A2 | 5/2006 |
| JP | 08-305319 | A | 11/1996 |
| JP | 09-006283 | A | 1/1997 |
| JP | 10-105111 | A | 4/1998 |
| JP | 10-207426 | | 8/1998 |
| JP | 10-207427 | | 8/1998 |
| JP | 2000-020024 | | 1/2000 |
| JP | 2000-075835 | A | 3/2000 |
| JP | 2000-163001 | | 6/2000 |
| JP | 2001-051649 | A | 2/2001 |
| JP | 2001-272948 | A | 10/2001 |
| JP | 2001-318649 | A | 11/2001 |
| JP | 2002-351394 | | 12/2002 |
| JP | 2003-280572 | | 10/2003 |
| KR | 10-2004-0072366 | A | 8/2004 |
| KR | 10-2004-0085741 | A | 10/2004 |
| KR | 10-2005-0042372 | A | 5/2005 |

OTHER PUBLICATIONS

Chinese Office Action dated Sep. 21, 2007.
U.S. Notice of Allowance dated Apr. 13, 2009 in U.S. Appl. No. 11/280,449.
European Search Report dated Feb. 14, 2007 in European Application No. 05257157.7.
European Search Report dated Feb. 14, 2007 in European Application No. 05254530.8.
European Search Report dated Aug. 08, 2006 in European Application No. 05277077.7.
Chinese Office Action dated on Sep. 21, 2007 in Chinese Application No. 200510125144.0.
Chinese Office Action dated on Sep. 21, 2007 in Chinese Application No. 200510125149.3.
Chinese Office Action dated Feb. 27, 2008 in Chinese Application No. 2005100881791.
Korean Office Action dated Oct. 27, 2006 in Korean Application No. 10-2005-0068668.
Korean Office Action dated Oct. 27, 2006 in Korean Application No. 10-2005-0068666.
Korean Office Action dated Jun. 27, 2006 in Korean Application No. 10-2004-0095451.
U.S. Office Action dated Nov. 13, 2008 in U.S. Appl. No. 11/269,649.
U.S. Office Action, dated May 26, 2009 in U.S. Appl. No. 11/269,649.
U.S. Office Action dated Oct. 31, 2008 in U.S. Appl. No. 11/187,928.
Korean Decision to Grant a Patentdated Oct. 09, 2007 in Korean Application No. 10-2005-0068668.
Japanese Office Action dated Aug. 26, 2008 in Japanese Application No. 2005-252325.

* cited by examiner

| first decision uint | second decision uint | third decision uint | coefficient |
|---|---|---|---|
| 0 | 0 | 0 | 0 |
| 0 | 0 | 1 | $Cm_2$ |
| 0 | 1 | 0 | $Cm_1+Cm_2$ |
| 0 | 1 | 1 | $Cm_1+Cm_2$ |
| 1 | 0 | 0 | $Cm_1+Cm_2$ |
| 1 | 0 | 1 | $Cm_1+Cm_2$ |
| 1 | 1 | 0 | 0 |
| 1 | 1 | 1 | $4Cm_1+Cm_2$ |

Fig. 18

| Value 1 | Value 2 | Value 3 | coefficient |
|---|---|---|---|
| 0 | 0 | 0 | 0 |
| 0 | 1 | 0 | $Cm_2$ |
| 0 | 0 | 1 | $Cm_1+Cm_2$ |
| 0 | 1 | 1 | $Cm_1+Cm_2$ |
| 1 | 0 | 0 | $Cm_1+Cm_2$ |
| 1 | 1 | 0 | $Cm_1+Cm_2$ |
| 1 | 0 | 1 | 0 |
| 1 | 1 | 1 | $4Cm_1+Cm_2$ |

Fig. 20

| Value 1 or Value 4 or Value 7 | Value 2 or Value 5 or Value 8 | Value 3 or Value 6 or Value 9 | coefficient |
|---|---|---|---|
| 0 | 0 | 0 | 0 |
| 0 | 0 | 1 | $Cm_2$ |
| 0 | 1 | 0 | $Cm_1+Cm_2$ |
| 0 | 1 | 1 | $Cm_1+Cm_2$ |
| 1 | 0 | 0 | $Cm_1+Cm_2$ |
| 1 | 0 | 1 | $Cm_1+Cm_2$ |
| 1 | 1 | 0 | 0 |
| 1 | 1 | 1 | $4Cm_1+Cm_2$ |

PLASMA DISPLAY APPARATUS AND DRIVING METHOD THEREOF

CROSS-REFERENCES TO RELATED APPLICATIONS

This Nonprovisional application claims priority under 35 U.S.C. §119(a) on Patent Application No. 10-2004-0095455 filed in Republic of Korea on Nov. 19, 2004, Patent Application No. 10-2005-0090172 filed in Republic of Korea on Sep. 27, 2005, the entire contents of which are hereby incorporated by reference.

BACKGROUND OF THE INVENTION

1. Field of the Invention

The present invention relates to a plasma display apparatus, and more particularly, to a plasma display apparatus and driving method thereof, in which scan electrodes are scanned according to one of a plurality of scan types and a last sustain pulse of sustain pulses applied to scan electrodes or sustain electrodes is controlled.

2. Background of the Related Art

In general, a plasma display panel comprises a front panel and a rear panel. Barrier ribs formed between the front panel and the rear panel form one cell. Each cell is filled with a primary discharge gas, such as neon (Ne), helium (He) or a mixed gas of Ne+He, and an inert gas containing a small amount of xenon (Xe). A plurality of these cells form one pixel. For example, a red (R) cell, a green (G) cell and a blue (B) cell form one pixel. If the inert gas is discharged with a high frequency voltage, it generates vacuum ultraviolet rays. Phosphors formed between the barrier ribs are excited to display images. The plasma display panel can be made thin and light, and has thus been in the spotlight as the next-generation display devices.

FIG. 1 is a view showing the construction of a general plasma display panel.

As shown in FIG. 1, the plasma display panel comprises a front substrate 100 and a rear substrate 110. In the front substrate 100, a plurality of sustain electrode pairs in which scan electrodes 102 and sustain electrodes 103 are formed in pairs is arranged on a front glass 101 serving as a display surface on which images are displayed. In the rear substrate 110, a plurality of address electrodes 113 crossing the plurality of sustain electrode pairs is arranged on a rear glass 111 serving as a rear surface. At this time, the front substrate 100 and the rear substrate 110 are parallel to each other with a predetermined distance therebetween.

The front substrate 100 comprises the pairs of scan electrodes 102 and sustain electrodes 103, which mutually discharge one another and maintain the emission of a cell within one discharge cell. In other words, each of the scan electrode 102 and the sustain electrode 103 has a transparent electrode (a) formed of a transparent ITO material and a bus electrode (b) formed of a metal material. The scan electrodes 102 and the sustain electrodes 103 are covered with one or more dielectric layers 104 for limiting a discharge current and providing insulation among the electrode pairs. A protection layer 105 having Magnesium Oxide (MgO) deposited thereon is formed on the dielectric layers 104 so as to facilitate discharge conditions.

In the rear substrate 110, barrier ribs 112 of stripe form (or well form), for forming a plurality of discharge spaces, i.e., discharge cells are arranged parallel to one another. Furthermore, a plurality of address electrodes 113, which generate vacuum ultraviolet rays by performing an address discharge, are disposed parallel to the barrier ribs 112. R, G and B phosphor layers 114 that radiate a visible ray for displaying images during an address discharge are coated on a top surface of the rear substrate 110. A dielectric layer 115 for protecting the address electrodes 113 is formed between the address electrodes 113 and the phosphor layers 114.

In the plasma display panel constructed above, the electrodes are constructed in matrix form. This will be described with reference to FIG. 2.

FIG. 2 is a view schematically showing the arrangement of electrodes of a three-electrode AC surface-discharge type plasma display panel (hereinafter referred to as "PDP").

Referring to FIG. 2, the three-electrode AC surface-discharge type PDP in the related art comprises scan electrodes Y1 to Yn and sustain electrodes Z formed on an upper plate, and address electrodes X1 to Xm formed on a lower plate such that they cross the scan electrodes Y1 to Yn and the sustain electrodes Z.

Discharge cells 200 for displaying any one of red, green and blue are disposed at the intersections of the scan electrodes Y1 to Yn, the sustain electrodes Z, and the address electrodes X1 to Xm in matrix form.

A dielectric layer (not shown) and an MgO protection layer (not shown) are laminated on the upper plate in which the scan electrodes Y1 to Yn and the sustain electrodes Z are formed.

Barrier ribs for preventing optical and electrical interference among neighboring discharge cells 200 are formed on the lower plate in which the address electrodes X1 to Xm are formed. Phosphors, which are excited by ultraviolet rays to emit a visible ray, are formed on surfaces of the lower plate and the barrier ribs.

An inert mixed gas such as He+Xe, Ne+Xe or He+Xe+Ne is injected into discharge spaces between the upper plate and the lower plate of the PDP.

A method of implementing gray levels of an image in the plasma display apparatus constructed above will be described with reference to FIG. 3.

FIG. 3 is a view illustrating a method of implementing gray levels of an image of a plasma display apparatus in the related art.

As shown in FIG. 3, in order to represent image gray levels of the plasma display panel in the related art, one frame is divided into several sub-fields having a different number of emissions. Each of the sub-fields is divided into a reset period (RPD) for initializing the entire cells, an address period (APD) for selecting a cell to be discharged, and a sustain period (SPD) for implementing gray levels depending on the number of discharges. For example, if it is sought to display images with 256 gray levels, a frame period (16.67 ms) corresponding to 1/60 seconds is divided into eight sub-fields (SF1 to SF8) as shown in FIG. 2. Each of the eight sub-fields (SF1 to SF8) is again divided into a reset period, an address period and a sustain period.

The reset period and the address period of each sub-field are the same every sub-field. An address discharge for selecting a cell to be discharged is generated because of a voltage difference between the address electrodes and the scan electrodes (i.e., transparent electrodes). The sustain period is increased in the ratio of $2^n$ (where n=0, 1, 2, 3, 4, 5, 6, 7) in each sub-field. Since the sustain period is varied every sub-field as described above, gray levels of an image are represented by controlling the sustain period of each sub-field, i.e., a sustain discharge number.

FIG. 4 is a view illustrating equivalent capacitance (C) of a plasma display panel.

Referring to FIG. 4, the equivalent capacitance (C) of the plasma display panel comprises equivalent capacitance (Cm1) between the data electrodes, such as a data electrode X1 and a data electrode X2, equivalent capacitance (Cm2) between the data electrode and the scan electrodes, such as the data electrode X1 and a scan electrode Y1, and equivalent capacitance (Cm2) between the data electrode and the sustain electrode such as the data electrode X1 and a sustain electrode Z1.

Meanwhile, the state of a voltage applied to the scan electrode Y or the data electrode X is changed according to the operation of a switching element included in a drive IC, such as a scan drive IC, for driving the scan electrode Y by supplying a scan pulse to the scan electrode Y in an address period, and a drive IC, such as a data driver IC, for driving the data electrode X by supplying a data pulse to the data electrode X in an address period. Therefore, the displacement current (Id) that is generated the aforementioned equivalent capacitance (Cm1) and the equivalent capacitance (Cm2) flows through the data driver IC through the data electrode.

As described above, if the equivalent capacitance of the plasma display panel increases, the amount of the displacement current (Id) flowing through the data driver IC is increased. If the switching number of the data driver IC is increased, the amount of the displacement current (Id) is increased. The switching number of the data driver IC is varied depending on input image data.

More particularly, in the case of a specific pattern in which a logic value of image data is repeated between 0 and 1, the amount of the displacement current flowing through the data driver IC is excessively increased. Therefore, there is a problem in electrical damage such as a burnt data driver IC.

FIG. 5 is a waveform showing an example of a driving waveform of a general plasma display panel. FIGS. 11*a* to 6*e* are views showing, step by step, the distribution of wall charges within a discharge cell, which is varied according to the driving waveform as shown in FIG. 5.

The driving waveform of FIG. 5 will be described in connection with FIGS. 11*a* to 6*e*.

Referring to FIG. 5, each of sub-fields (SFn−1, SFn) includes a reset period (RP) for initializing the discharge cells 1 of the entire screen, an address period (AP) for selecting discharge cells, a sustain period (SP) for sustaining the discharge of selected discharge cells 1, and an erase period (EP) for erasing wall charges within the discharge cells 1.

In the erase period (EP) of the $(n-1)^{th}$ sub-field (SFn−1), an erase ramp waveform (ERR) is applied to the sustain electrodes Z. during the erase period (EP), 0V is applied to the scan electrodes Y and the address electrodes X. The erase ramp waveform (ERR) is a positive ramp waveform whose voltage gradually rises from 0V to a positive sustain voltage (Vs). An erase discharge is generated between the scan electrodes Y and the sustain electrodes Z within on-cells in which the sustain discharge is generated by the erase ramp waveform (ERR). Wall charges within the on-cells are erased by the erase discharge. As a result, each of the discharge cells 1 has the wall charge distribution as shown in FIG. 6*a* soon after the erase period (EP).

In a set-up period (SU) of the reset period (RP) where the $n^{th}$ sub-field (SFn) begins, a positive ramp waveform (PR) is applied to all the scan electrodes Y, and 0V is applied to the sustain electrodes Z and the address electrodes X. A voltage on the scan electrodes Y gradually rises from the positive sustain voltage (Vs) to a reset voltage (Vr), which is higher than the positive sustain voltage (Vs), by means of the positive ramp waveform (PR) of the set-up period (UP). A dark discharge in which light is rarely generated is generated between the scan electrodes Y and the address electrodes X within the discharge cells of the entire screen as well as between the scan electrodes Y and the sustain electrodes Z by means of the positive ramp waveform (PR). As a result of this dark discharge, positive wall charges remain on the address electrodes X and the sustain electrodes Z immediately after the set-up period (SU), and negative wall charges remain on the scan electrodes Y, as shown in FIG. 6*b*. While the dark discharge is generated in the set-up period (SU), a gap voltage (Vg) between the scan electrodes Y and the sustain electrodes Z and a gap voltage between the scan electrodes Y and the address electrodes X are initialized to a voltage close upon a firing voltage (Vf) which can generate a discharge.

After the set-up period (SU), in a set-down period (SD) of the reset period (RP), a negative ramp waveform (NR) is applied to the scan electrodes Y. At the same time, the positive sustain voltage (Vs) is applied to the sustain electrodes Z and 0V is applied to the address electrodes X. A voltage on the scan electrodes Y gradually falls from the positive sustain voltage (Vs) to a negative erase voltage (Ve) by means of the negative ramp waveform (NR). A dark discharge is generated between the scan electrodes Y and the sustain electrodes Z as well as between the scan electrodes Y and the address electrodes X within the discharge cells of the entire screen by means of the negative ramp waveform (NR). As a result of the dark discharge of the set-down period (SD), the wall charge distribution within each of the discharge cells 1 is changed to an optimal address condition, as shown in FIG. 6*c*. At this time, excessive wall charges unnecessary for an address discharge are erased from the scan electrodes Y and the address electrodes X within each of the discharge cells 1 except for a predetermined amount of the wall charges. The wall charges on the sustain electrodes Z have its polarity inverted from a positive polarity to a negative polarity as negative wall charges moved from the scan electrodes Y are accumulated on the sustain electrodes Z. While the dark discharge is generated in the set-down period (SD) of the reset period (RP), a gap voltage between the scan electrodes Y and the sustain electrodes Z and a gap voltage between the scan electrodes Y and the address electrodes X becomes close to the firing voltage (Vf).

In the address period (AP), while negative scan pulses (−SCNP) are sequentially applied to the scan electrodes Y, a positive data pulse (DP) is applied to the address electrodes X in synchronization with the scan pulse (−SCNP). A voltage of the scan pulse (−SCNP) is a scan voltage (Vsc), which falls from 0V or a negative scan bias voltage (Vyb) close to 0V to a negative scan voltage (−Vy). A voltage of the data pulse (DP) is a positive data voltage (Va). During the address period (AP), a positive Z bias voltage (Vzb) lower than the positive sustain voltage (Vs) is applied to the sustain electrodes Z. In a state where the gap voltage is adjusted to a voltage close to the firing voltage (Vf) immediately after the reset period (RP), an address discharge is generated between the scan electrodes Y and the address electrodes X while the gap voltage between the electrodes Y, X exceeds the firing voltage (Vf) within on-cells to which the scan voltage (Vsc) and the data voltage (Va) are applied. The first address discharge between the scan electrode Y and the address electrode X generates priming charged particles within the discharge cells, and thus induces a second discharge between the scan electrodes Y and the sustain electrodes Z, as shown in FIG. 6*d*. The wall charge distribution within on-cells in which the address discharge is generated is shown in FIG. 6*e*.

Meanwhile, the wall charge distribution within off-cells in which the address discharge is not generated substantially keeps the state of FIG. 6*c*.

In the sustain period (SP), sustain pulses (SUSP) of a positive sustain voltage (Vs) are alternately applied to the scan electrodes Y and the sustain electrodes Z. A sustain discharge is generated between the scan electrodes Y and the sustain electrodes Z within on-cells selected by the address discharge every sustain pulse (SUSP) owing to the wall charge distribution of FIG. 6*e*. To the contrary, a discharge is not generated within off-cells during the sustain period. This is because the gap voltage between the scan electrodes Y and the sustain electrodes Z cannot exceed the firing voltage (Vf) when the first positive sustain voltage (Vs) is applied to the scan electrodes Y since the wall charge distribution of the off-cells is kept to the state of FIG. 6*c*.

In the conventional plasma display apparatus, however, several discharges are generated in order to control the initialization and wall charges of the discharge cells 1 through the erase period (EP) of the $(n-1)^{th}$ sub-field (SFn−1) and the reset period (RP) of the $n^{th}$ sub-field (SFn). Therefore, problems arise because a dark room contrast value is lowered and the contrast ratio is lowered accordingly.

Furthermore, in the conventional plasma display apparatus, in the case where negative wall charges are excessively accumulated on the scan electrodes Y since wall charges are not smoothly erased in the erase period (EP) of the $(n-1)^{th}$ sub-field (SFn−1), a dark discharge is not generated in the set-up period (SU) of the $n^{th}$ sub-field (SFn). If the dark discharge is not normally generated in the set-up period (SU) as described above, discharge cells are not initialized. In this case, to generate s discharge in the set-up period, the reset voltage (Vr) should become high. If the dark discharge is not generated in the set-up period (SU), a condition within the discharge cells immediately after the reset period does not become an optimal address condition. This results in an abnormal discharge or erroneous discharge. In addition, if positive wall charges are excessively accumulated on the scan electrodes Y soon after the erase period (EP) of the $(n-1)^{th}$ sub-field (SFn−1), a strong discharge is generated when the positive sustain voltage (Vs), i.e., a start voltage of the positive ramp waveform (PR), is applied to the scan electrodes Y in the set-up period (SU) of the $n^{th}$ sub-field (SFn). Therefore, initialization is not uniform over the entire cells. These problems will be described in detail below with reference to FIG. 7.

FIG. 7 is a view illustrating variation in an externally applied voltage and a gap voltage within a discharge cell between scan electrodes and sustain electrodes in a set-up period when the plasma display panel is driven according to the driving waveform as shown in FIG. 5.

FIG. 7 shows an externally applied voltage (Vyz) between the scan electrodes Y and the sustain electrodes Z in the set-up period (SU) and a gap voltage (Vg) within a discharge cell. The externally applied voltage (Vyz), which is indicated by a solid line in FIG. 7, is an external voltage applied to the scan electrodes Y and the sustain electrodes Z. Since 0V of is applied to the sustain electrodes Z, the externally applied voltage (Vyz) is substantially the same as a voltage of the positive ramp waveform (PR). In FIG. 7, dotted lines ①② and ③ indicate gap voltages (Vg) formed in a discharge gas by means of the wall charges within the discharge cell. The gap voltages (Vg) are varied as indicated by dotted lines ①② and ③ because the amount of wall charges within the discharge cells is varied depending on whether a discharge has been generated in a previous sub-field or not. The relation between the externally applied voltage (Vyz) between the scan electrodes Y and the sustain electrodes Z and the gap voltage (Vg) formed in the discharge gas within the discharge cell can be expressed in the following Equation 1.

$$Vyz = Vg + Vw \quad \text{[Equation 1]}$$

In FIG. 7, the gap voltage (Vg) of ① refers to a case where wall charges within a discharge cell are sufficiently erased and the wall charges are sufficiently small. The gap voltage (Vg) increases in proportion to the externally applied voltage (Vyz), but generates a dark discharge if it reaches the firing voltage (Vf). The gap voltage within the discharge cells are initialized to the firing voltage (Vf) by the dark discharge.

In FIG. 7, the gap voltage (Vg) of ② defers to a case where a strong discharge is generated during the erase period (EP) of the $(n-1)^{th}$ sub-field (SFn−1) and thus inverts the polarity of wall charges in the wall charge distribution within the discharge cells. At this time, the polarity of wall charges accumulated on the scan electrodes Y soon after the erase period (EP) is inverted to a positive polarity because of the strong discharge. This case happens when the uniformity of discharge cells is low or a tilt of the erase ramp waveform (ERR) is varied depending on variation in temperature when the size of a PDP is large. In this case, as the initial gap voltage (Vg) excessively rises as indicated by ② FIG. 7, the gap voltage (Vg) exceeds the firing voltage (Vf) while the positive sustain voltage (Vs) is applied to the scan electrodes Y in the set-up period (SU). Therefore, a strong discharge is generated. Since the discharge cells are not initialized to the wall charge distribution of an optimal address condition, i.e., the wall charge distribution of FIG. 6*c* by means of the strong discharge in the set-up period (SU) and the set-down period (SD), an address discharge may be generated in off-cells that should be turned off. In other words, if a strong erase discharge is generated in the erase period prior to the reset period, an erroneous discharge can be generated.

In FIG. 7, the gap voltage (Vg) of ③ refers to a case where a wall charge distribution within discharge cells, which are formed as a result of a sustain discharge generated immediately before an erase discharge, keeps intact because the erase discharge is not generated or very weakly generated during the erase period (EP) of the $(n-1)^{th}$ sub-field (SFn−1). This will be described in more detail. As shown in FIG. 7, the last sustain discharge is generated when the sustain pulse (SUSP) is applied to the scan electrodes Y. As a result of the last sustain discharge, negative wall charges remain on the scan electrodes Y and positive wall charges remain on the sustain electrodes Z. However, although these wall charges must be erased in order for initialization to be normally performed in a next sub-field, the polarity of the wall charges keeps intact if the erase discharge is not generated or the erase discharge is very weakly generated. The reason why the erase discharge is not generated or is very weakly generated is that the uniformity of discharge cells in a PDP is very low or a tilt of the erase ramp waveform (ERR) is changed depending on a variation in temperature. In this case, since the initial gap voltage (Vg) is very low, i.e., a negative polarity as shown in ③ of FIG. 7, the gap voltage (Vg) within the discharge cells does not reach the firing voltage (Vf) even if the positive ramp waveform (PR) rises up to the reset voltage (Vr) in the set-up period. Therefore, a dark discharge is not generated in the set-up period (SU) and the set-down period (SD). Consequently, if an erase discharge is not generated or is very weakly generated in the erase period prior to the reset period, an erroneous discharge or an abnormal discharge is generated because initialization is not normally performed.

In the case of ② in FIG. 7, the relation between the gap voltage (Vg) and the firing voltage (Vf) can be expressed in the following Equation 2. In the case of ③ in FIG. 7, the relation between the gap voltage (Vg) and the firing voltage (Vf) can be expressed in the following Equation 3.

$$Vgini+Vs>Vf \quad \text{[Equation 2]}$$

$$Vgini+Vr<Vf \quad \text{[Equation 3]}$$

where Vgini is an initial gap voltage immediately before the set-up period (SU) as can be seen from FIG. 7.

In consideration of the above problem, a gap voltage condition (or a wall voltage condition) for enabling initialization to be normally performed in the erase period (EP) and the reset period (RP) can be expressed in the following Equation 4, which fulfills both Equations 2 and 3.

$$Vf-Vr<Vgini<Vf-Vs \quad \text{[Equation 4]}$$

As a result, if the initial gap voltage (Vgini) does not fulfill the condition of Equation 4 prior to the set-up period (SU), the conventional plasma display apparatus can generate an erroneous discharge, miss-discharge or abnormal discharge, and has a narrow operational margin. In other words, to secure operational reliability and operational margin in the conventional plasma display apparatus, an erase operation in the erase period (EP) should be normally performed. However, the erase operation can be performed abnormally depending on the uniformity of discharge cells and a use temperature of a PDP, as described above.

Furthermore, in the conventional plasma display apparatus, an erroneous discharge, miss-discharge or an abnormal discharge can be generated due to excessive spatial charges occurring under a high-temperature environment and an unstable wall charge distribution due to the amount of active motion of the spatial charges. Therefore, a problem arises because operational margin is narrowed. This will be described in detail in connection with FIGS. 8*a* to 8*c*.

FIGS. 8*a* to 8*c* are views illustrating spatial charges and the behavior of the spatial charges when the plasma display panel is driven according to the driving waveform as shown in FIG. 5 under high temperature environment.

The amount of spatial charges generated upon discharge and the amount of motion thereof under high temperature environment, are greater than those at room temperature or a low temperature. Therefore, in a sustain discharge of a $(n-1)^{th}$ sub-field (SFn−1), lots of spatial charges are generated. Lots of spatial charges 300 within the discharge space remain active even immediately after the set-up period (SU) of the $n^{th}$ sub-field (SFn), as shown in FIG. 8*a*.

If the data voltage (Va) is applied to the address electrodes X and the scan voltage (−Vy) is applied to the scan electrodes Y during the address period in a state where the spatial charges 300 having active motion exist in the discharge space, as shown in FIG. 8*a*, negative spatial charges 300 are recombined with negative wall charges that have been accumulated on the scan electrodes Y as a result of the set-up discharge of the set-up period (SU), and negative spatial charges 300 are also recombined with positive wall charges that have been accumulated on the address electrodes Y as a result of the set-up discharge of the set-up period (SU), as shown in FIG. 8*b*.

As a result, as shown in FIG. 8*c*, the negative wall charges on the scan electrodes Y, which have been formed by the set-up discharge, and the positive wall charges on the address electrodes X, which have been formed by the set-up discharge, are erased. Although the data voltage (Va) and the scan voltage (−Vy) are applied to the address electrodes X and the scan electrodes Y, the gap voltage (Vg) does not reach the firing voltage (Vf). Therefore, an address discharge is not generated. Therefore, if the driving waveform as shown in FIG. 5 is applied to a PDP used under high temperature environment, a problem arises because miss-writing of on-cells is frequently generated.

FIG. 8*d* is a view illustrating an erroneous discharge depending on the temperature in the plasma display apparatus that is operated according to the driving waveform depending on the driving method in the related art.

Referring to FIG. 8*d*, in the plasma display apparatus that is operated according to the driving waveform depending on the driving method in the related art, in the case where the temperature around the panel is relatively high, the ratio in which spatial charges 401 and wall charges 400 within a discharge cell are recombined is increased. Therefore, an erroneous discharge is generated because an absolute amount of wall charges that take part in a discharge is reduced. The aforementioned spatial charges 401 are charges existing in the spaces within the discharge cell and do not take part in a discharge unlike the wall charges 400.

For example, the ratio in which the spatial charges 401 and the wall charges 400 within a discharge cell are recombined in the address period is increased and the amount of the wall charges 400 taking part in the address discharge is decreased. This makes unstable the address discharge. In this case, a time where the spatial charges 401 and the wall charges 400 can be recombined is sufficiently secured as the order of addressing is later. This further makes unstable the address discharge. Therefore, a high temperature erroneous discharge, such as that discharge cells, which have been turned on in the address period, are turned off in the sustain period, is generated.

Furthermore, in the case where the temperature around the panel is relatively high, if a sustain discharge is generated in the sustain period, the speed of the spatial charges 401 becomes fast during a discharge. This increases the ratio in which the spatial charges 401 and the wall charges 400 are recombined. Therefore, the amount of the wall charges 400 that participate in the sustain discharge is reduced due to the recombination of the spatial charges 401 and the wall charges 400 after any one sustain discharge, which prevents a next sustain discharge form occur. Therefore, a problem arises because a high temperature erroneous discharge is generated.

SUMMARY OF THE INVENTION

Accordingly, an object of the present invention is to solve at least the problems and disadvantages of the background art.

It is an object of the present invention to provide a plasma display apparatus and driving method thereof, in which a discharge is stabilized under high temperature environment and scanning is performed according to selected one or more of a plurality of scan types, preventing electrical damage to an driver IC.

The plasma display apparatus of the present invention comprises a plasma display panel comprising a plurality of scan electrodes, a plurality of sustain electrodes, and a plurality of data electrodes crossing the plurality of scan electrodes and the sustain electrodes, and a controller for scanning the scan electrodes using one of a plurality of scan types in which the order of scanning the plurality of scan electrodes is different in an address period, applies a data pulse to the data electrodes corresponding to one scan type, and controls a difference between an application time point of a last sustain pulse of sustain pulses, which are applied to the scan electrodes or the sustain electrode in a sustain period subsequent to the address period, and a application time point of a reset pulse, which is applied to the scan electrodes in a reset period of a next sub-field, to be greater than a difference between application time points of the two sustain pulses, in at least one of sub-fields of a frame.

The present invention can reduce generation of noise and stabilize a discharge of a PDP under high temperature environment. It is thus possible to prohibit generation of an erroneous discharge depending on a temperature.

BRIEF DESCRIPTION OF THE DRAWINGS

The invention will be described in detail with reference to the following drawings in which like numerals refer to like elements.

FIG. 18 is a table showing pattern contents of image data depending on output signals of first to third decision units XOR1, XOR2 and XOR3 included in the data comparator according to a first embodiment of the present invention;

FIG. 20 is a table showing pattern contents of image data depending on output signals of first to ninth decision units XOR1 to XOR9 included in the circuit block of FIG. 19 according to a first embodiment of the present invention;

DETAILED DESCRIPTION OF THE PREFERRED EMBODIMENT

Preferred embodiments of the present invention will be described in a more detailed manner with reference to the drawings.

Figure 9A:
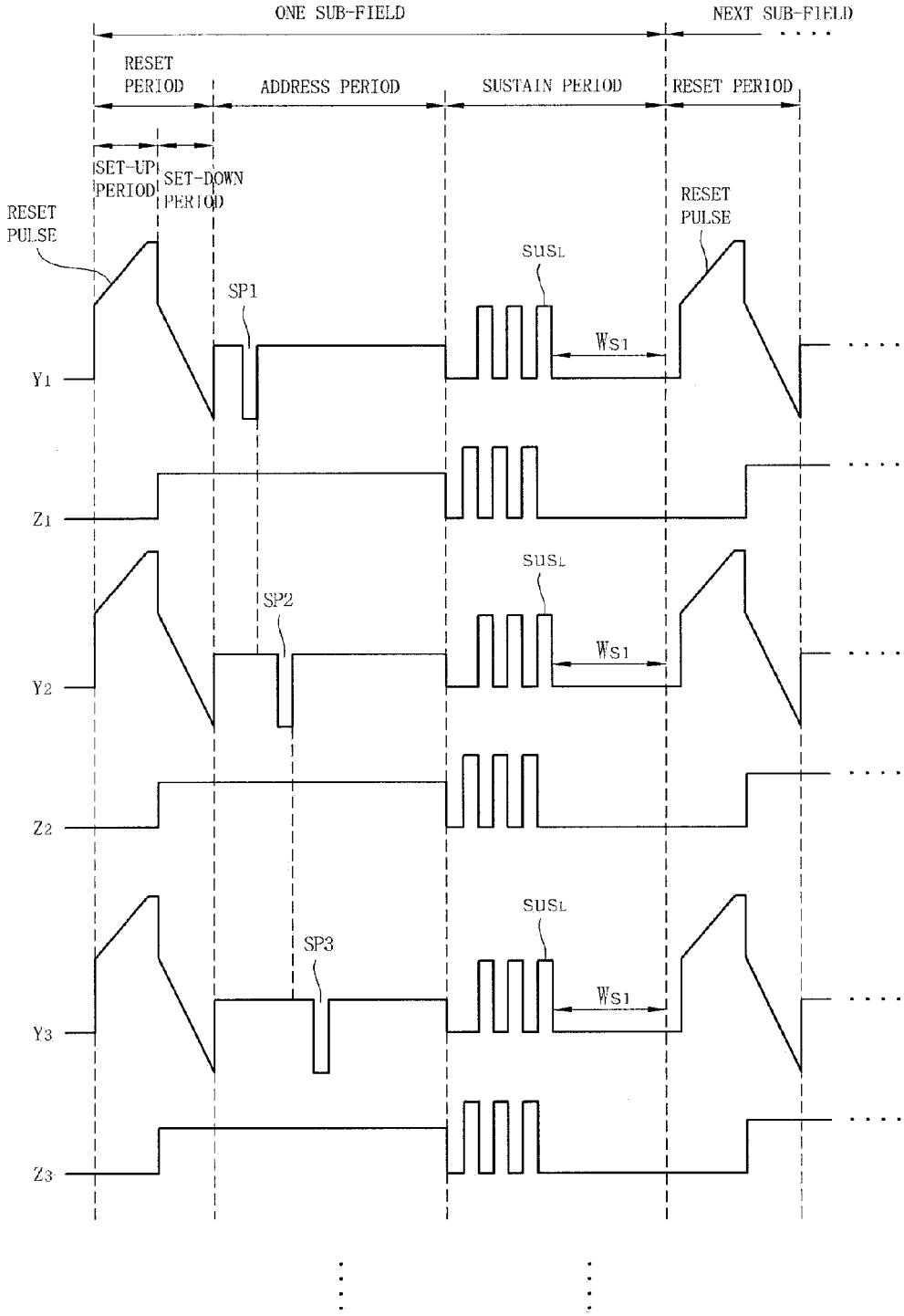
FIGS. 9*a* and 9*b* are views illustrating a driving method of a plasma display apparatus according to a first embodiment of the present invention.
Figure 9B:
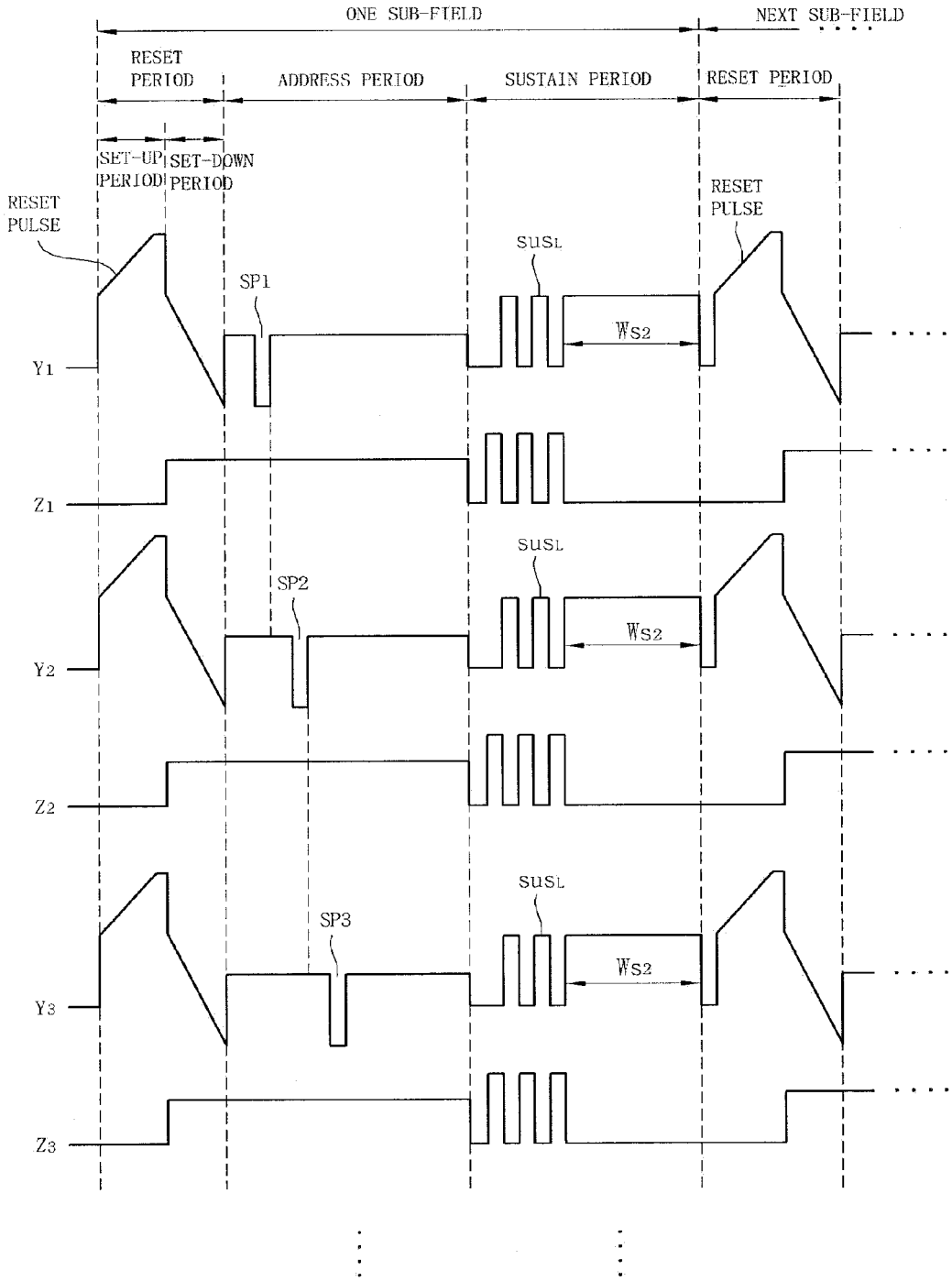

FIGS. 9*a* and 9*b* are views illustrating a driving method of a plasma display apparatus according to a first embodiment of the present invention.

Referring first to FIG. 9*a*, in the method of driving the plasma display apparatus according to a first embodiment of the present invention, the plasma display apparatus is driven with a driving waveform being divided into a reset period, an address period and a sustain period in one frame, as described above.

In a set-up period of the reset period, a ramp-up waveform (Ramp-up) is applied to scan electrodes Y. The ramp-up waveform generates a weak dark discharge within discharge cells of the entire screen. The ramp-up discharge also causes positive wall charges to be accumulated on data electrodes X and sustain electrodes Z, and negative wall charges to be accumulated on the scan electrodes Y.

In a set-down period of the reset period, after the ramp-up waveform is applied to the scan electrodes Y, a ramp-down waveform (Ramp-down), which falls from a positive voltage lower than a peak voltage of the ramp-up waveform to a predetermined voltage level lower than a ground (GND) level voltage, generates a weak erase discharge within the discharge cells, thus sufficiently erasing wall charges excessively formed on the scan electrodes Y. The set-down discharge causes wall charges of the degree in which a data discharge can be stably generated to uniformly remain within the cells.

In the address period, as a negative scan pulse, which falls from a scan reference voltage (Vsc), is applied to the scan electrodes Y, the scan electrodes Y are scanned. A positive data pulse is applied to the data electrodes X corresponding to the scan pulse.

As a voltage difference between the scan pulse and the data pulse and a wall voltage generated in the reset period are added, an address discharge is generated within discharge cells to which the data pulse is applied. Wall charges of the degree in which a discharge can be generated when a sustain voltage (Vs) is applied are formed within discharge cells selected by the address discharge.

In this case, when the plurality of scan electrodes Y is scanned in the address period, the scan electrodes Y are scanned according to one of a plurality of scan types in which the order of scanning the plurality of scan electrodes Y is different.

For example, as in FIG. 9*a*, a scan electrode Y1 of the plurality of scan electrodes can be first scanned by applying a first scan pulse (SP1) to the scan electrode Y1. A next scan electrode Y2 can be then scanned by applying a second scan pulse (SP2) to the scan electrode Y2. A next scan electrode Y3 can be then scanned by applying a third scan pulse (SP3) to the scan electrode Y3. This will be described in more detail later on.

In the sustain period subsequent to the address period, a sustain pulse (Sus) is alternately applied to one or more of the scan electrodes Y and the sustain electrodes Z. As a wall voltage within the discharge cells and the sustain pulse are added, a sustain discharge, i.e., a display discharge is generated between the scan electrodes Y and the sustain electrodes Z in the discharge cells selected by the address discharge whenever the sustain pulse is applied.

In this sustain period, a difference (Ws1) between an application time of a last sustain pulse (SUSL) of sustain pulses applied to the scan electrodes Y in a sustain period of at least one of sub-fields of a frame and an application time of a reset pulse applied to the scan electrodes Y in a reset period of a next sub-field is set to be greater than that between application times of two sustain pulses.

FIG. 9*a* shows only a case where the last sustain pulse (SUSL) is applied to the scan electrodes Y. However, the last sustain pulse (SUSL) can also be applied to the sustain electrodes Z.

In FIG. 9*a*, after the application of the last sustain pulse (SUSL) is finished, a voltage of the scan electrodes Y is kept to a voltage of a ground level (GND) so that the difference (Ws1) between an application time of the last sustain pulse (SUSL) and an application time of a reset pulse applied to the scan electrodes Y in a reset period of a next sub-field is relatively great. However, a difference between an application time of the last sustain pulse (SUSL) and an application time of a reset pulse applied to the scan electrodes Y in a reset period of a next sub-field can be set to be relatively long through other methods. This is shown in FIG. 9*b*.

Referring to FIG. 9*b*, a difference between an application time of the last sustain pulse (SUSL) and an application time of a reset pulse applied to the scan electrodes Y in a reset period of a next sub-field is set to be relatively great by increasing a pulse width of the last sustain pulse (SUSL).

The method in which a difference between an application time of the last sustain pulse (SUSL) and an application time of a reset pulse applied to the scan electrodes Y in a reset period of a next sub-field is set to be relatively great will be described in more detail later on.

In this case, the method of scanning the plurality of scan electrodes Y using one of a plurality of scan types in which the order of scanning the plurality of scan electrodes Y is different will be described in more detail below.

An important factor to decide one of the plurality of scan types is the amount of a displacement current (Id) depending on image data. This will be described with reference to FIG. 10.

Figure 10:
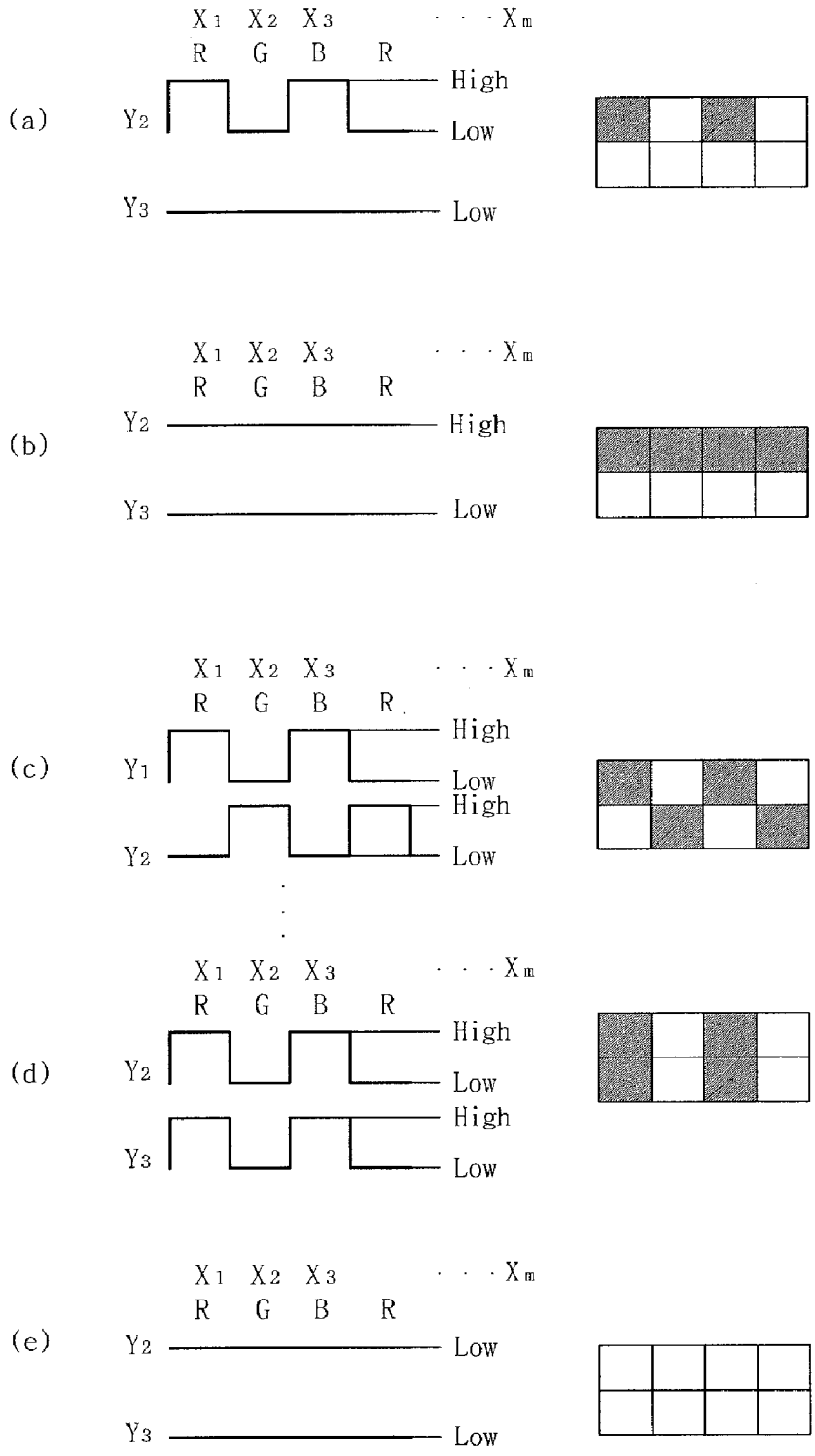
FIG. 10 is a view illustrating the amount of a displacement current depending on input image data.

FIG. 10 is a view illustrating the amount of a displacement current depending on input image data.

Referring to FIG. 10, as in (a), when a second scan electrode Y2 is scanned, i.e., when a scan pulse is supplied to the second scan electrode Y2, data electrodes, such as data electrodes X1 to Xm, are supplied with image data having an alternating logic value of 1 (high) and 0 (low). Furthermore, when a third scan electrode Y3 is scanned, the data electrodes X are kept to the logic value 0. The logic value 1 is a state where a voltage of the data pulse, i.e., a state where a data voltage (Vd) is applied to corresponding data electrodes X. The logic value 0 is a state where 0V is applied to corresponding data electrodes X, i.e., a state where the data voltage (Vd) is not applied.

That is, image data whose logic value alternates between 1 and 0 is applied to a discharge cell on one scan electrode Y. Image data that are kept to the logic value 0 are applied to a discharge cell on a next scan electrode Y. At this time, the displacement current (Id) flowing through each of the data electrodes X can be expressed in the following Equation 1.

$$Id=\tfrac{1}{2}(Cm1+Cm2)Vd \qquad \text{[Equation 1]}$$

Id: The displacement current flowing through each of the data electrodes X

Cm1: Equivalent capacitance between the data electrodes X

Cm2: Equivalent capacitance between the data electrodes X and the scan electrodes Y or between the data electrodes X and the sustain electrodes Z Vd: A voltage of the data pulse, which is applied to each of the data electrodes X As in (b), when the second scan electrode Y2 is scanned, image data whose logic value is kept to 1 are supplied to the data electrodes X1 to Xm. Furthermore, when the third scan electrode Y3 is scanned, image data whose logic value is kept to 0 are supplied to the data electrodes X1 to Xm. The logic value 0 is a state where 0V is applied to corresponding data electrodes X, i.e., a state where the data voltage (Vd) is not applied, as described above.

That is, this is a case where image data whose logic value is kept to 1 are supplied to a discharge cell on one scan electrode Y and image data whose logic value is kept to 0 are supplied to a discharge cell on a next scan electrode Y. Furthermore, this is true of a case where image data whose logic value is kept to 0 are supplied to a discharge cell on one scan electrode Y and image data whose logic value is kept to 1 are supplied to a discharge cell on a next scan electrode Y. At this time, the displacement current (Id) flowing through each of the data electrodes X can be expressed in the following Equation 2.

$$Id=\tfrac{1}{2}(Cm2)Vd \qquad \text{[Equation 2]}$$

Id: Displacement current flowing through each of the data electrodes X

Cm2: Equivalent capacitance between the data electrodes X and the scan electrodes Y or between the data electrodes X and the sustain electrodes Z Vd: Voltage of the data pulse, which is applied to each of the data electrodes X As in (c), when the second scan electrode Y2 is scanned, image data whose logic value is alternately changed between 1 and 0 are supplied to the data electrodes X1 to Xm. Furthermore, when the third scan electrode Y3 is scanned, image data whose logic value is alternately changed between 1 and 0 are supplied so that the image data have a phase, which is shifted by 180° from the phase of the image data applied to the discharge cell on the second scan electrode Y2.

That is, the image data whose logic value is alternately changed between 1 and 0 are supplied to a discharge cell on one scan electrode Y. The image data whose logic value is alternately changed between 1 and 0 are supplied to a discharge cell on a next scan electrode Y so that the image data have a phase, which is shifted by 180° from the phase of the image data applied to the discharge cell on one scan electrode Y. The displacement current (Id) flowing through each of the data electrodes X can be expressed in the following Equation 3.

$$Id=\tfrac{1}{2}(4Cm1+Cm2)Vd \qquad \text{[Equation 3]}$$

Id: Displacement current flowing through each of the data electrodes X

Cm2: Equivalent capacitance between the data electrodes X and the scan electrodes Y or between the data electrodes X and the sustain electrodes Z Vd: Voltage of the data pulse, which is applied to each of the data electrodes X As in (d), when the second scan electrode Y2 is scanned, image data whose logic value is alternately changed between 1 and 0 are supplied to the data electrodes X1 to Xm. Furthermore, when the third scan electrode Y3 is scanned, image data whose logic value is alternately changed between 1 and 0 are supplied so that the image data have the same phase as that of the image data applied to the discharge cell on the second scan electrode Y2.

That is, the image data whose logic value is alternately changed between 1 and 0 are supplied to the discharge cell on one scan electrode Y. The image data whose logic value is alternately changed between 1 and 0 are supplied to a discharge cell on a next scan electrode Y so that the image data have the same phase as that of the image data applied to the discharge cell on one scan electrode Y. At this time, the displacement current (Id) flowing through each of the data electrodes X can be expressed in the following Equation 4

$$Id=0 \qquad \text{[Equation 4]}$$

Id: Displacement current flowing through each of the data electrodes X

Cm2: Equivalent capacitance between the data electrodes X and the scan electrodes Y or between the data electrodes X and the sustain electrodes Z Vd: Voltage of the data pulse, which is applied to each of the data electrodes X As in (e), when the second scan electrode Y2 is scanned, image data whose logic value is kept to 0 are supplied to the data electrodes X1 to Xm. Furthermore, when the third scan electrode Y3 is scanned, image data whose logic value is kept to 0 are also supplied to the data electrodes X1 to Xm.

That is, image data whose logic value is kept to 0 are supplied to a discharge cell on one scan electrode Y, and image data whose logic value is kept to 0 are supplied to a discharge cell on a next scan electrode Y.

Furthermore, this is true of a case where image data whose logic value is kept to 1 are supplied to a discharge cell on one scan electrode Y and image data whose logic value is kept to 1 are supplied to a discharge cell on a next scan electrode Y. At this time, the displacement current (Id) flowing through each of the data electrodes X can be expressed in the following Equation 5.

$$Id=0 \quad \text{[Equation 5]}$$

Id: Displacement current flowing through each of the data electrodes X

Cm2: Equivalent capacitance between the data electrodes X and the scan electrodes Y or between the data electrodes X and the sustain electrodes Z Vd: Voltage of the data pulse, which is applied to each of the data electrodes X From Equations 1 to 5, it can be seen that a case where image data whose logic value is alternately changed between 1 and 0 are supplied to the discharge cell on one scan electrode Y and image data whose logic value is alternately changed between 1 and 0 are supplied to a discharge on a next scan electrode Y so that the image data have a phase, which is shifted by 180° from a phase of the image data applied to the discharge cell on one scan electrode Y has the highest displacement current flowing through the data electrodes X.

Meanwhile, it can be seen that a case where image data whose logic value is alternately changed between 1 and 0 are supplied to a discharge cell on one scan electrode Y and image data whose logic value is alternately changed between 1 and 0 are supplied to a discharge cell on a next scan electrode Y so that the image data have the same phase as that of the image data applied to the discharge cell on one scan electrode Y, and a case where image data whose logic value is kept to 0 are supplied both to a discharge cell on one scan electrode Y and a discharge cell on a next scan electrodes Y have the lowest displacement current flowing through the data electrodes X.

From the description of FIG. 10, it can be seen that in the case where image data having different logic levels are alternately provided as in FIG. 10(*c*), the highest displacement current flows, and a possibility that the data driver IC can experience the greatest electrical damage is the highest in this case.

In other words, from the viewpoint of the data driver IC responsible for one data electrode X, the image data as shown in FIG. 10(*c*) correspond to a case where the switching number of the data driver IC is the highest. Therefore, it can be seen that the greater the switching operation number of the data driver IC, the more the displacement current flowing through the data driver IC and the higher the possibility that the data driver IC may undergo electrical damage.

An example of changing the scan order considering these image data and the amount of the displacement current accordingly will be described with reference to FIGS. 11*a* and 11*b*.

Figure 11A:
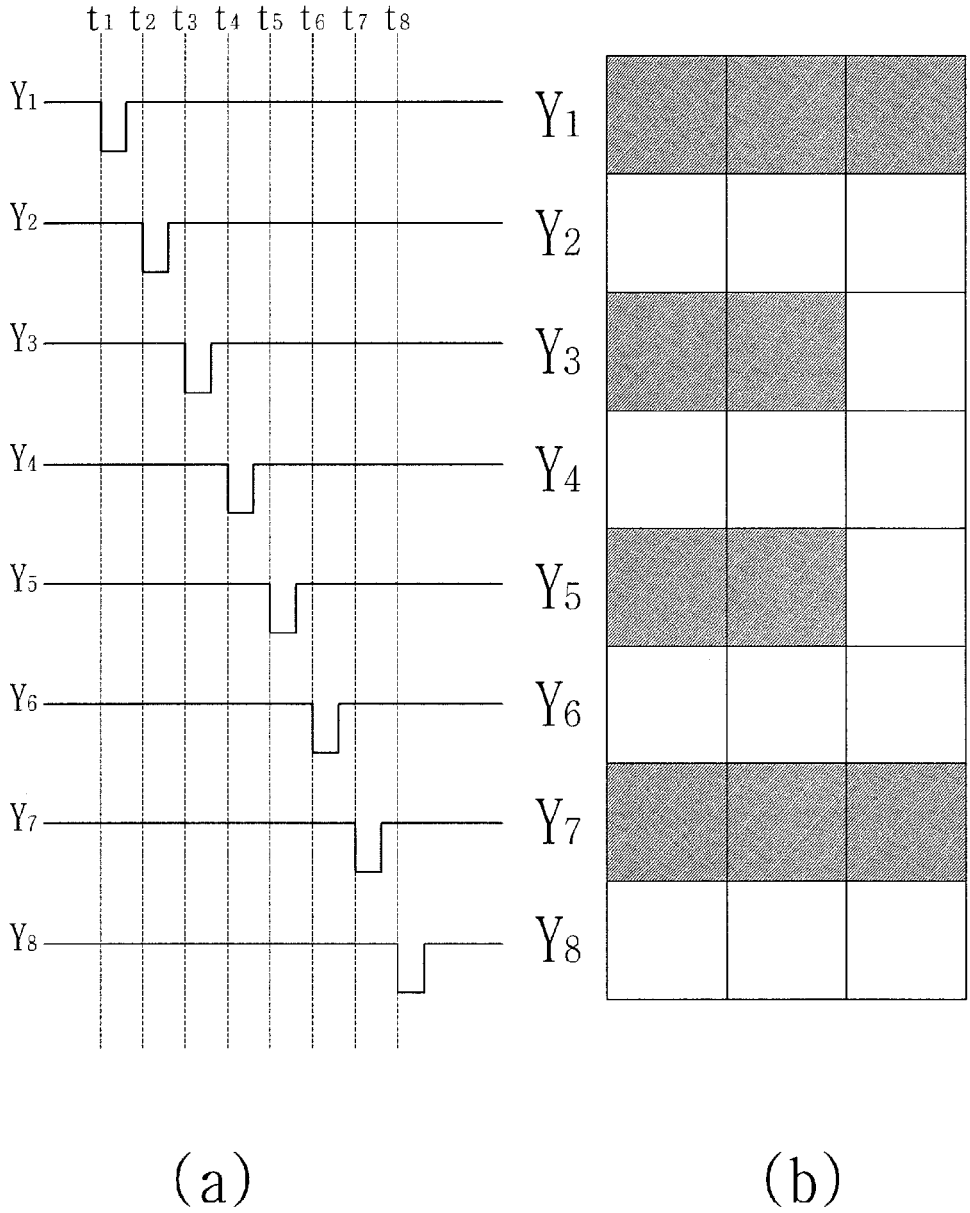
FIGS. 11*a* and 11*b* are views illustrating an exemplary method of changing a scan order considering image data and a displacement current accordingly.
Figure 11B:
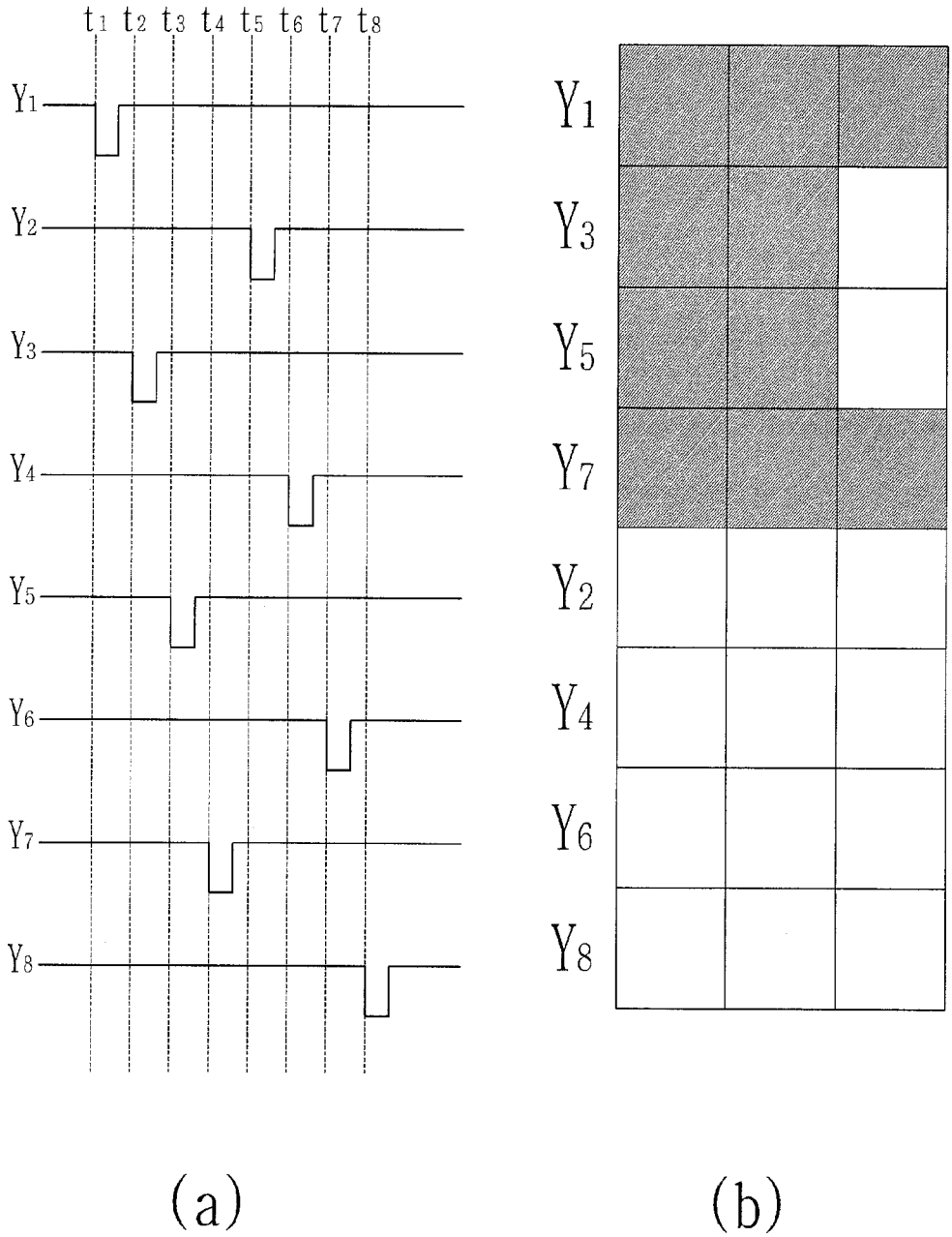

FIGS. 11*a* and 11*b* are views illustrating an exemplary method of changing a scan order considering image data and a displacement current accordingly.

From FIGS. 11*a* and 11*b*, it can be seen that FIGS. 11*a* and 11*b* show the same image data except for its scan order, i.e., a scanning order.

Referring first to FIG. 11*a*, in the case where image data of a pattern as shown in (b) are supplied, if the scan electrodes Y are scanned in the same order as that of (a), a relatively high displacement current is generated because the frequency that a logic value of image data is changed in a direction where the scan electrodes Y are arranged is relatively frequent.

If the scanning order of the scan electrodes Y is again adjusted as in (a) of FIG. 11*b*, it results in that the image data of this pattern are arranged as shown in (b) of FIG. 11*b*. In this case, since the frequency that the logic value of image data is changed in a direction where the scan electrodes Y are arranged is reduced, a displacement current generated is reduced.

As a result, if the scanning order of the scan electrodes Y is controlled according to the image data as in FIG. 11*b*, the amount of the displacement current flowing through the data driver IC can be reduced and a possibility that the data driver IC may experience electrical damage is reduced.

The method of driving the plasma display apparatus according to the present invention has been developed on the basis of the principle as in FIGS. 11*a* and 11*b*. Another application example in the method of driving the plasma display apparatus according to the present invention will be described with reference to FIG. 12.

Figure 12:
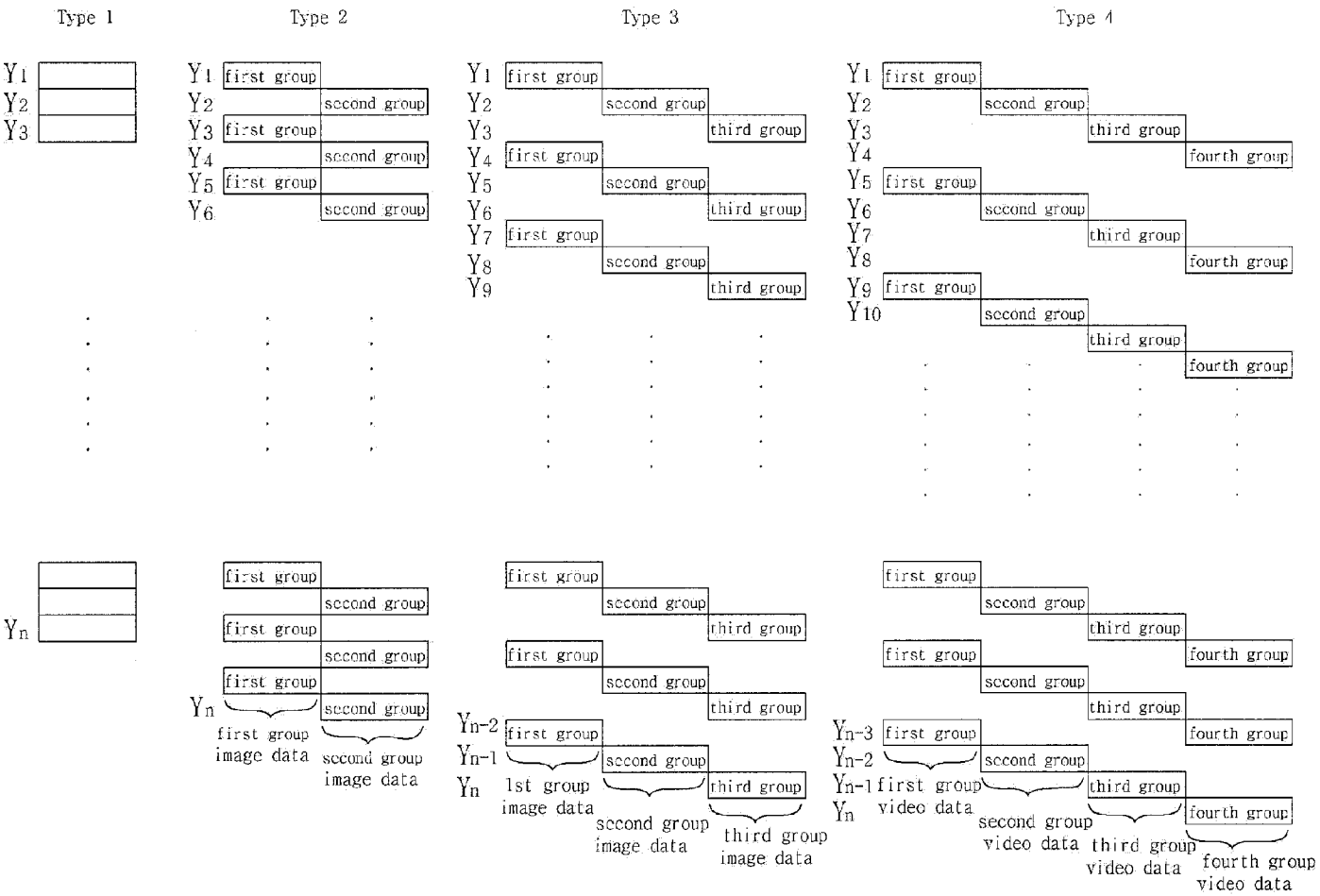
FIG. 12 is a view illustrating another application example in a driving method of a plasma display apparatus according to a first embodiment of the present invention.

FIG. 12 is a view illustrating another example in a driving method of a plasma display apparatus according to a first embodiment of the present invention.

Referring to FIG. 12, the method of driving the plasma display apparatus according to the present invention can perform scanning using a selected one of four scan types, i.e., a first type (Type 1), a second type (Type 2), a third type (Type 3) and a fourth type (Type 4), as shown in FIG. 12.

In the scan order of the first scan type (Type 1), scanning is performed in an order in which scan electrodes Y are arranged like Y1-Y2-Y3- . . . .

In the scan order of the second scan type (Type 2), scan electrodes Y belonging to a first group are sequentially scanned, and scan electrodes Y belonging to a second group are sequentially scanned. That is, the scan electrodes Y1-Y3-Y5-, . . . , Yn−1 are scanned and the scan electrodes Y2-Y4-Y6-, . . . , Yn are scanned.

In the scan order of the third scan type (Type 3), after scan electrodes Y belonging to a first group are sequentially scanned and scan electrodes Y belonging to a second group are sequentially scanned, scan electrodes Y belonging to a third group are sequentially scanned. That is, after the scan electrodes Y1-Y4-Y7-, . . . , Yn−2 are scanned and the scan electrodes Y2-Y5-Y8-, . . . , Yn−1 are scanned, the scan electrodes Y3-Y6-Y9-, . . . , Yn are scanned.

In the scan order of the fourth scan type (Type 4), after scan electrodes Y belonging to a first group are sequentially scanned, scan electrodes Y belonging to a second group are sequentially scanned and scan electrodes Y belonging to a third group are sequentially scanned, scan electrodes Y belonging to a fourth group are sequentially scanned. That is, after scan electro Y1-Y5-Y9-, . . . , Yn−3 are scanned, scan electrodes Y2-Y6-Y10-, . . . , Yn−2 are scanned, scan electrodes Y3-Y7-Y11-, . . . , Yn−1 are scanned, scan electrodes Y4-Y8-Y12-, . . . , Yn are scanned.

In FIG. 12, the method of scanning the scan electrodes Y using a selected one of the four kinds of scan types has been shown. However, the present invention is not limited to the above method. A method of scanning the scan electrodes Y using a selected one of various numbers of scan types, such as two kinds of scan types, three kinds of scan types and five kinds of scan types, is also possible.

Figure 1:
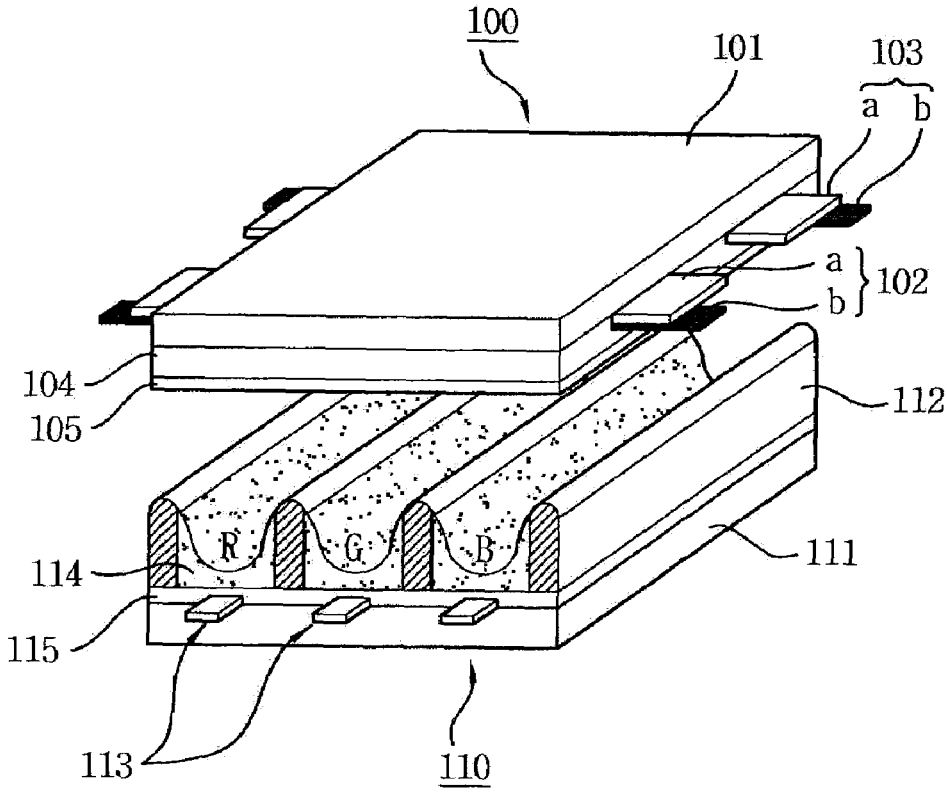
Fig. 1 Prior Art
FIG. 1 is a view showing the construction of a general PDP.
Figure 2:
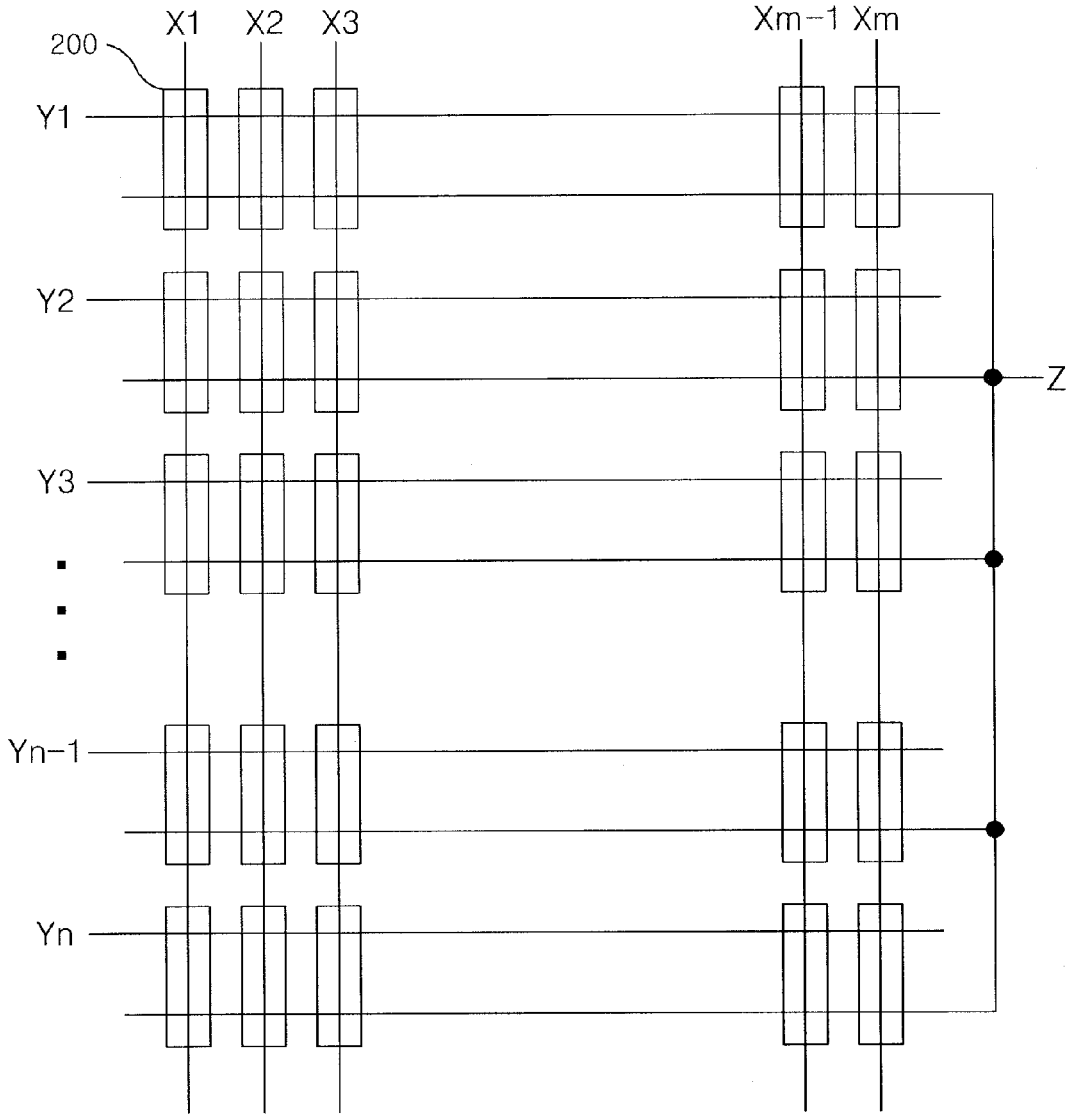
Fig. 2 Prior Art
FIG. 2 is a view schematically showing the arrangement of electrodes of a three-electrode AC surface-discharge type PDP.

A detailed construction of the scan driver 202 in FIG. 2, for scanning the scan electrodes Y using one of a plurality of scan types as described above, will be described with reference to FIG. 13.

Figure 13:
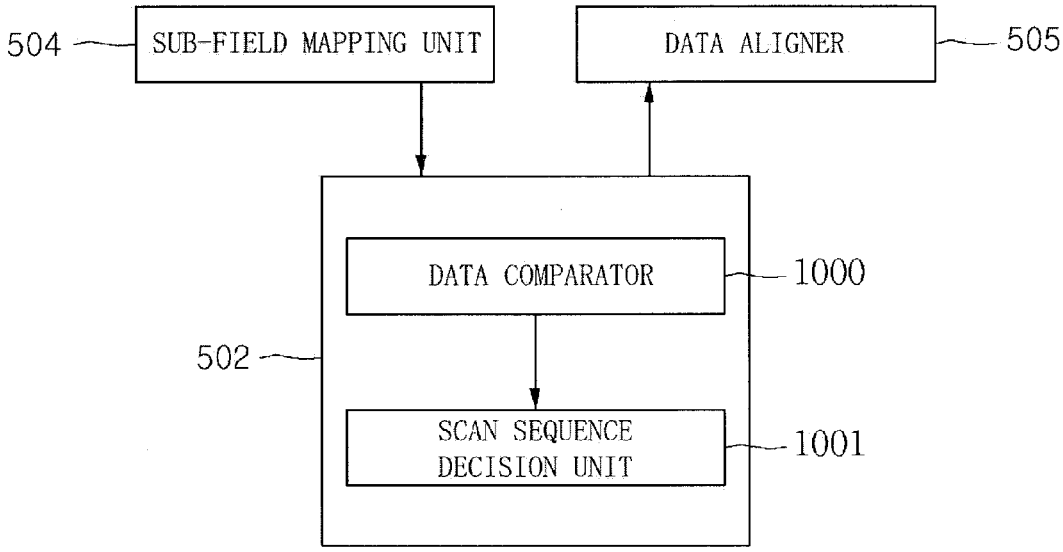
FIG. 13 is a view illustrating the construction and operation of a scan driver for realizing the method of driving the plasma display apparatus according to a first embodiment of the present invention.

FIG. 13 is a view illustrating the construction and operation of the scan driver for realizing the method of driving the plasma display apparatus according to a first embodiment of the present invention.

Referring to FIG. 13, the scan driver for implementing the method of driving the plasma display apparatus according to the present invention can comprise a data comparator 1000 and a scan order decision unit 1001.

The data comparator 1000 receives image data, which are mapped by the sub-field mapping unit 204, and calculates the amount of the displacement current by comparing image data of a cell bundle consisting of one or more discharge cells located on a specific scan electrode Y line and image data of a cell bundle located in vertical and horizontal directions of the cell bundle using a plurality of scan types.

The term "cell bundle" refers to that one or more cells are bundled to form one unit. For example, since cells corresponding to R, G and B are bundled to form one pixel, a pixel corresponds to the cell bundle.

The scan order decision unit 1001 decides a scan order using a scan type having the lowest displacement current based on information on the amount of the displacement current, which is calculated by the data comparator 1000.

Information on the scan order, which is decided by the scan order decision unit 1001, is applied to the data aligner 205. The data aligner 205 realigns the image data, which are sub-field mapped by the sub-field mapping unit 204 according the scan order decided by the above-described scan order decision unit 1001, and supplies the re-aligned image data to the data electrodes X.

The construction of the scan driver 202 of FIG. 13 will be described in conjunction with FIG. 12. If the amount of the displacement current with respect to the four kinds of the scan types in FIG. 12 is calculated by the data comparator 1000 of FIG. 13 and information on the amount of the displacement current with respect to the four kinds of the scan types is applied to the scan order decision unit 1001, the scan order decision unit 1001 compares the amounts of the displacement currents with respect to the four kinds of the scan types, and selects one scan type having the lowest displacement current. For example, assuming that the amount of the displacement current with respect to the first scan type is 10, the amount of the displacement current with respect to the second scan type is 15, the amount of the displacement current with respect to the third scan type is 11 and the amount of the displacement current with respect to the fourth scan type is 8, the scan order decision unit 1001 selects the fourth scan type, and decides a scanning order of the scan electrodes Y according to the selected fourth scan type.

Meanwhile, if amounts of the displacement current with respect to all the scan types of the four kinds of scan types, i.e., the first, third and fourth scan types other than the second scan type is sufficiently low so that it does not cause electrical damage to the data driver IC, the scan order decision unit 1001 can select any one of the first, third and fourth scan types.

In this case, information on current, which is sufficiently low enough not to cause electrical damage to the data driver IC, can be previously set. That is, the highest value of current, which is sufficiently low enough not to cause electrical damage to the data driver IC, is previously set as a critical current. A scan type in which a displacement current lower than the critical current is generated can be selected.

The data comparator 100 shown in FIG. 13 will be described in more detail below with reference to FIG. 14.

Figure 14:
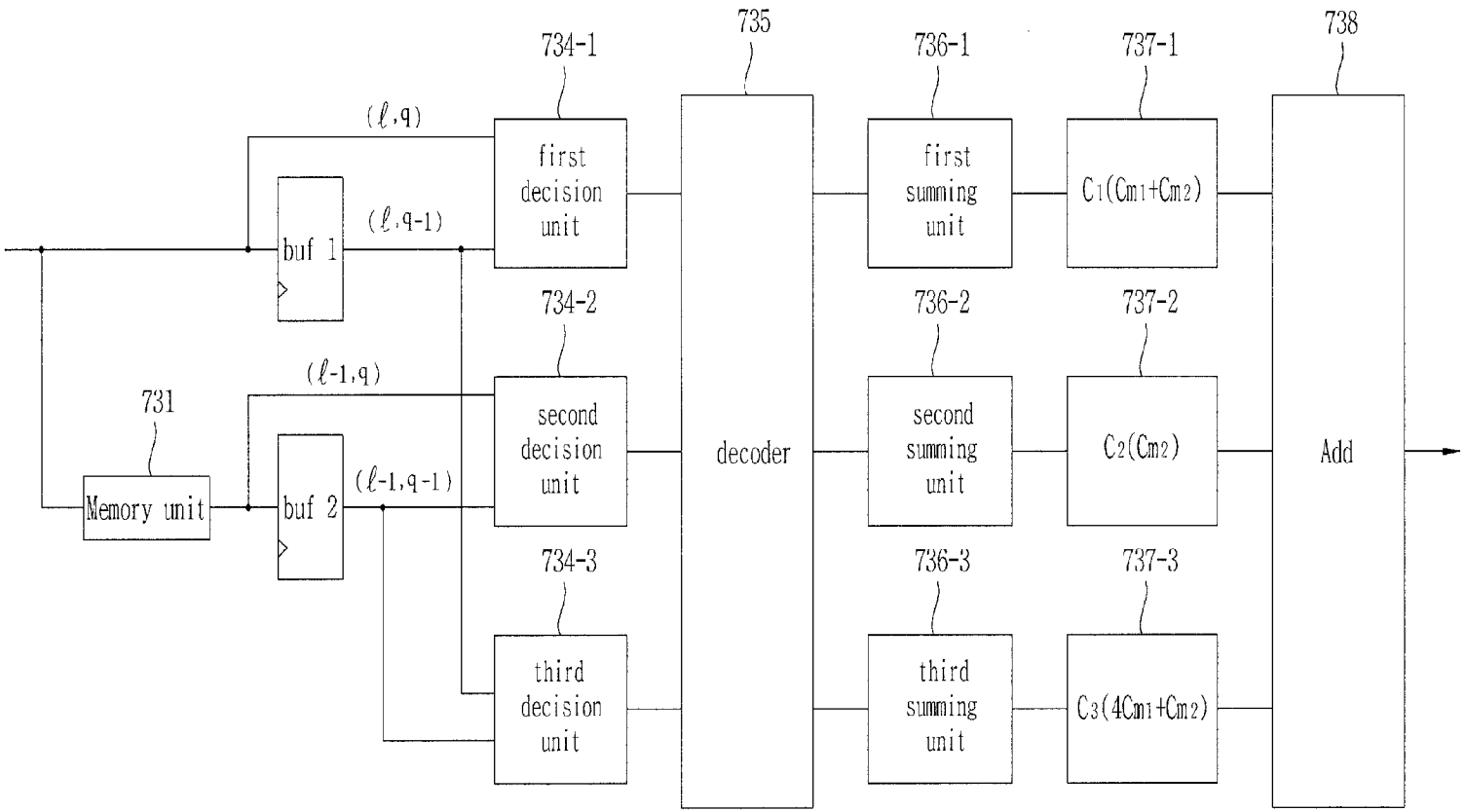
FIG. 14 shows a basic circuit block included in a data comparator 1000 included in the scan driver of the plasma display apparatus according to a first embodiment of the present invention.

FIG. 14 shows a basic circuit block included in a data comparator 1000, which is included in the scan driver of the plasma display apparatus according to a first embodiment of the present invention.

As shown in FIG. 14, in the plasma display apparatus of the present invention, the basic circuit block included in the data comparator 1000 of the scan driver comprises a memory unit 731, a first buffer buf1, a second buffer buf2, first to third decision units 734-1, 734-2 and 734-3, a decoder 735, first to third summation units 736-1, 736-2 and 736-3, first to third current calculators 737-1, 737-2 and 737-3, and a current summation unit 738.

Image data corresponding to a $(l-1)^{th}$ scan electrode, i.e., a $(l-1)^{th}$ scan electrode line are stored in the memory unit 731. Image data corresponding to a $l^{th}$ scan electrode, i.e., a $l^{th}$ scan electrode line are input.

The first buffer buf1 temporarily stores image data of a $(q-1)^{th}$ discharge cell of discharge cells corresponding to the $l^{th}$ scan electrode line.

The second buffer buf2 temporarily stores image data of a $(q-1)^{th}$ discharge cell of discharge cells corresponding to the $(l-1)^{th}$ scan electrode line, which are stored in the memory unit 731.

The first decision unit 734-1 comprises an XOR gate element, and it compares the image data of a $q^{th}$ discharge cell of the $l^{th}$ scan electrode line and the image data of the $(q-1)^{th}$ discharge cell of the $l^{th}$ scan electrode line, which are stored in the first buffer buf1. As a result of the comparison, if the two image data are different from each other, the first decision unit 734-1 outputs 1. If the two image data are identical to each other, the first decision unit 734-1 outputs 0.

The second decision unit 734-2 comprises an XOR gate element, and it compares the image data of the $q^{th}$ discharge cell of the $(l-1)^{th}$ scan electrode line and the image data of the $(q-1)^{th}$ discharge cell of the $(l-1)^{th}$ scan electrode line, which are stored in the second buffer buf2. As a result of the comparison, if the two image data are different from each other, the second decision unit 734-2 outputs 1. If the two image data are identical to each other, the second decision unit 734-2 outputs 0.

The third decision unit 734-3 comprises an XOR gate element, and it compares the image data of the $(q-1)^{th}$ discharge cell of the $l^{th}$ scan electrode line, which are stored in the first buffer buf1, and the image data of the $(q-1)^{th}$ discharge cell of the $(l-1)^{th}$ scan electrode line, which are stored in the second buffer buf2. As a result of the comparison, if the two image data are different from each other, the third decision unit 734-3 outputs 1. If the two image data are identical to each other, the third decision unit 734-3 outputs 0.

The operation of the first to third decision units included in the basic circuit block of the data comparator 1000 constructed above will be described in more detail below with reference to FIG. 15.

Figures 15, 16:
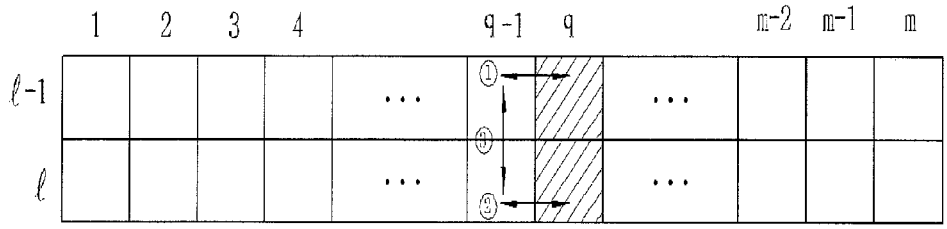
FIG. 15 is a view illustrating, in more detail, the operation of first to third decision units of a data comparator.
FIG. 16 is a table showing pattern contents of image data depending on output signals of first to third decision units 734-1, 734-2 and 734-3 included in the basic circuit block of the data comparator according to a first embodiment of the present invention.

FIG. 15 is a view illustrating, in more detail, the operation of the first to third decision units of the data comparator. ①, ② and ③ correspond to the operations of the first decision unit 734-1, the second decision unit 734-2 and the third decision unit 734-3.

Referring to FIG. 15, the data comparator 1000 of the present invention compares image data of neighing cells located in horizontal and vertical directions of one cell using the first decision unit 734-1 to the third decision unit 734-3, and determines variation in the image data.

The decoder 735 outputs a 3-bit signal corresponding to an output signal of each of the first to third decision units 734-1, 734-2 and 734-3.

FIG. 16 is a table showing pattern contents of the image data depending on output signals of first to third decision units 734-1, 734-2 and 734-3 included in the basic circuit block of the data comparator according to a first embodiment of the present invention.

Referring to FIG. 16, if an output signal of each of the first to third decision units 734-1, 734-2 and 734-3 is (0,0,0), this is the same as the pattern state of the image data shown in (a) of FIG. 10. If the output signal is (0,0,0), the displacement current (Id) is 0.

If the output signal of each of the first to third decision units 734-1, 734-2 and 734-3 is (0,0,1), this is the same as the pattern state of the image data, which is shown in (b) of FIG. 10. Therefore, if the output signal is (0,0,1), the displacement current (Id) is proportional to Cm2.

If the output signal of each of the first to third decision units 734-1, 734-2 and 734-3 is any one of (0,1,0), (0,1,1), (1,0,0) and (1,0,1), this is the same as the pattern state of the image data, which is shown in (a) of FIG. 10. Therefore, if the output signal is any one of (0,1,0), (0,1,1), (1,0,0) and (1,0,1), the displacement current (Id) is proportional to (Cm1+Cm2).

If the output signal of each of the first to third decision units 734-1, 734-2 and 734-3 is (1,1,0), this is the same as the pattern state of the image data, which is shown in (d) of FIG. 10. Therefore, if the output signal is (1,1,0), the displacement current (Id) is 0.

If the output signal of each of the first to third decision units 734-1, 734-2 and 734-3 is (1,1,1), this is the same as the pattern state of the image data, which is shown in (c) of FIG. 10. Therefore, if the output signal is (1,1,1), the displacement current (Id) is proportional to (4Cm1+Cm2).

Furthermore, the first to third summation units 736-1, 736-2 and 736-3 of FIG. 14 sum output numbers of specific 3-bit signals output from the decoder 735, and output the summation result.

That is, the first summation unit 736-1 sums a number in which any one of (0,1,0), (0,1,1), (1,0,0) and (1,0,1) is output by the decoder 735 (C1). The second summation unit 736-2 sums a number in which (0,0,1) is output by the decoder 735 (C2). The third summation unit 736-3 sums a number in which (1,1,1) is output by the decoder 735 (C3).

The first to third current calculators 737-1, 737-2 and 737-3 receive C1, C2 and C3 from the first summation unit 736-1, the second summation unit 736-2 and the third summation unit 736-3, respectively, and calculate amounts of the displacement current.

The current summation unit 738 sums the amounts of the displacement current, which are calculated by the first to third current calculators 737-1, 737-2 and 737-3.

Figure 17:
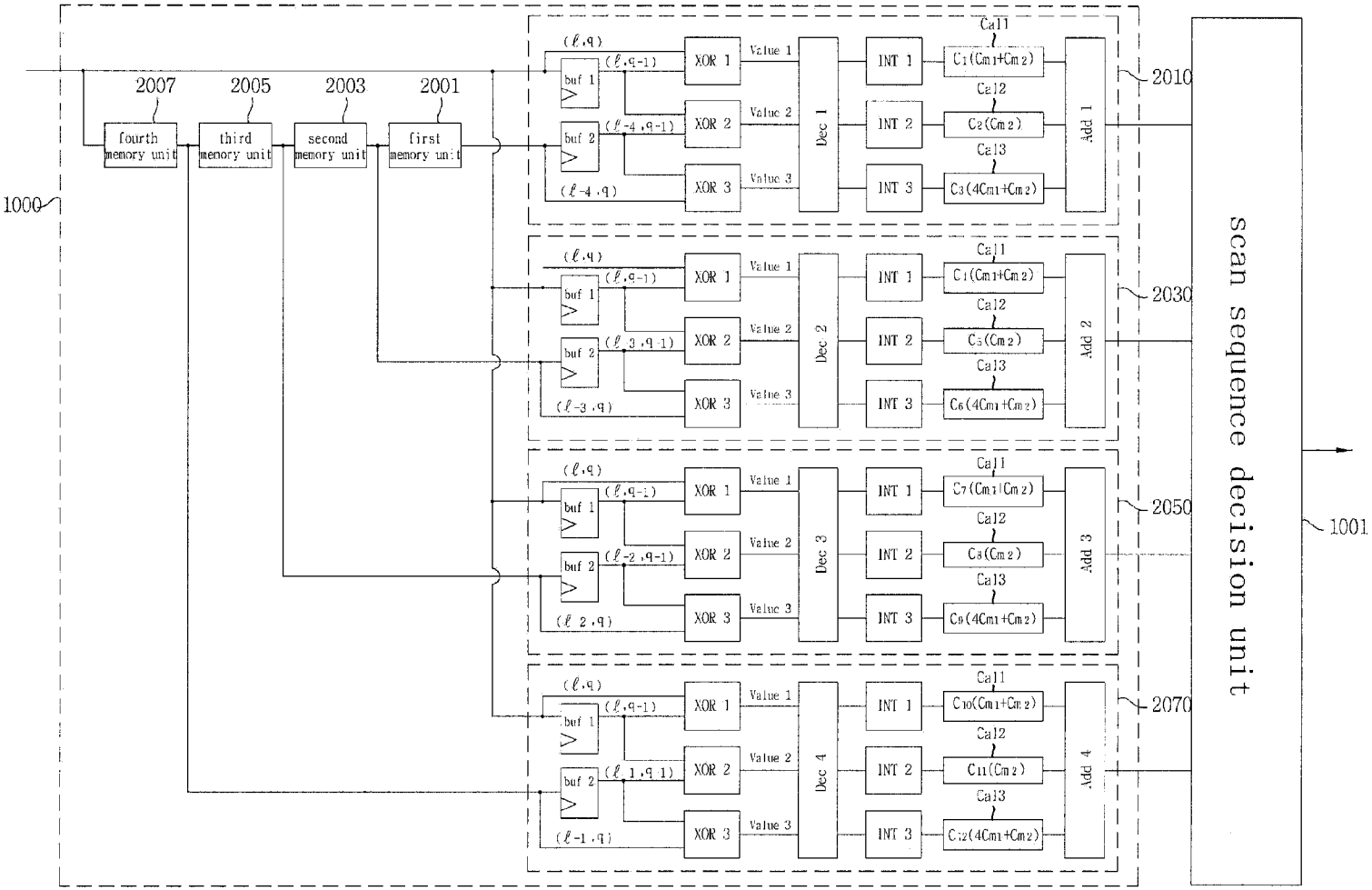
FIG. 17 is a block diagram of a data comparator 1000 and a scan order decision unit 1001 of a scan driver in the plasma display apparatus according to a first embodiment of the present invention.

FIG. 17 is a block diagram of a data comparator 1000 and a scan order decision unit 1001 of a scan driver in the plasma display apparatus according to a first embodiment of the present invention.

As shown in FIG. 17, in the plasma display apparatus according to a first embodiment of the present invention, the data comparator 1000 of the scan driver has a structure in which four basic circuit blocks shown in FIG. 17 are connected. The scan order decision unit 1001 compares the outputs of the four basic circuit blocks to decide a scan order that outputs the lowest displacement current. FIG. 17 corresponds to a case where a scan type includes a total of four scan types as in FIG. 16. That is, FIG. 17 shows the construction of the data comparator 1000 and the scan order decision unit 1001 corresponding to a case where the scan electrodes Y are scanned from the total of four scan types to one scan type.

The data comparator 1000 comprises first to fourth memory units 2001, 2003, 2005 and 2007, and first to fourth current decision units 2010, 2030, 2050 and 2070. That is, one memory unit and one current decision unit correspond to the basic circuit block shown in FIG. 17.

The first to fourth memory units 2001, 2003, 2005 and 2007 are interconnected and store image data corresponding to the four scan electrode (Y) lines. That is, the first memory unit 2001 stores image data corresponding to a $(l-4)^{th}$ scan electrode (Y) line. The second memory unit 2003 stores image data corresponding to a $(l-3)^{th}$ scan electrode (Y) line. The third memory unit 2005 stores image data corresponding to a $(l-2)^{th}$ scan electrode (Y) line. The fourth memory unit 907 stores image data corresponding to a $(l-1)^{th}$ scan electrode (Y) line.

The first current decision unit 2010 receives the image data of the $l^{th}$ scan electrode (Y) line and the image data of the $(l-4)^{th}$ scan electrode (Y) line, which are stored in the first memory unit 2001. If the current of the first current decision unit 2010 that has received the image data is lower than the current of the second to fourth current decision units 2030, 2050 and 2070, the scan order is the same as the fourth scan type (Type 4) of FIG. 12. That is, scanning has to be performed in order of Y1-Y5-Y9-, . . . , Y2-Y6-Y10-, . . . , Y3-Y7-Y1-, . . . , Y4-Y8-Y12-, . . . .

The operation of the first current decision unit 2010 is the same as that of the basic circuit block. The image data corresponding to the $(l-4)^{th}$ scan electrode (Y) line are stored in the first memory unit 2001, and the image data corresponding to the $l^{th}$ scan electrode (Y) line are input.

The first buffer buf1 temporarily stores the image data of the $(q-1)^{th}$ discharge cell of the discharge cells corresponding to the $l^{th}$ scan electrode (Y) line.

The second buffer buf2 temporarily stores the image data of the $(q-1)^{th}$ discharge cell of the discharge cells corresponding to the $(l-4)^{th}$ scan electrode (Y) line, which are stored in the first memory unit 2001.

The first decision unit XOR1 comprises an XOR gate element, and it compares image data (l, q) of the $q^{th}$ discharge cell of the $l^{th}$ scan electrode (Y) line and image data (l, q−1) of the $(q-1)^{th}$ discharge cell of the $l^{th}$ scan electrode (Y) line, which are stored in the first buffer buf1. As a result of the comparison, if the two data are different from each other, the first decision unit XOR1 outputs Value=1. If the two data are identical to each other, the first decision unit XOR1 outputs Value=0.

The second decision unit XOR2 comprises an XOR gate element, and it compares image data (l, q−1) of the $(q-1)^{th}$ discharge cell of the $l^{th}$ scan electrode (Y) line and image data (l−4, q−1) of the $(q-1)^{th}$ discharge cell of the $(l-4)^{th}$ scan electrode (Y) line, which are stored in the second buffer buf2. As a result of the comparison, if the two data are different from each other, the second decision unit XOR2 outputs Value=1. If the two data are identical to each other, the first decision unit XOR1 outputs Value=0.

The third decision unit XOR3 comprises an XOR gate element, and it compares image data (l−4, q−1) of the $(q-1)^{th}$ discharge cell of the $(l-4)^{th}$ scan electrode (Y) line, which are stored in the second buffer buf2, and image data (l−4, q) of the $q^{th}$ discharge cell of the $(l-4)^{th}$ scan electrode (Y) line, which are output from the first memory unit 901. As a result of the comparison, if the two data are different from each other, the third decision unit XOR3 outputs Value=1. If the two data are identical to each other, the first decision unit XOR1 outputs Value=0.

The first decoder Dec1 receives the output signals of the first to third decision units XOR1, XOR2 and XOR3 in parallel and then outputs 3-bit signals.

FIG. 18 is a table showing the pattern contents of the image data depending on output signals of first to third decision units XOR1, XOR2 and XOR3 included in the data comparator according to a first embodiment of the present invention.

Referring to FIG. 18, amounts of capacitance that decides amounts of displacement currents are varied depending on output signals (Value1, Value2, Value3) of the first to third decision units XOR1, XOR2 and XOR3.

First to third summation units Int1, Int2 and Int3 sum output numbers of specific 3-bit signals, which are output from the first decoder Dec1, and output the sum result.

That is, the first summation unit Int1 sums (C1) a number in which any one of (0,0,1), (0,1,1), (1,0,0) and (1,1,0) is output by the first decoder Dec1. The second summation unit Int2 sums (C2) a number in which (0,1,0) is output by the first decoder Dec1. The third summation unit Int3 sums (C3) a number in which (1,1,1) is output by the first decoder Dec1.

First to third current calculators Cal1, Cal2, Cal3 receive C1, C2 and C3 from the first summation units Int1, the second summation unit Int2 and the third summation unit Int3, respectively, and calculate amounts of the displacement current.

That is, the first current calculator Call calculates the amount of current by multiplying the output (C1) of the first summation unit Int1 and (Cm1+Cm2). The second current calculator Cal2 calculates the amount of current by multiplying the output (C2) of the second summation unit Int2 and Cm2. The third current calculator Cal3 calculates the amount of current by multiplying the output (C3) of the third summation unit Int3 and (4Cm1+Cm2).

A first current summation unit Add1 sums the amounts of the displacement current, which are calculated by the first to third current calculators Cal1, Cal2 and Cal3.

In the same manner as the operation of the first current decision unit, the second to fourth current decision units 2030, 2050 and 2070 also calculate the summed amounts of the displacement current.

The first decision unit XOR1 of the second current decision unit 2030 comprises an XOR gate element, and it compares the image data (l, q) of the $q^{th}$ discharge cell of the $l^{th}$ scan electrode (Y) line and the image data (l, q−1) of the $(q-1)^{th}$ discharge cell of the $l^{th}$ scan electrode (Y) line, which are stored in the first buffer buf1. As a result of the comparison, if the two image data are different from each other, the first decision unit XOR1 outputs 1. If the two image data are identical to each other, the first decision unit XOR1 outputs 0.

The second decision unit XOR2 of the second current decision unit 2030 comprises an XOR gate element, and it compares the image data (l, q−1) of the $(q-1)^{th}$ discharge cell of the $l^{th}$ scan electrode (Y) line and the image data (l−3, q−1) of the $(q-1)^{th}$ discharge cell of the $(l-3)^{th}$ scan electrode (Y) line, which are stored in the second buffer buf2. As a result of the comparison, if the two image data are different from each other, the second decision unit XOR2 outputs 1. If the two image data are identical to each other, the second decision unit XOR2 outputs 0.

The third decision unit XOR3 of the second current decision unit 2030 comprises an XOR gate element, and it compares the image data (l−3, q−1) of the $(q-1)^{th}$ discharge cell of the $(l-3)^{th}$ scan electrode (Y) line, which are stored in the second buffer buf2, and the image data (l−3, q) of the $q^{th}$ discharge cell of the $(l-3)^{th}$ scan electrode (Y) line, which are output the second memory unit 2003. As a result of the comparison, if the two image data are different from each other, the third decision unit XOR3 outputs 1. If the two image data are identical to each other, the third decision unit XOR3 outputs 0.

Furthermore, the first decision unit XOR1 of the third current decision unit 2050 comprises an XOR gate element, and it compares the image data (l, q) of the $q^{th}$ discharge cell of the $l^{th}$ scan electrode (Y) line and the image data (l, q−1) of the $(q-1)^{th}$ discharge cell of the $l^{th}$ scan electrode (Y) line, which are stored in the first buffer buf1. As a result of the comparison, if the two image data are different from each other, the first decision unit XOR1 outputs 1. If the two image data are identical to each other, the first decision unit XOR1 outputs 0.

The second decision unit XOR2 of the third current decision unit 2050 comprises an XOR gate element, and it compares the image data (l, q−1) of the $(q-1)^{th}$ discharge cell of the $l^{th}$ scan electrode (Y) line and the image data (l−2, q−1) of the $(q-1)^{th}$ discharge cell of the $(l-2)^{th}$ scan electrode (Y) line, which are stored in the second buffer buf2. As a result of the comparison, if the two image data are different from each other, the second decision unit XOR2 outputs 1. If the two image data are identical to each other, the second decision unit XOR2 outputs 0.

The third decision unit XOR3 of the third current decision unit 2050 comprises an XOR gate element, and it compares the image data (l−2, q−1) of the $(q-1)^{th}$ discharge cell of the $(l-2)^{th}$ scan electrode (Y) line, which are stored in the second buffer buf2, and the image data (l−2, q) of the $q^{th}$ discharge cell of the $(l-2)^{th}$ scan electrode (Y) line, which are output from the third memory unit 2005. As a result of the comparison, if the two image data are different from each other, the third decision unit XOR3 outputs 1. If the two image data are identical to each other, the third decision unit XOR3 outputs 0.

The first decision unit XOR1 of the fourth current decision unit 2070 comprises an XOR gate element, and it compares the image data (l, q) of the $q^{th}$ discharge cell of the $l^{th}$ scan electrode (Y) line and the image data (l, q−1) of the $(q-1)^{th}$ discharge cell of the $l^{th}$ scan electrode (Y) line, which are stored in the first buffer buf1. As a result of the comparison, if the two image data are different from each other, the first decision unit XOR1 outputs 1. If the two image data are identical to each other, the first decision unit XOR1 outputs 0.

The second decision unit XOR2 of the fourth current decision unit 2070 comprises an XOR gate element, and it compares the $(q-1)^{th}$ image data (l, q−1) of the $l^{th}$ scan electrode (Y) line and the image data (l−1, q−1) of the $(q-1)^{th}$ discharge cell of the $(l-1)^{th}$ scan electrode (Y) line, which are stored in the second buffer buf2. As a result of the comparison, if the two image data are different from each other, the second decision unit XOR2 outputs 1. If the two image data are identical to each other, the second decision unit XOR2 outputs 0.

The third decision unit XOR3 of the fourth current decision unit 2070 comprises an XOR gate element, and it compares the image data (l−1, q−1) of the $(q-1)^{th}$ discharge cell of the $(l-1)^{th}$ scan electrode (Y) line, which are stored in the second buffer buf2, and the image data (l−1, q) of the $q^{th}$ discharge cell of the $(l-1)^{th}$ scan electrode (Y) line, which are output from the fourth memory unit 2007. As a result of the comparison, if the two image data are different from each other, the third decision unit XOR3 outputs 1. If the two image data are identical to each other, the third decision unit XOR3 outputs 0.

The scan order decision unit 1001 receives the amounts of the displacement current, which are calculated by the first to fourth current decision units 2010, 2030, 2050 and 2070, and then decides a scan order according to a current decision unit that has output the lowest displacement current, or decides a scan order of the scan electrodes Y according to any one of the scan types, in which a displacement current lower than a previously set critical current is generated.

For example, if the scan order decision unit 1001 determines that the amount of the displacement current received from the second current decision unit 2030 is the lowest, the scan order decision unit 1001 sets a scan order so that scanning is performed in order of Y1-Y4-Y7-, . . . , Y2-Y5-Y8-, . . . , Y3-Y6-Y9-, . . . , in the same manner as the third scan type (Type 3) of FIG. 14.

Furthermore, if the scan order decision unit 1001 determines that the amount of the displacement current received from the third current decision unit 2050 is the lowest, the scan order decision unit 1001 sets the scan order so that scanning is performed in order of Y1-Y3-Y5-, . . . , Y2-Y4-Y6-, . . . , in the same manner as the second scan type (Type 2) of FIG. 14.

If the scan order decision unit 1001 determines that the amount of the displacement current received from the fourth current decision unit 2070 is the lowest, the scan order decision unit 1001 sets the scan order so that scanning is performed in order of Y1-Y2-Y3-Y4-Y5-Y6-, . . . , in the same manner as the first scan type (Type 1) of FIG. 14.

Meanwhile, in the plasma display apparatus of the present invention, which has been described with reference to FIG. 14, the basic circuit block included in the data comparator 1000 of the scan driver can be constructed differently from that of FIG. 14. This will be described below with reference to FIG. 19.

Figure 19:
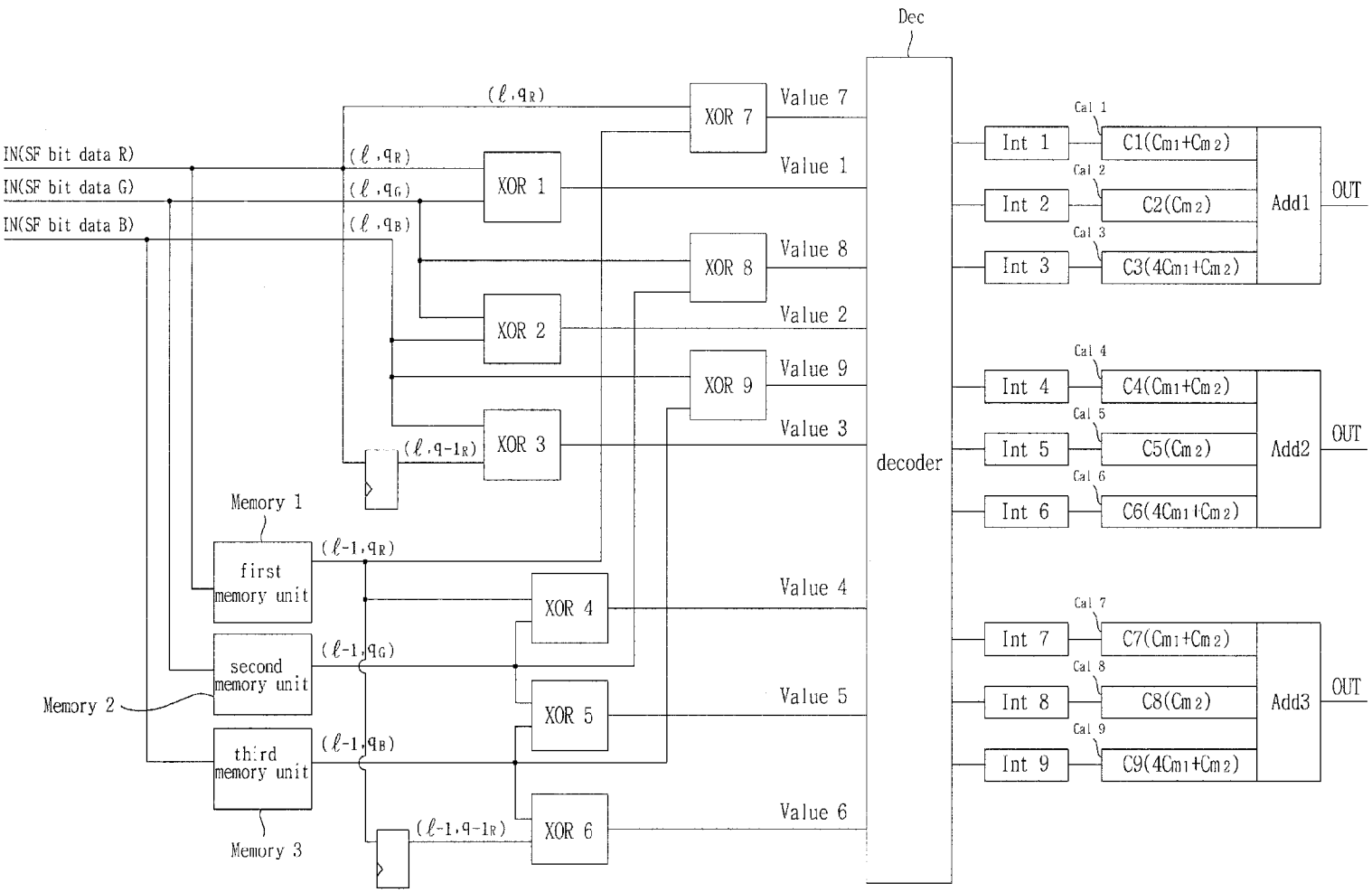
FIG. 19 is a block diagram illustrating another construction of a basic circuit block included in the data comparator 1000 included in the scan driver of the plasma display apparatus according to a first embodiment of the present invention.

FIG. 19 is a block diagram illustrating another construction of a basic circuit block included in the data comparator 1000, which is included in the scan driver of the plasma display apparatus according to a first embodiment of the present invention.

Referring to FIG. 19, the basic circuit block of FIG. 19 calculates the amount of the displacement current through variation in image data corresponding to R, G and B cells of a $q^{th}$ pixel and a $(q-1)^{th}$ pixel on the $l^{th}$ scan electrode line, variation in image data corresponding to R, G and B cells of the $q^{th}$ pixel and the $(q-1)^{th}$ pixel on the $(l-1)^{th}$ scan line, and variation in image data corresponding to R, G and B cells of the $q^{th}$ pixel on the $l^{th}$ scan electrode line and the $(q-1)^{th}$ pixel on the $(l-1)^{th}$ scan electrode line.

First to third memory units Memory1, Memory2 and Memory3 temporarily store the image data corresponding to the R cell of the $(l-1)^{th}$ scan electrode line, the image data corresponding to the G cell of the $(l-1)^{th}$ scan electrode line, and the image data corresponding to the B cell of the $(l-1)^{th}$ scan electrode line, respectively.

The first to third decision units XOR1, XOR2 and XOR3 decide variation between the image data corresponding to the R, G and B cells of the $q^{th}$ pixel on the $l^{th}$ scan electrode line.

That is, the first decision unit XOR1 compares image data (l, qR) corresponding to the R cell of the $q^{th}$ pixel on the $l^{th}$ scan electrode line and image data (l, qG) corresponding to the G cell of the $q^{th}$ pixel on the $l^{th}$ scan electrode line. As a result of the comparison, if the two data are different from each other, the first decision unit XOR1 outputs the logic value 1. If the two data are identical to each other, the first decision unit XOR1 outputs the logic value 0.

The second decision unit XOR2 compares image data (l, qG) corresponding to the G cell of the $q^{th}$ pixel on the $l^{th}$ scan electrode line and image data (l, qB) corresponding to the B cell of the $q^{th}$ pixel on the $l^{th}$ scan electrode line. As a result of the comparison, if the two data are different from each other, the second decision unit XOR2 outputs the logic value 1. If the two data are identical to each other, the first decision unit XOR1 outputs the logic value 0.

The third decision unit XOR3 compares image data (l, qB) corresponding to the B cell of the $q^{th}$ pixel on the $l^{th}$ scan electrode line and image data (l, q−1R) corresponding to the R cell of the $(q-1)^{th}$ pixel on the $l^{th}$ scan electrode line. As a result of the comparison, if the two data are different from each other, the third decision unit XOR3 outputs the logic value 1. If the two data are identical to each other, the first decision unit XOR1 outputs the logic value 0.

The fourth to sixth decision units XOR4, XOR5 and XOR6 decide variation between the image data corresponding to the R, G and B cells of the $q^{th}$ pixel on the $(l-1)^{th}$ scan electrode line.

That is, the fourth decision unit XOR4 compares image data (l−1, qR) corresponding to the R cell of the $q^{th}$ pixel on the $(l-1)^{th}$ scan electrode line and image data (l−1, qG) corresponding to the G cell of the $q^{th}$ pixel on the $(l-1)^{th}$ scan electrode line. As a result of the comparison, if the two data are different from each other, the fourth decision unit XOR4 outputs the logic value 1. If the two data are identical to each other, the first decision unit XOR1 outputs the logic value 0.

The fifth decision unit XOR5 compares image data (l−1, qG) corresponding to the G cell of the $q^{th}$ pixel on the $(l-1)^{th}$ scan electrode line and image data (l−1, qB) corresponding to the B cell of the $q^{th}$ pixel on the $(l-1)^{th}$ scan electrode line. As a result of the comparison, if the two data are different from each other, the fifth decision unit XOR5 outputs the logic value 1. If the two data are identical to each other, the first decision unit XOR1 outputs the logic value 0.

The sixth decision unit XOR6 compares image data (l−1, qB) corresponding to the B cell of the $q^{th}$ pixel on the $(l-1)^{th}$ scan electrode line and image data (l−1, q−1R) corresponding to the R cell of the $(q-1)^{th}$ pixel on the $(l-1)^{th}$ scan electrode line. As a result of the comparison, if the two data are different from each other, the sixth decision unit XOR6 outputs the logic value 1. If the two data are identical to each other, the first decision unit XOR1 outputs the logic value 0.

The seventh to ninth decision units XOR7, XOR8 and XOR9 decide variation between the image data by comparing the image data corresponding to the R, G and B cells of the $q^{th}$ pixel on the $l^{th}$ scan electrode line and the image data corresponding to the R, G and B cells of the $q^{th}$ pixel on the $(l-1)^{th}$ scan electrode line, respectively.

That is, the seventh decision unit XOR7 compares the image data (l, qR) corresponding to the R cell of the $q^{th}$ pixel on the $l^{th}$ scan electrode line and the image data (l−1, qR) corresponding to the R cell of the $q^{th}$ pixel on the $(l-1)^{th}$ scan electrode line. As a result of the comparison, if the two data are different from each other, the seventh decision unit XOR7 outputs the logic value 1. If the two data are identical to each other, the first decision unit XOR1 outputs the logic value 0.

The eighth decision unit XOR8 compares the image data (l, qG) corresponding to the G cell of the $q^{th}$ pixel on the $l^{th}$ scan electrode line and the image data (l−1, qG) corresponding to the G cell of the $q^{th}$ pixel on the $(l-1)^{th}$ scan electrode line. As a result of the comparison, if the two data are different from each other, the eighth decision unit XOR8 outputs the logic value 1. If the two data are identical to each other, the first decision unit XOR1 outputs the logic value 0.

The ninth decision unit XOR9 compares the image data (l, qB) corresponding to the B cell of the $q^{th}$ pixel on the $l^{th}$ scan electrode line and the image data (l−1, qB) corresponding to the B cell of the $q^{th}$ pixel on the $(l-1)^{th}$ scan electrode line. As a result of the comparison, if the two data are different from each other, the ninth decision unit XOR9 outputs the logic value 1. If the two data are identical to each other, the first decision unit XOR1 outputs the logic value 0.

The decoder Dec outputs 3-bit signals corresponding to the output signals (Value1, Value2 and Value3) of the first to third decision units XOR1, XOR2 and XOR3, the output signals (Value4, Value5 and Value6) of the fourth to sixth decision units XOR4, XOR5 and XOR6, and the output signals (Value7, Value8 and Value9) of the seventh to ninth decision units XOR7, XOR8 and XOR9.

FIG. 20 is a table showing the pattern contents of the image data depending on output signals of first to ninth decision units XOR1 to XOR9 included in the circuit block of FIG. 19 according to a first embodiment of the present invention.

Referring to FIG. 20, the first to third summation units Int1, Int2 and Int3 sum (C1, C2, C3) the output numbers of the 3-bit signals, which are output from the decoder Dec and correspond to the output signals (Value1, Value2 and Value3) of the first to third decision units XOR1, XOR2 and XOR3, respectively, and then outputs the summation results.

The fourth to sixth summation units Int4, Int5 and Int6 sum (C4, C5 and C6) the output numbers of the 3-bit signals, which are output from the decoder Dec and correspond to the output signals (Value4, Value5 and Value6) of the fourth to sixth decision units XOR4, XOR5 and XOR6, respectively, and then outputs the summation results.

The seventh to ninth summation units Int7, Int8 and Int9 sum (C7, C8 and C9) the output numbers of the 3-bit signals, which are output from the decoder Dec and correspond to the output signals (Value7, Value8 and Value9) of the ninth decision units XOR7, XOR8 and XOR9, respectively, and then outputs the summation results.

The first to third current calculators Cal1, Cal2 and Cal3 receive C1, C2 and C3 from the first, second and third summation units Int1, Int2 and Int3, respectively, and calculate amounts of the displacement current.

The fourth to sixth current calculators Cal4, Cal5 and Cal6 receive C4, C5 and C6 from the fourth, firth and sixth summation units Int4, Int5 and Int6, respectively, and calculate amounts of the displacement current.

The seventh to ninth current calculators Cal7, Cal8 and Cal9 receive C7, C8 and C9 from the seventh to ninth summation units Int7, Int8 and Int9, respectively, and calculate amounts of the displacement current.

The first current summation unit Add1 sums the amounts of the displacement current, which are calculated by the first to third current calculators Cal1, Cal2 and Cal3.

The second current summation unit Add2 sums the amounts of the displacement current, which are calculated by the fourth to sixth current calculators Cal4, Cal5 and Cal6.

The third current summation unit Add3 sums the amounts of the displacement current, which are calculated by the seventh to ninth current calculators Cal7, Cal8 and Cal9.

As described above, the amount of the displacement current with respect to variation in image data corresponding to each cell can be calculated.

Figure 21:
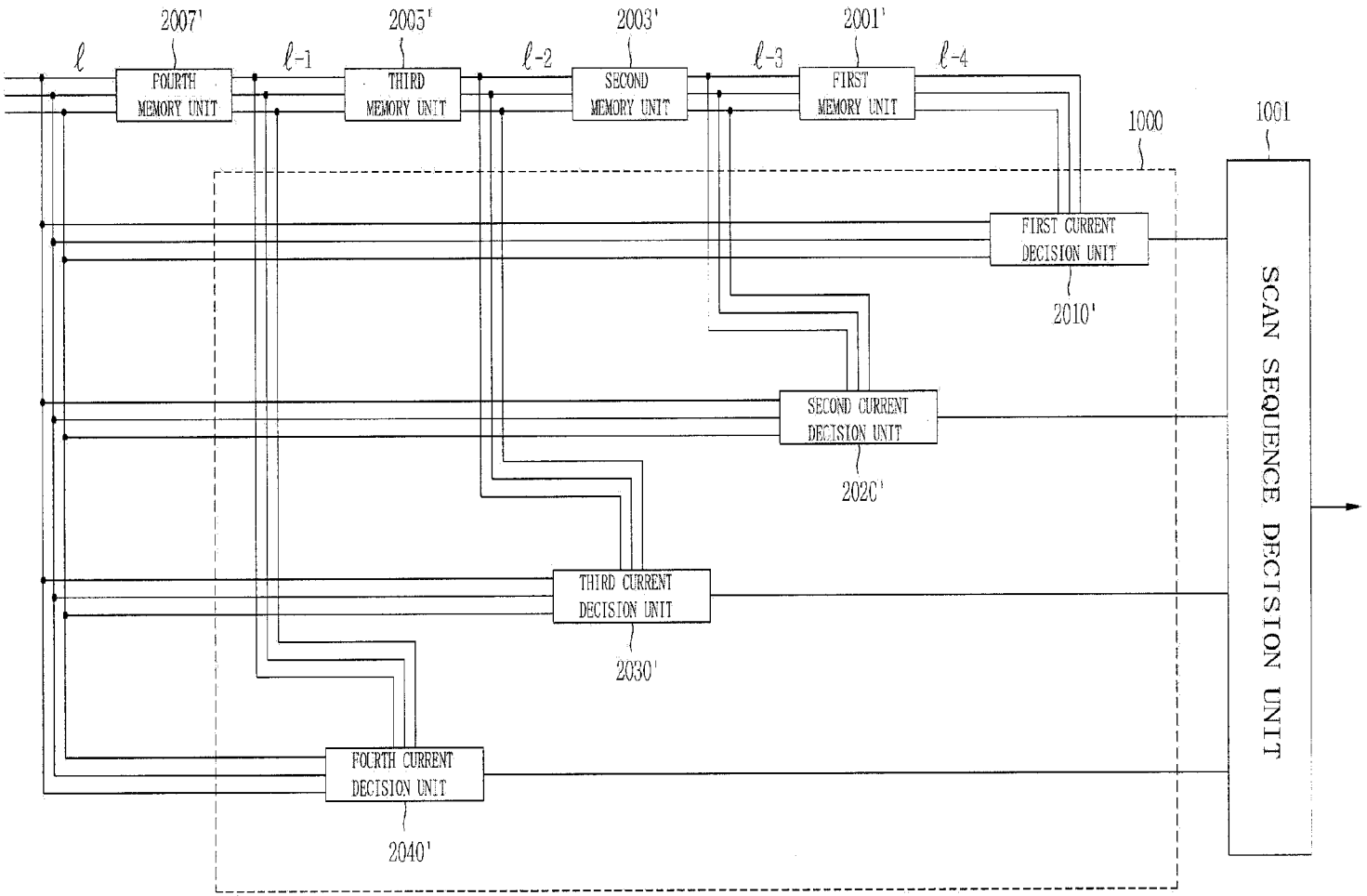
FIG. 21 is a block diagram of the data comparator 1000 and the scan order decision unit 1001 of the scan driver in the plasma display apparatus according to a first embodiment of the present invention taking FIGS. 19 and 20 into consideration.

FIG. 21 is a block diagram of the data comparator 1000 and the scan order decision unit 1001 of the scan driver in the plasma display apparatus according to a first embodiment of the present invention taking FIGS. 19 and 20 into consideration.

Referring to FIG. 21, the data comparator 1000 taking FIGS. 19 and 20 into consideration has a structure in which four basic circuit blocks 4 shown in FIG. 21, i.e., first to fourth current decision units 2010', 2020', 2030' and 2040' are connected. The scan order decision unit 1001 compares the outputs of the four basic circuit blocks and decides a scan order that generates the lowest displacement current.

The first current decision unit 2010' compares the image data (l, qR) and the image data (l, qG), the image data (l, qG) and the image data (l, qB), the image data (l, qB) and the image data (l, q−4R), the image data (l−4, qR) and the image data (l−4, qG), the image data (l−4, qG) and the image data (l−4, qB), the image data (l−4, qB) and (l−4, q−1R), the image data (l, qR) and the image data (l−4, qR), the image data (l, qG) and (l−4, qG), and the image data (l, qB) and the image data (l−4, qB), respectively.

l and l−4 refer to the $l^{th}$ scan electrode line and the $(l-4)^{th}$ scan electrode line, respectively. qR, qG and qB refer to the R, G and B cells of the $q^{th}$ pixel, respectively. q−1R, q−1G and q−1B refer to the R, G and B cells of the $(q-1)^{th}$ pixel, respectively.

Therefore, the first current decision unit 2010' compares the image data and calculates the amount of the displacement current, which corresponds to the scan order of Type4, as described above.

The second current decision unit 2020' compares the image data (l, qR) and the image data (l, qG), the image data (l, qG) and the image data (l, qB), the image data (l, qB) and the image data (l, q−1R), the image data (l−3, qR) and the image data (l−3, qG), the image data (l−3, qG) and the image data (l−3, qB), the image data (l−3, qB) and (l−3, q−1R), the image data (l, qR) and the image data (l−3, qR), the image data (l, qG) and (l−3, qG), and the image data (l, qB) and the image data (l−3, qB), respectively. l and (l−3) refer to the $l^{th}$ scan electrode line and the $(l-3)^{th}$ scan electrode line, respectively.

Therefore, the second current decision unit 2020' compares the image data and calculates the amount of the displacement current, which corresponds to the scan order of Type3, as described above.

The third current decision unit 2030' compares the image data (l, qR) and the image data (l, qG), the image data (l, qG) and the image data (l, qB), the image data (l, qB) and the image data (l, q−1R), the image data (l−2, qR) and the image data (l−2, qG), the image data (l−2, qG) and the image data (l−2, qB), the image data (l−2, qB) and (l−2, q−1R), the image data (l, qR) and the image data (l−2, qR), the image data (l, qG) and the image data (l−2, qG), and the image data (l, qB) and the image data (l−2, qB), respectively. l and (l−2) refer to the $l^{th}$ scan electrode line and the $(l-2)^{th}$ scan electrode line, respectively.

Therefore, the third current decision unit 2030' compares the image data and calculates the amount of the displacement current, which corresponds to the scan order of Type2, as described above.

The fourth current decision unit 2040' compares the image data (l, qR) and the image data (l, qG), the image data (l, qG) and the image data (l, qB), the image data (l, qB) and the image data (l, q−1R), the image data (l−1, qR) and the image data (l−1, qG), the image data (l−1, qG) and the image data (l−1, qB), the image data (l−1, qB) and the image data (l−1, q−1R), the image data (l, qR) and the image data (l−1, qR), the image data (l, qG) and (l−1, qG), and the image data (l, qB) and the image data (l−1, qB), respectively. l and (l−1) refer to the $l^{th}$ scan electrode line and the $(l-1)^{th}$ scan electrode line, respectively.

Therefore, the fourth current decision unit 2040' compares the image data and calculates the amount of the displacement current, which corresponds to the scan order of Type1, as described above.

The scan order decision unit 1001 receives the amounts of the displacement current, which are calculated by the first to fourth current decision units 2010', 2030', 2050' and 2070', and decides a scan order according to a current decision unit that has output the lowest displacement current.

For example, if the scan order decision unit 1001 determines that the amount of the displacement current, which is received from the second current decision unit 2030', is the lowest, the scan order decision unit 1001 sets the scan order so that scanning is performed in order of Y1-Y4-Y7-, . . . , Y2-Y5-Y8-, . . . , Y3-Y6-Y9- . . . , in the same manner as the third scan type (Type 3) of FIG. 19.

Furthermore, if the scan order decision unit 1001 determines that the amount of the displacement current, which is received from the third current decision unit 2050', is the lowest, the scan order decision unit 1001 sets the scan order so that scanning is performed in order of Y1-Y3-Y5-, . . . , Y2-Y4-Y6-, . . . , in the same manner as the second scan type (Type 2) of FIG. 12.

Figure 22:
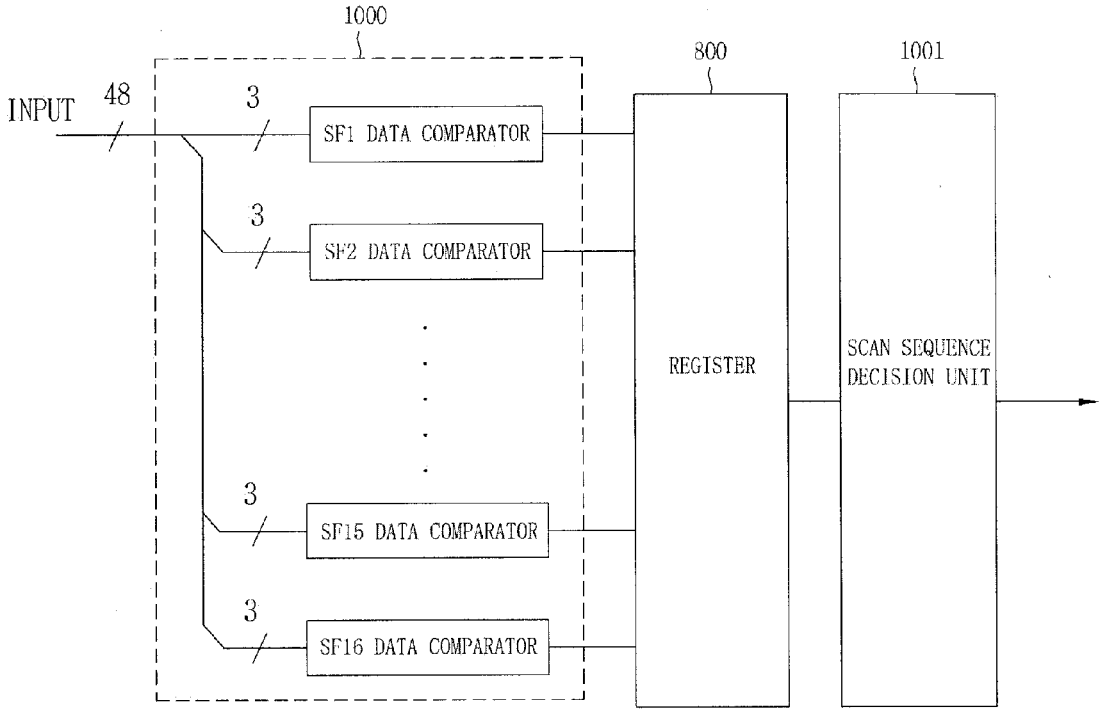
FIG. 22 is a block diagram of an embodiment in which a data comparator and a scan order decision unit are applied every sub-field according to a first embodiment of the present invention.

FIG. 22 is a block diagram of an embodiment in which the data comparator and the scan order decision unit according to the present invention are applied to each sub-field.

Referring to FIG. 22, each of a data comparator for a first sub-field (SF1) to a data comparator for a sixteenth sub-field (SF16) calculates the amount of the displacement current according to an image pattern in a corresponding sub-field with respect to a plurality of scan types, and stores the calculated amount in a buffer 800.

Each of the data comparator for the first sub-field (SF1) to the data comparator for the sixteenth sub-field (SF16) is the same as the block construction of the data comparator shown in FIG. 17. Each of the data comparator for the first sub-field (SF1) to the data comparator for the sixteenth sub-field (SF16) calculates the amount of the displacement current according to a pattern of image data in each sub-field with respect to a plurality of scan types, and stores the calculated amount in the buffer 800.

The scan order decision unit 1001 compares the amounts of the displacement current according to the patterns of the image data for the respective sub-fields, which are received from the buffer 800, knows the pattern of the image data having the lowest displacement current, and decides a scan order every sub-field.

In the plasma display apparatus and driving method thereof of the present invention as described above, the displacement current between the scan electrode lines corresponding to a plurality of scan types are calculated, and lines corresponding to the scan types having the lowest displacement current are sequentially scanned.

That is, it has been shown in FIG. 22 that a displacement current between lines in which scan types are spaced apart one another at regular intervals by a predetermined number is calculated, and a scan type having the lowest displacement current is selected. However, a displacement current between lines in which scan types are spaced apart one another irregularly or according to a predetermined rule can be calculated, and a scan type having the lowest displacement current can be selected. Furthermore, it has been described above that the displacement current is calculated using weights (Cm2, Cm1+ Cm2, or 4Cm1+ Cm2), which include at least one of capacitances (Cm1 and Cm2). However, the amounts of the displacement currents of the sub-fields can be found by summing the values of "u0"v or "u1"v in such a manner that in the case where weights are not used and the displacement current does not flow, the amount of the displacement current is set to "u0"v and in the case where the displacement current flows, the amount of the displacement current is set to "u1"v. For example, in FIG. 14, the first to third summation units 736-1 to 736-3 can be constructed using one summation unit, and the current calculators 737-1 to 737-3 and the current summation unit 738 may be omitted. In this case, one summation unit can count the output numbers of C1, C2 and C3 and calculates the count values themselves as displacement currents.

Meanwhile, a sub-field in which the scan electrodes Y are scanned using any one of a plurality of scan types can be arbitrarily decided within one frame. This will be described below with reference to FIG. 23.

Figure 23:
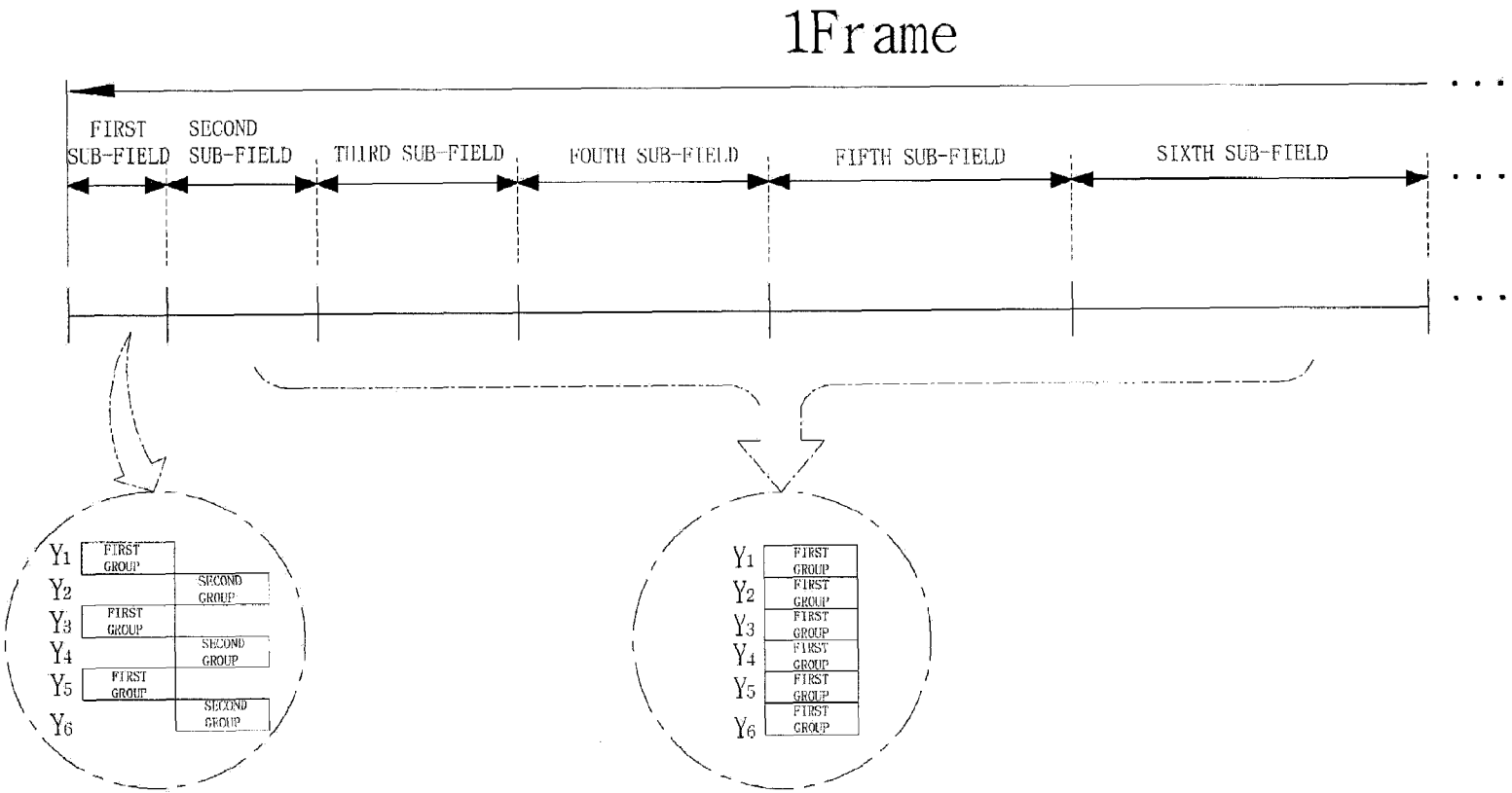
FIG. 23 is a view illustrating an exemplary method of selecting a sub-field that scans scan electrodes Y according to any one of a plurality of scan types within one frame according to a first embodiment of the present invention.

FIG. 23 is a view illustrating an exemplary method of selecting a sub-field that scans scan electrodes Y using any one of a plurality of scan types within one frame according to a first embodiment of the present invention.

Referring to FIG. 23, the scan electrodes Y are scanned using the first scan type (Type 1) of FIG. 22 only in a first sub-field having the lowest gray level weight, of sub-fields included in one frame, and the scan electrodes Y are scanned according to a general method, i.e., a sequential scanning method in the remaining sub-fields. In more detail, the displacement current for a plurality of scan types is calculated in selected one or more of sub-fields included in one frame, and the scan electrodes Y are then scanned using a scan type in which the displacement current is the lowest in each sub-field.

It is, however, more preferred that the displacement current with respect to the plurality of scan types are calculated in the respective sub-fields included in one frame, and the scan electrodes Y are scanned according to a scan type in which the displacement current is the lowest in each sub-field, as in FIG. 22.

In view of the above description, in the case where patterns of image data include a first pattern and a second pattern, it can be seen that a scanning order in the first pattern of the image data and a scanning order in the second pattern of the image data can be different from each other. This will be described in more detail with reference to FIG. 24.

Figure 24:
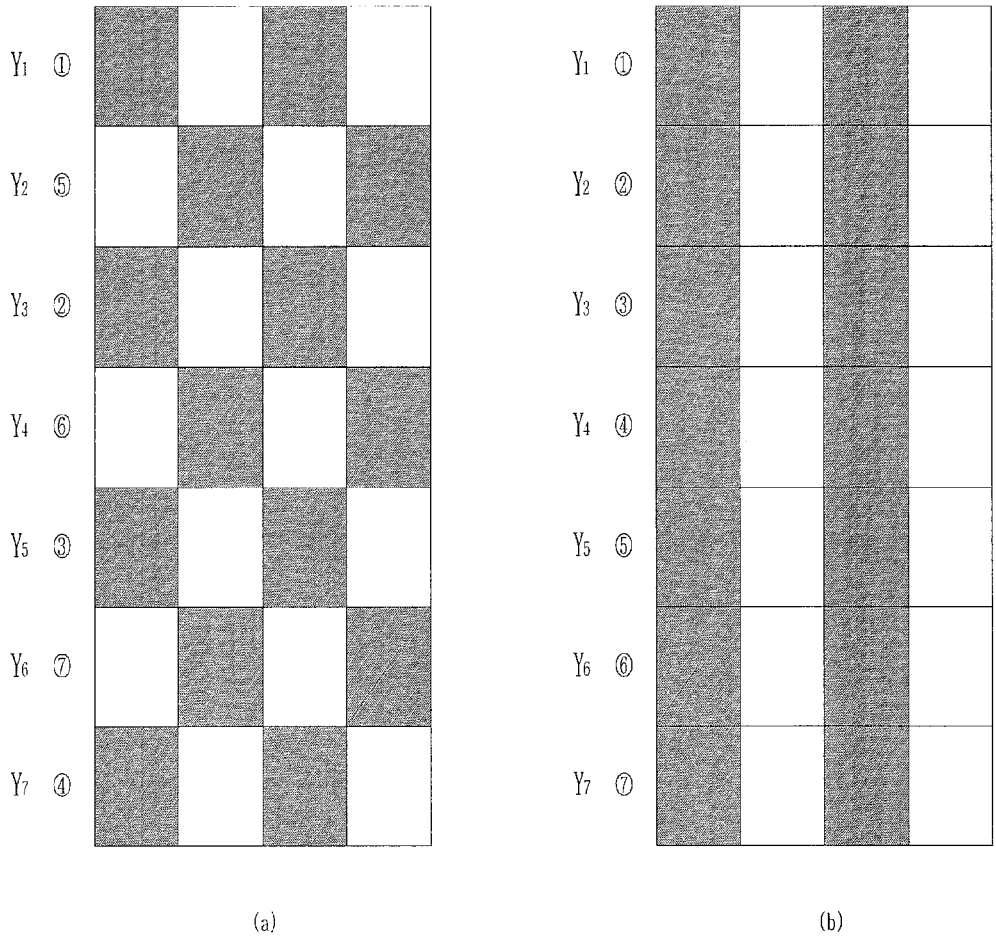
FIG. 24 is a view illustrating that scan orders can be different from each other in patterns of two different image data according to a first embodiment of the present invention.

FIG. 24 is a view illustrating that scan orders can be different from each other in the patterns of two different image data.

Referring to FIG. 24, (a) shows a pattern of image data, in which the logic level "1" and the logic level "0" are alternately disposed in up and down directions and right and left directions. (b) shows a pattern of image data, in which the logic levels "1" and "0" are alternately disposed in right and left directions, but the logic levels "1" and "0" are not changed in up and down directions.

In the case of the image data pattern of (a), the scan order of the scan electrodes Y is Y1-Y3-Y5-Y7-Y2-Y4-Y6. In the case of the image data pattern of (b), the scan order of the scan electrodes Y is Y1-Y2-Y3-Y4-Y5-Y6-Y7. That is, the scan order of the scan electrodes Y is different in the case where the image data have the pattern as shown in (a) and the image data have the pattern as shown in (b).

The reason why the scan order of the scan electrodes Y is adjusted, as described above, has already been described above in detail. Further description thereof will be omitted for simplicity.

Meanwhile, in the case where the scanning order of the scan electrodes Y is controlled in consideration of the pattern of the image data as described above, a critical value for the image data pattern can be set and the scanning order can be controlled according to the set critical value. This will be described below with reference to FIG. 25.

Figure 25:
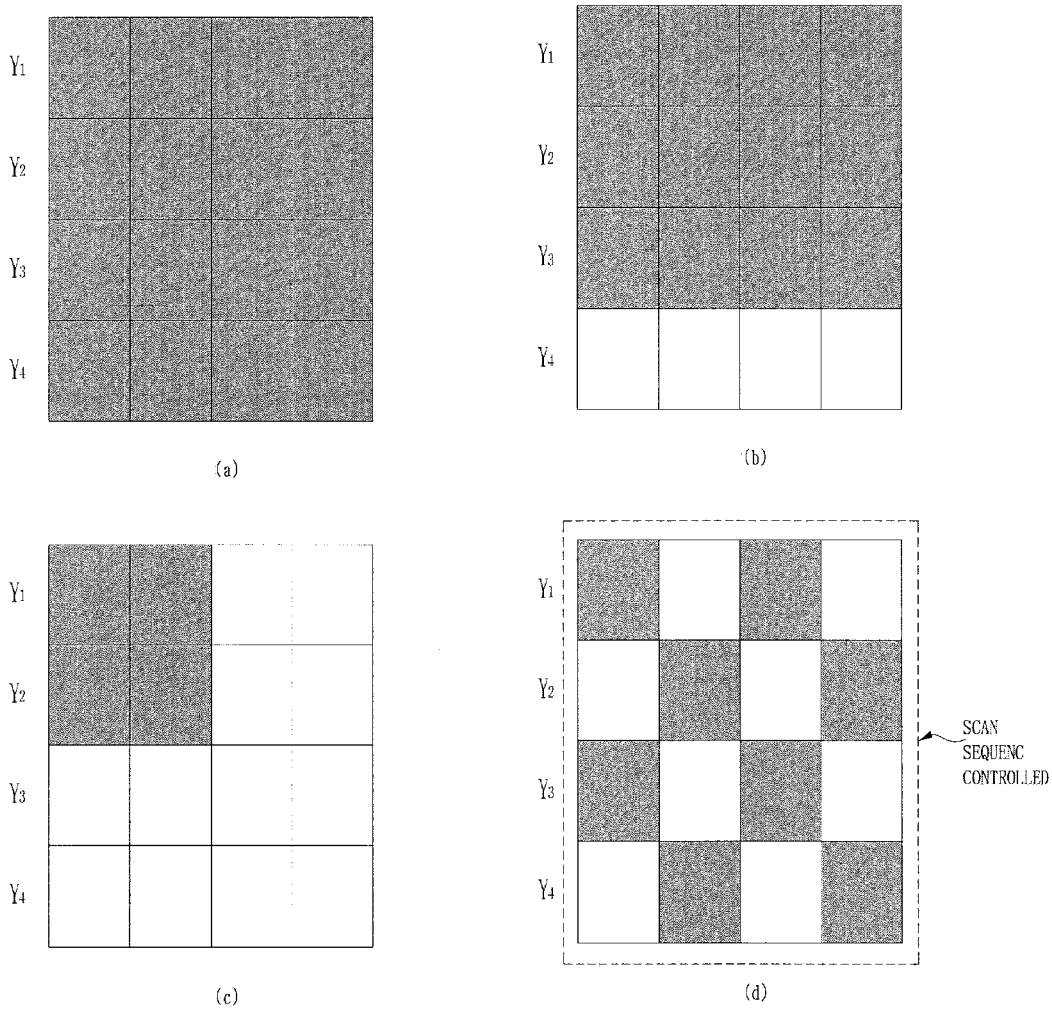
FIG. 25 is a view illustrating an exemplary method of controlling a scanning order by setting a critical value depending on an image data pattern according to a first embodiment of the present invention.

FIG. 25 is a view illustrating an example of a method of controlling a scanning order by setting a critical value depending on an image data pattern.

Referring to FIG. 25, (a) of FIG. 25 shows a case where image data are all high level, i.e., the logic level "1". (b) of FIG. 25 shows a case where image data are all the logic level "1" on Y1, Y2 and Y3 scan electrode lines and are all the logic level "0" on a Y4 scan electrode line. (c) of FIG. 25 shows a case where the first and second of Y1 and Y2 scan electrodes are the logic level "1" and the third and fourth of the Y1 and Y2 scan electrodes are the logic level "0", and image data are all the logic level "1" on Y3 and Y4 scan electrode lines. (d) of FIG. 25 shows a case where the logic levels "1" and "0" are alternately disposed.

In this case, in (a) of FIG. 25, since the data driver IC is not switched, a total of a switching number is 0. In (b) of FIG. 25, a total of four switching numbers of the data driver IC is generated in up and down directions. In (c) of FIG. 25, a total of twice switching numbers is generated in up and down directions and a total of twice switching numbers is generated in right and left directions. In (d) of FIG. 25, a total of twelve switching numbers is generated in up and down directions and a total of twelve switching numbers is generated in right and left directions. It can be seen that the case of (d) of FIG. 25 has the highest load depending on the pattern.

A load value according to the pattern of the data has been already described in detail. It is preferred that the load value is the sum of a load value in the longitudinal direction of a corresponding data pattern and a load value in the traverse direction of a corresponding data pattern.

Assuming that a previously set critical load value is a load depending on a total of ten switching numbers in up and down directions and a total of ten switching numbers in right and left directions, only the case of the last pattern (d) of the patterns (a), (b), (c) and (d) exceeds the previously set critical load value.

What the meaning that the critical load value is exceeded as described above means that the amount of the displacement current according to a pattern of data exceeds a previously set critical current can be seen through the above description on the present invention.

In this case, in the pattern (d), when the image data are supplied, the scanning order of the scan electrodes Y can be controlled. To control the scanning order of the scan electrodes Y has already been described in detail. Description thereof will be omitted in order to avoid redundancy.

Meanwhile, it has been described above that a scan type having a scan order corresponding to each of the scan electrodes Y is decided and scanning is performed according to the scan order corresponding to each of the scan electrodes Y using the scan type. It is, however, to be understood that a plurality of scan electrodes Y can be set as a scan electrode group and a scan order corresponding to the scan electrode group can be decided. This will now be described with reference to FIG. 26.

Figure 26:
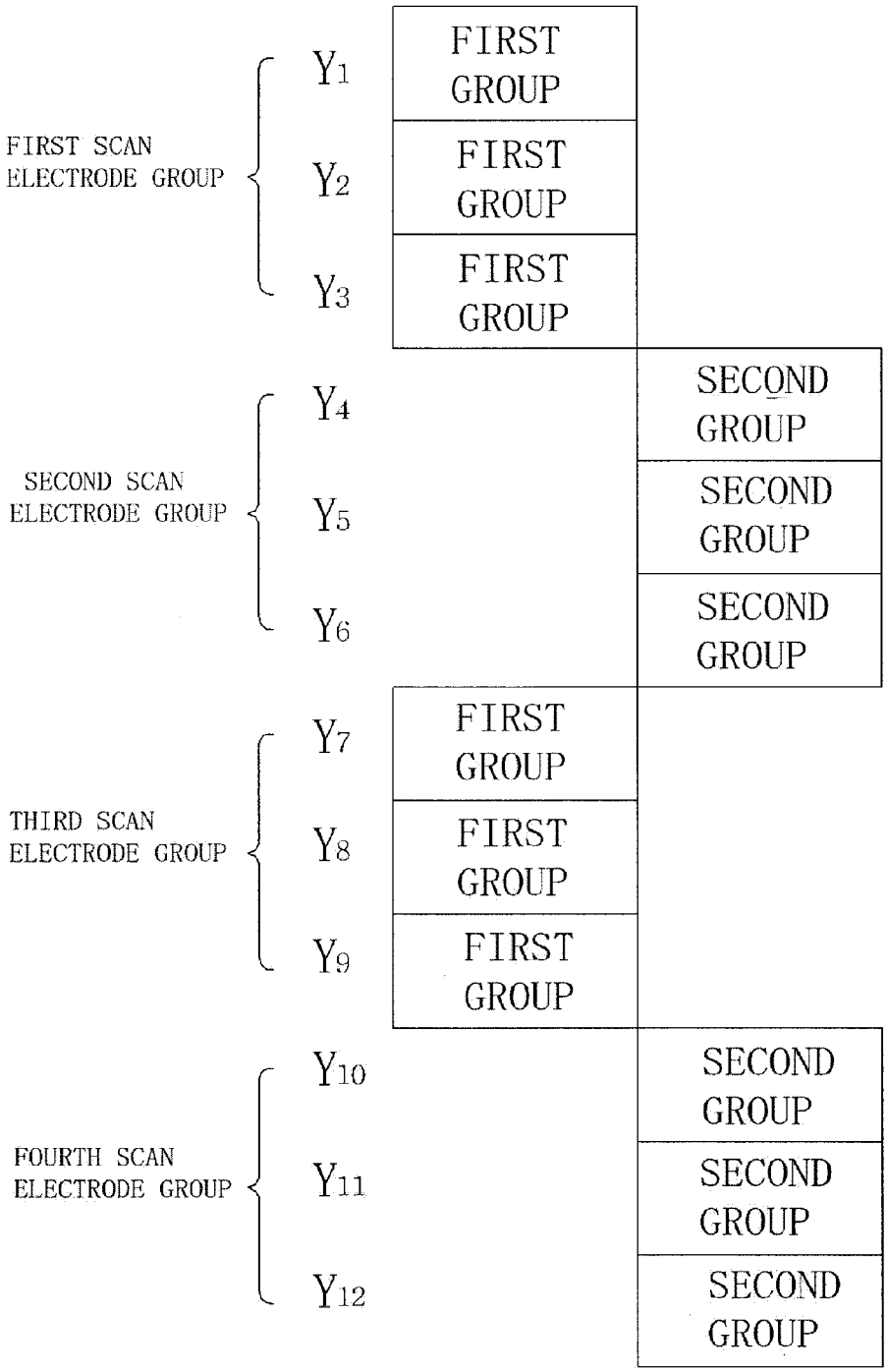
FIG. 26 is a view illustrating an exemplary method of deciding a scan order corresponding to scan electrode groups, each comprising a plurality of scan electrodes Y according to a first embodiment of the present invention.

FIG. 26 is a view illustrating an example of a method of deciding a scan order corresponding to scan electrode groups, each comprising a plurality of scan electrodes Y.

Referring to FIG. 26, Y1, Y2 and Y3 scan electrodes are set as a first scan electrode group, Y4, Y5 and Y6 scan electrodes are set as a second scan electrode group, Y7, Y8 and Y9 scan electrodes are set as a third scan electrode group, and Y10, Y11 and Y12 scan electrodes are set as a fourth scan electrode group. It has bee shown in FIG. 26 that each scan electrode group is set to include four scan electrodes. It is, however, to be understood that Furthermore, one or more of a plurality of scan electrode groups can be set to include a different number of scan electrodes Y from the remaining scan electrode groups. For example, two scan electrodes Y can be included in a first scan electrode group and four scan electrodes Y can be included in a second scan electrode group.

Figure 7:
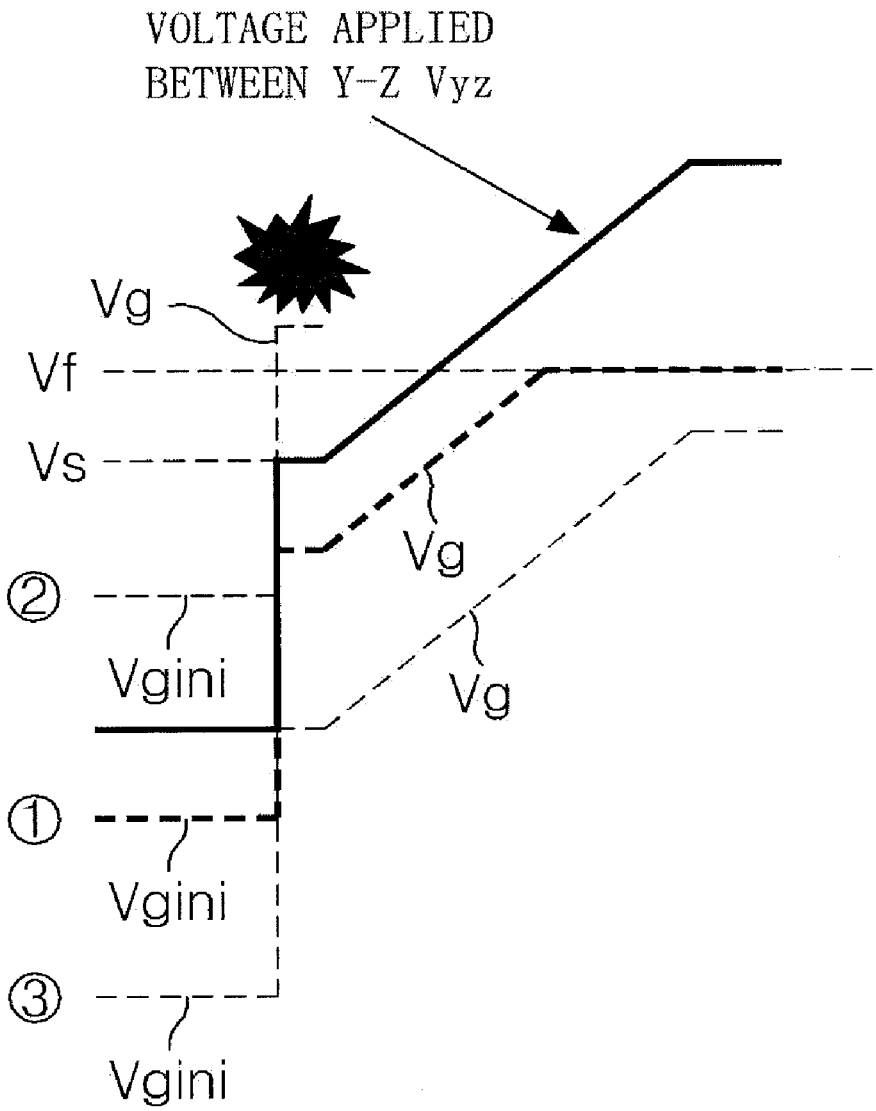
Fig. 7 Prior Art
FIG. 7 is a view illustrating variation in an externally applied voltage and a gap voltage within a discharge cell between scan electrodes and sustain electrodes in a set-up period when the PDP is driven according to the driving waveform as shown in FIG. 5.
Figure 8A:
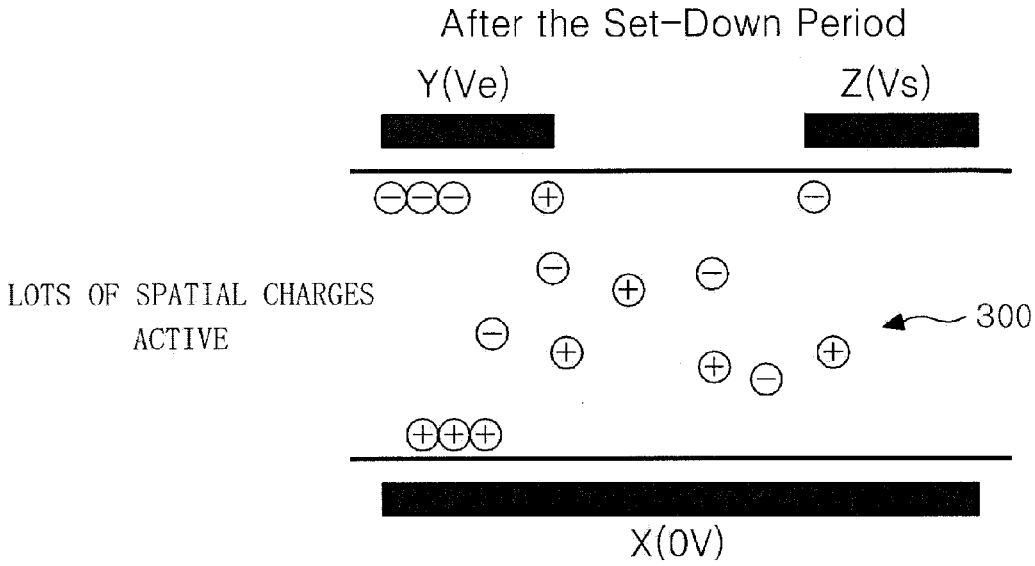
Fig. 8a Prior Art
FIGS. 8*a* to 8*c* are views illustrating spatial charges and the behavior of the spatial charges when the PDP is driven according to the driving waveform as shown in FIG. 5 under high temperature environment.
Figure 8B:
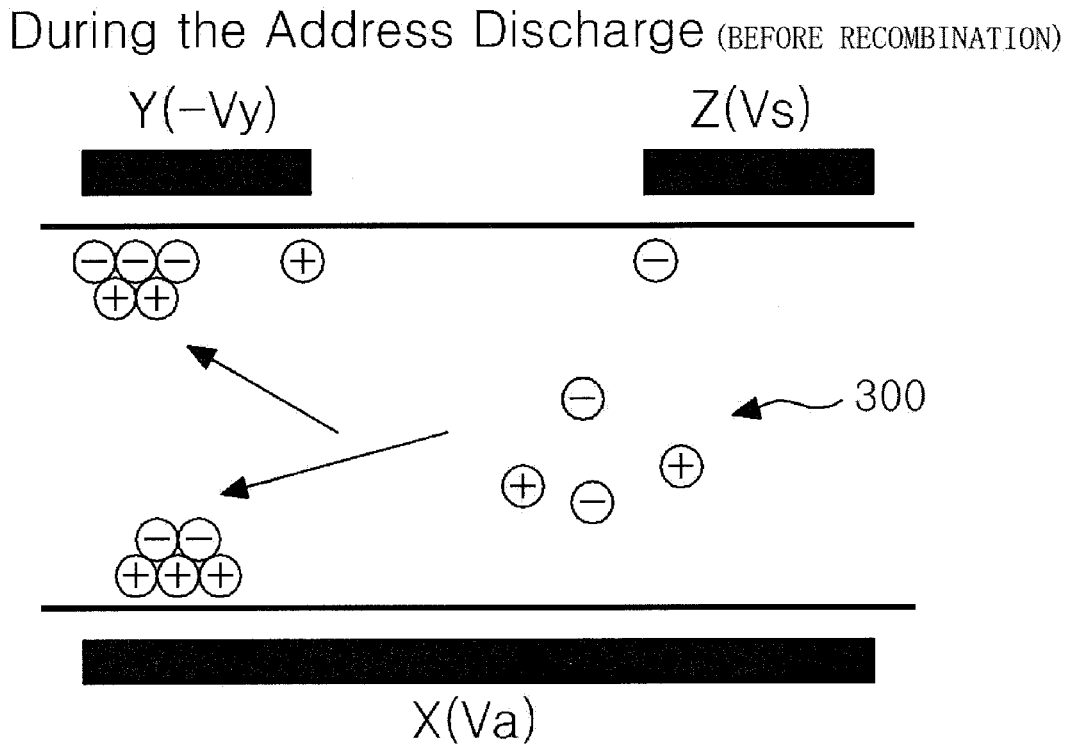
Fig. 8b Prior Art
Figure 8C:
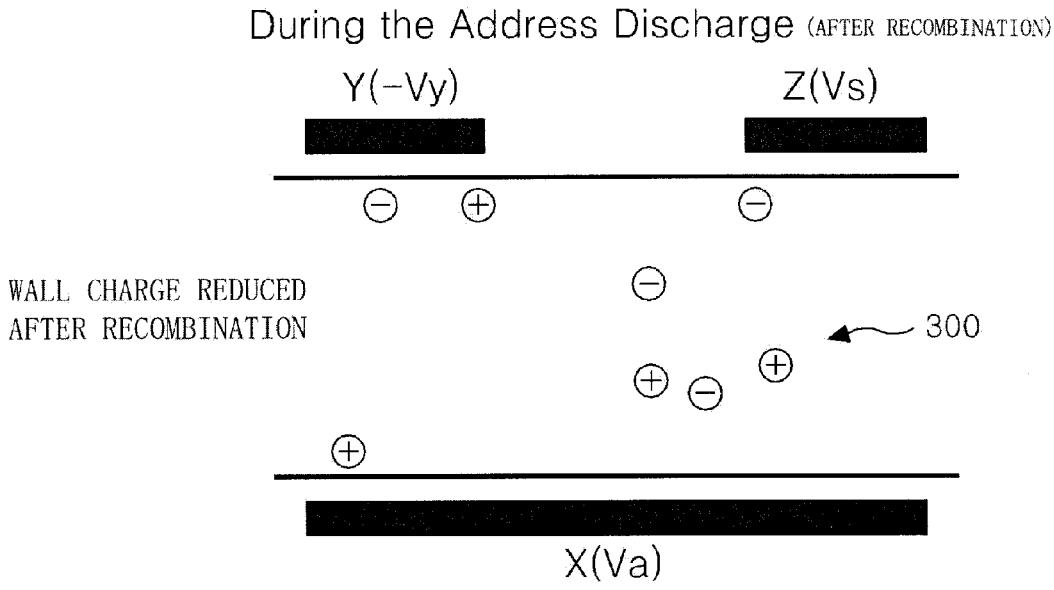
Fig. 8c Prior Art
Figure 8D:
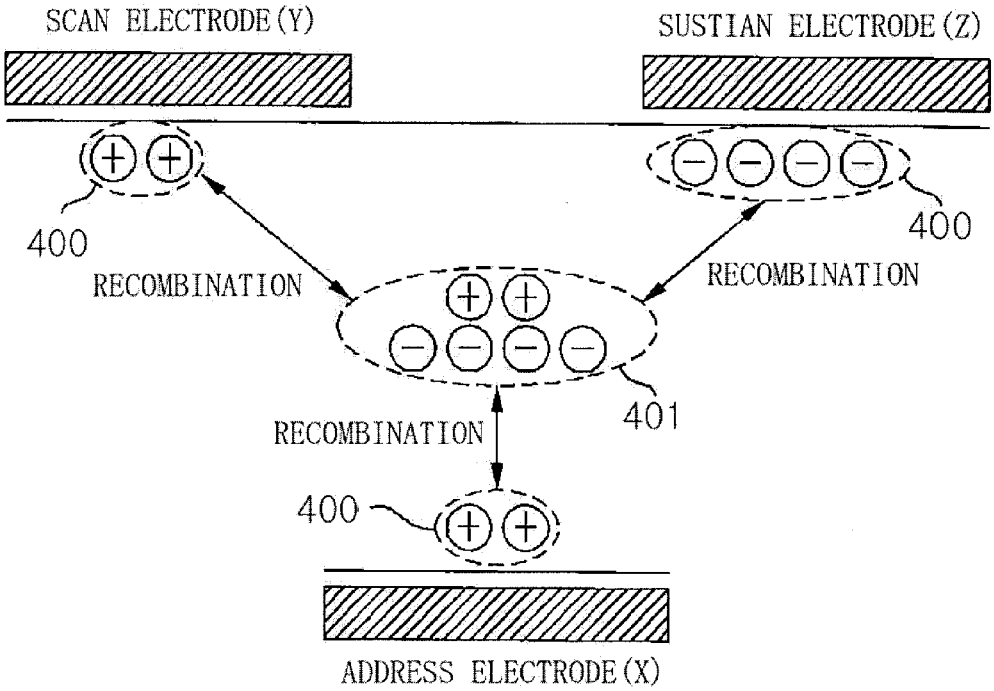
Fig. 8d Prior Art
FIG. 8*d* is a view illustrating an erroneous discharge depending on a temperature.

In the case where the scan electrode groups are set as described above, if the second type (Type 2) of FIG. 7 is applied, the third scan electrode group is scanned after scanning the first scan electrode group and the second and fourth scan electrode groups are then sequentially scanned, as in FIG. 21. In other words, the scanning order is Y1, Y2, Y3, Y7, Y8, Y9, Y4, Y5, Y6, Y10, Y11 and Y12.

In the description according to a first embodiment of the present invention, the method of scanning a plurality of scan electrodes Y according to one of a plurality of scan types where an order to scan the plurality of scan electrodes Y is different has been described in detail.

In a second embodiment of the present invention, a difference between an application time of a last sustain pulse of sustain pulses applied to the scan electrodes Y or the sustain electrodes Z in a sustain period subsequent to an address period to which the first embodiment is applied and an application time of a reset pulse applied to the scan electrodes Y in a reset period of a next sub-field is set to be greater than a different between application times of two sustain pulses.

Figure 27:
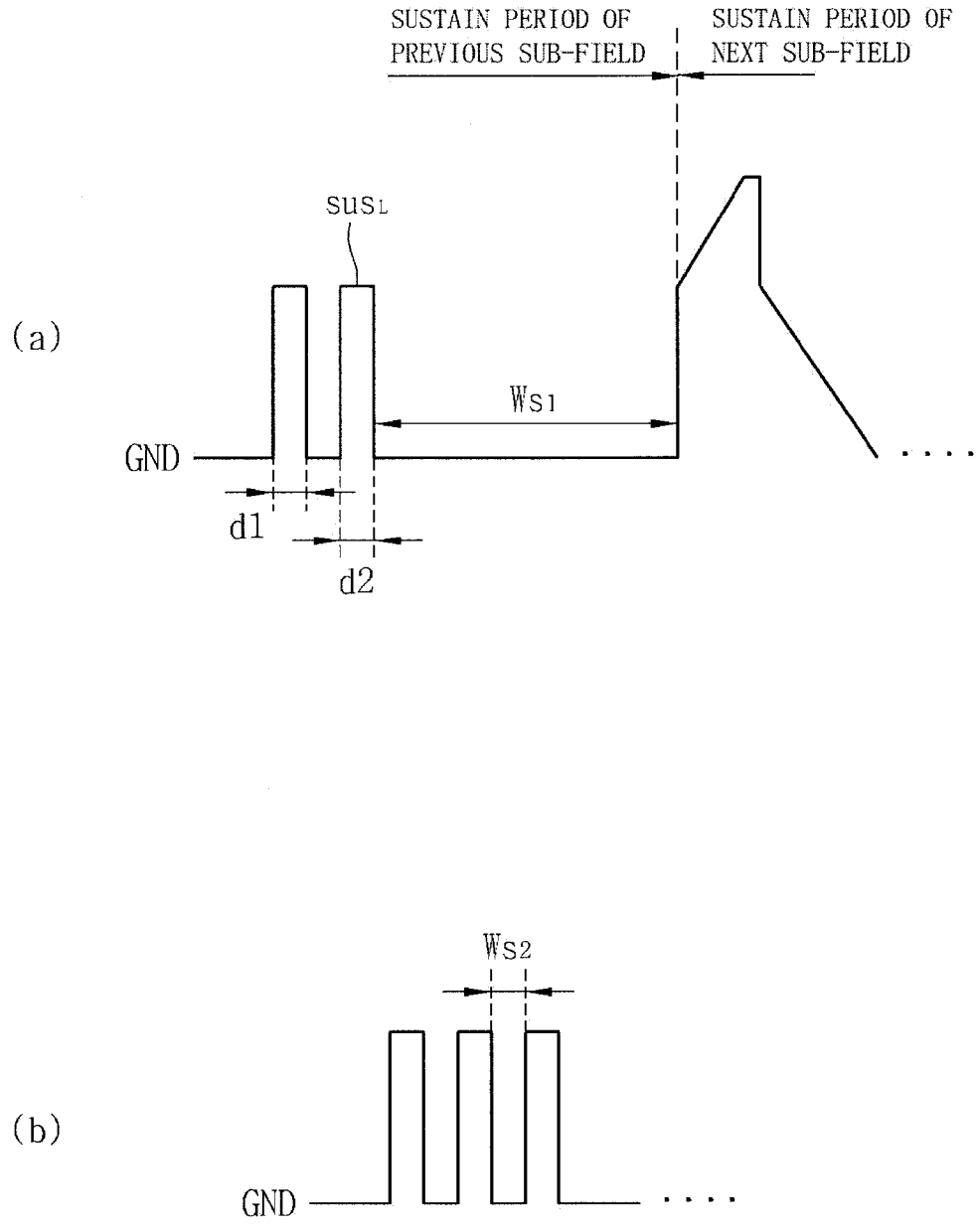
FIG. 27 is a view illustrating a method of controlling a difference between an application time of a last sustain pulse and an application time of a reset pulse applied in a reset period of a next sub-field according to a second embodiment of the present invention.

FIG. 27 is a view illustrating a method of controlling a difference between an application time of a last sustain pulse and an application time of a reset pulse applied in a reset period of a next sub-field according to a second embodiment of the present invention.

Referring to FIG. 27, (a) of FIG. 27 shows the relation between a last sustain pulse (SUSL) applied in a sustain period of any one of sub-fields and a reset pulse applied in a reset period of a next sub-field. FIG. 27 shows a case where the last sustain pulse (SUSL) is applied to the scan electrodes Y. It is, however, to be noted that the last sustain pulse (SUSL) can be applied to the sustain electrodes Z.

(b) of FIG. 27 shows a difference (Ws2) between application times in the remaining sustain pulses other than the last sustain pulse (SUSL).

Referring to (a), a time lag of Ws1 is placed between then application time of the last sustain pulse (SUSL) and the application time of a reset pulse applied in a reset period of a next sub-field.

Ws1 in (a) is set to be greater than Ws2 in (b).

The reason why Ws1 in (a) is set to be greater than Ws2 in (b) as described above will be described in detail with reference to FIG. 28.

Figure 28:
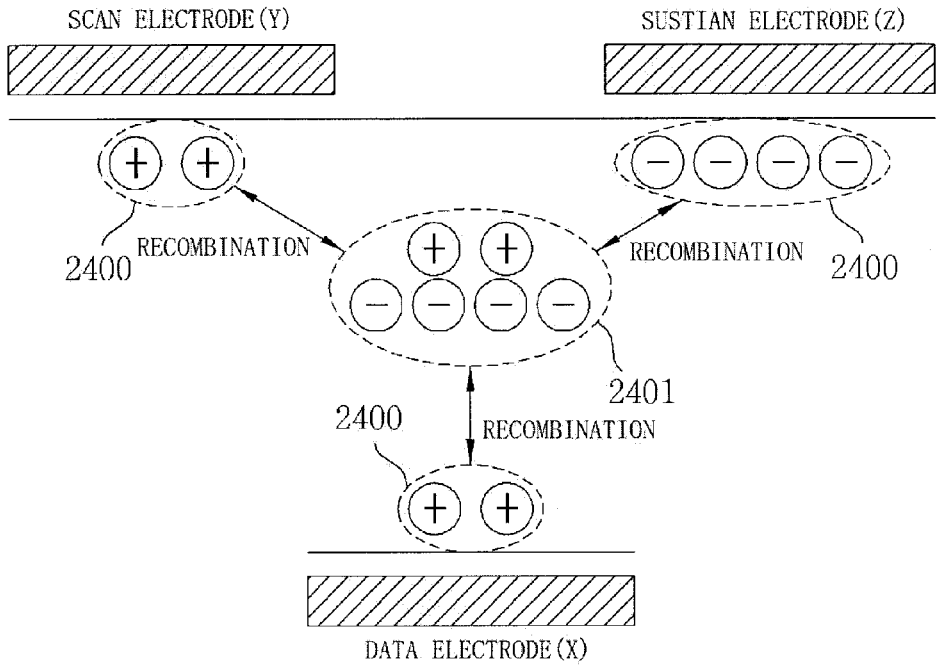
FIG. 28 is a view illustrating the reason why the application time of the sustain pulse is controlled according to a second embodiment of the present invention.

FIG. 28 is a view illustrating the reason why the application time of the sustain pulse is controlled according to a second embodiment of the present invention.

That is, FIG. 28 is a view illustrating the reason why a difference between an application time of the last sustain pulse (SUSL) of sustain pulses applied to the scan electrodes Y or the sustain electrodes Z and an application time of a reset pulse applied to the scan electrodes Y in a reset period of a next sub-field is set to be greater than an application time of two sustain pulses.

FIG. 28 shows the relation between wall charges 2400 located on a plurality of electrodes, such as scan electrodes Y, sustain electrodes Z and data electrodes X within one cell, and spatial charges 2401 located in the space within the cell.

Under this circumstance, in the case where an ambient temperature of the panel rises to a relatively high temperature, the recombination ratio between the spatial charges 2401 and the wall charges 2400 within the cell is increased.

In this case, since an absolute amount of wall charges participating in a discharge is reduced, an erroneous discharge, such as that a discharge is not generated in a cell where the discharge must be generated, occurs. In this case, the spatial charges 2401 are charges existing in the space within the cell, and do not take part in a discharge unlike the wall charges 2400.

For example, if the recombination ratio of the spatial charges 2401 and the wall charges 2400 increases in an address period, the amount of the wall charges 2400 taking part in an address discharge decreases, which makes unstable the address discharge. In this case, a time where the spatial charges 2401 and the wall charges 2400 can be recombined can be sufficiently secured as the order of addressing is later. This makes further unstable an address discharge. Therefore, a high temperature erroneous discharge, such as that a cell, which has been turned on in an address period, is turned off in a sustain period, is generated.

Furthermore, in the case where an ambient temperature of the panel is relatively high, if a sustain discharge is generated in a sustain period, the speed of the spatial charges 2401 becomes fast during the discharge. This increases the recombination ratio of the spatial charges 2401 and the wall charges 2400. Therefore, the amount of the wall charges 2400 that participate in the sustain discharge is reduced due to the recombination of the spatial charges 2401 and the wall charges 2400 after any one sustain discharge. This makes unstable a discharge in a next sub-field.

In this case, if a period from a time point where the application of the last sustain pulse (SUSL) is finished in the sustain period to a time point where the reset pulse is applied in a reset period of a next sub-field is set to be sufficiently long, a sufficient time of the degree in which the spatial charges 2401 can be reduced is secured after the application of the last sustain pulse (SUSL). Therefore, the spatial charges 2401 within the cell can be reduced.

Therefore, as the amount of the spatial charges 2401 within the cell decreases, generation of an erroneous discharge can be prohibited even at high temperature in which an ambient temperature of the panel is relatively high.

More particularly, as described above with reference to FIGS. 10 to 26, in the case where the plurality of scan electrodes Y is scanned using one of a plurality of scan types in which the order of scanning the scan electrodes Y in the address period is different in at least one of sub-fields of a frame, the scan order of specific scan electrodes Y can be frequently changed. In this case, the distribution of wall charges within a cell, which are formed in the address period, may become relatively unstable in comparison with a case where the scan order is constant.

For example, in the case of the third scan electrode Y3 in FIG. 12, if the scan electrodes Y are scanned using the first scan type (Type 1), the scanning order of the third scan electrode Y is the third. If the scan electrodes Y are scanned using the second scan type (Type 2), the scan order of the third scan electrode Y3 is the second. If the scan electrodes Y are scanned using the third scan type (Type 3), the scan order of the third scan electrode Y3 is the seventh. If the scanning order of the third scan electrode Y3 is frequently changed as described above, the distribution of the wall charges within the cell, which are located on the third scan electrode Y3 lines, becomes unstable.

In this case, if a period from an application time of the last sustain pulse (SUSL), of sustain pulses supplied to the scan electrodes Y or the sustain electrodes Z, to an application time of a reset pulse applied to the scan electrodes Y in a reset period of a next sub-field is set to be sufficiently long, i.e., a period from a time point where the application of the last sustain pulse (SUSL) in a sustain period is finished to a time point where a reset pulse is applied in a reset period of a next sub-field is set to be sufficiently long, spatial charges within cells located on the above third scan electrode Y3 line can be sufficiently reduced. This can stabilize a discharge within cells located on the third scan electrode Y3 line.

Reference will be then made to FIG. 27.

The difference (Ws2) between the application time of the last sustain pulse (SUSL) and the application time of the reset pulse applied to the scan electrodes Y in a reset period of a next sub-field in (a) can be set to 1 to 1000 times or less of a difference between application times of two sustain pulses in (b). That is, the relation $Ws2 < Ws1 \leqq 1000Ws2$ is established.

Meanwhile, the difference between the application time of the last sustain pulse (SUSL) and the application time of the reset pulse applied to the scan electrodes Y in a reset period of a next sub-field can be set in the range of 100 μs to 1 ms.

In this case, a pulse width of the last sustain pulse (SUSL) is d2, which is set to be approximately the same as a pulse width d1 of the remaining sustain pulses.

A voltage of the scan electrodes Y is kept to the ground level (GND) for the period Ws1 after the last sustain pulse (SUSL) having the same pulse width as that of the remaining sustain pulses is applied as described above. Therefore, a time lag is generated between the application time of the last sustain pulse (SUSL) and the application time of a reset pulse applied in a reset period of a next sub-field.

As a result, in FIG. 27, a difference between the application time of the last sustain pulse (SUSL) and the application time of the reset pulse applied to the scan electrodes Y in a reset period of a next sub-field is a period where the voltage of the scan electrodes Y is kept to the voltage of the ground level (GMD) after the last sustain pulse (SUSL) is applied. Therefore, the length of the period where the voltage of the scan electrodes Y is kept to the voltage of the ground level (GMD) is set in the range of 100 μs to 1 ms.

In this case, the reason why the period up to the reset period of the next sub-field after the application of the last sustain pulse (SUSL) is finished is set to 100 μs or higher, i.e., the lowest critical value is set to 100 μs is to sufficiently reduce spatial charges generated during the sustain discharge of the PDP. The reason why the period up to the reset period of the next sub-field after the application of the last sustain pulse (SUSL) is finished is set to 1 ms or less, i.e., the highest critical value is set to 1 ms is to secure operating margin of the sustain period during sustain driving of the PDP.

Furthermore, FIG. 27 shows that Ws1 of (a) is set to be greater than Ws2 of (b) only in one sub-field. However, Ws1 of (a) can be set to be greater than Ws2 of (b) in the entire sub-fields included in a frame.

For example, in the case where one frame includes a total of 12 sub-fields, a difference between an application time of the last sustain pulse (SUSL), of sustain pulses applied to the scan electrodes Y or the sustain electrodes Z, and an application time of a reset pulse applied to the scan electrodes Y in a reset period of a next sub-field, in the entire 12 sub-fields, can be set to be greater than a difference between application times of two sustain pulses.

The application time of the sustain pulse, which has been described with reference to FIG. 27, will be described in more detail with reference to FIG. 29.

Figure 29:
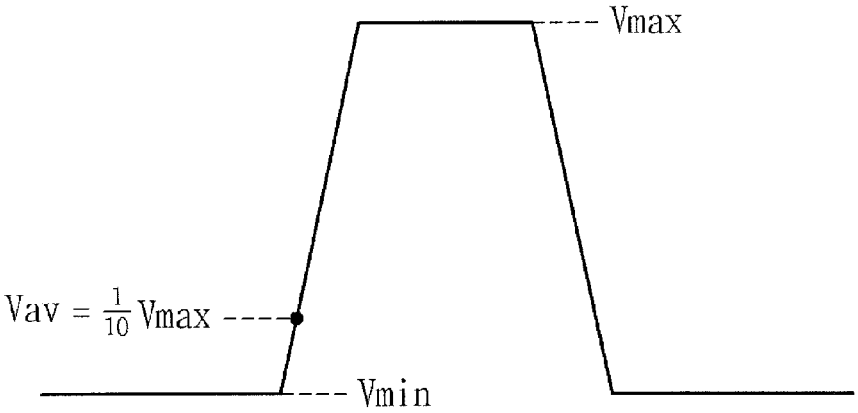
FIG. 29 is a view illustrating, in detail, the application time of the sustain pulse.

FIG. 29 is a view illustrating, in detail, the application time of the sustain pulse.

Referring to FIG. 29, the application time of the last sustain pulse can be a time point at which an average voltage approximately becomes 10% (Vmax/10) of the highest voltage (Vmax) while a voltage of the last sustain pulse (SUSL) rises from the lowest voltage (Vmin).

Furthermore, though not shown in the drawing, the meaning that the application of the last sustain pulse (SUSL) is finished refers to a case where the voltage of the last sustain pulse (SUSL) becomes approximately 10% or less of the highest voltage. In other words, assuming that the highest voltage of the last sustain pulse (SUSL) is 200V, it is said that a case where the voltage of the last sustain pulse (SUSL) becomes approximately 20V refers to that the application the last sustain pulse (SUSL) is finished.

In the above, a difference between the application time of the last sustain pulse (SUSL) and the application time of the reset pulse applied in a reset period of a next sub-field is controlled by sustaining the voltage of corresponding electrodes, e.g., the scan electrodes Y in FIG. 27 to the voltage of the ground level (GND) from a time point where the application of the last sustain pulse (SUSL) is finished to the application time of the reset pulse applied in the reset per of the next sub-field.

However, a difference between the application time of the last sustain pulse (SUSL) and the application time of the reset pulse applied in a reset period of a next sub-field can be controlled by adjusting the pulse width of the last sustain pulse (SUSL). This will be described below with reference to FIG. 30.

Figure 30:
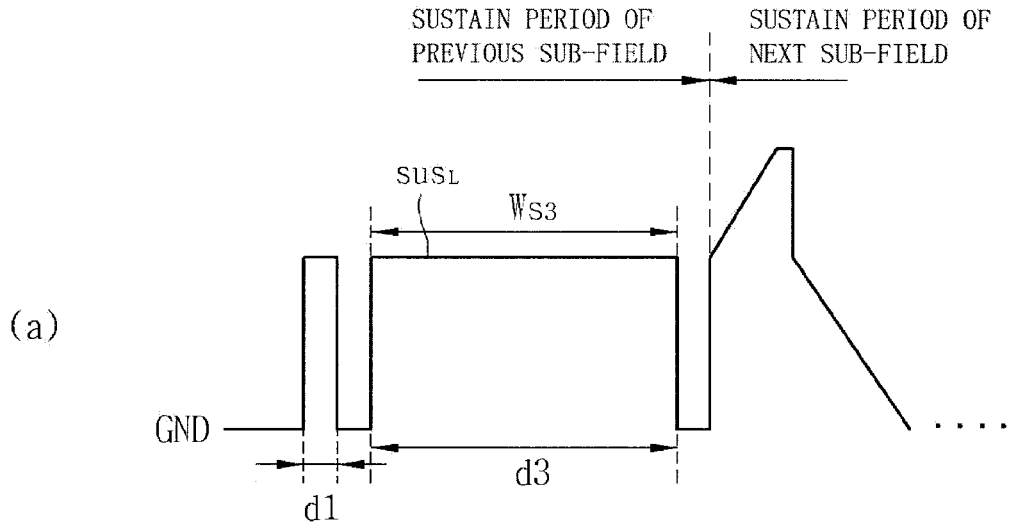
FIG. 30 is a view illustrating another method of controlling a difference between an application time of a last sustain pulse and an application time of a reset pulse applied in a reset period of a next sub-field according to a second embodiment of the present invention.
Figure 30:
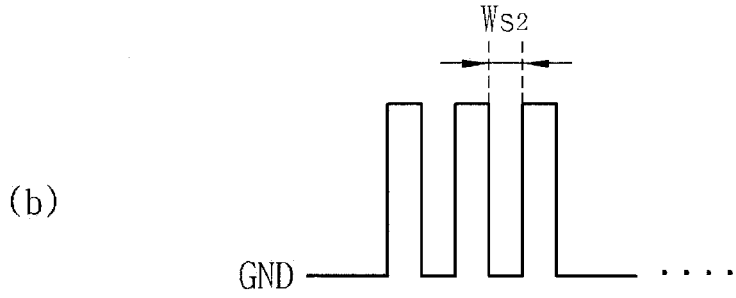

FIG. 30 is a view illustrating another method of controlling a difference between an application time of a last sustain pulse and an application time of a reset pulse applied in a reset period of a next sub-field according to a second embodiment of the present invention.

Referring to FIG. 30, (a) shows the relation of the last sustain pulse (SUSL) applied in a sustain period of any one of sub-fields and a reset pulse applied in a reset period of a next sub-field. FIG. 30 also shows an example of a case where the last sustain pulse (SUSL) is applied to the scan electrodes Y in the same manner as FIG. 27. However, unlike the case of FIG. 30, the last sustain pulse (SUSL) can be applied to the sustain electrodes Z.

(b) shows a difference (Ws2) between application times between the remaining sustain pulses other than the last sustain pulse (SUSL) in the same manner as FIG. 27.

Referring to (a), there exists a time lag of Ws3 between the application time of the last sustain pulse (SUSL) and the application time of the reset pulse applied in the reset period of the next sub-field.

Ws3 in (a) is set to be greater than Ws2 in (b).

However, in FIG. 30, the difference between the application time of the last sustain pulse (SUSL) and the application time of the reset pulse applied in the reset period of the next sub-field is generated as the pulse width of the last sustain pulse (SUSL) is increased, unlike FIG. 27.

In other words, a width (d3) of the last sustain pulse (SUSL) is greater than a width (d1) of the remaining sustain pulses.

The width of the last sustain pulse (SUSL) can be set within a range of 100 μs to 1 ms.

The reason why the pulse width of the last sustain pulse (SUSL) is set to 100 μs or higher, i.e., the lowest critical value is set to 100 μs is to sufficiently reduce spatial charges generated during a sustain discharge of the PDP. The reason why the pulse width of the last sustain pulse (SUSL) is set to 1 ms or less, i.e., the highest critical value is set to 1 ms is to secure operating margin of a sustain period during sustain driving of the PDP.

The reason why Ws3 in (a) is set to be greater than Ws2 in (b), as described above, is to reduce spatial charges within cells in the same manner as FIG. 27. This has been described in detail with reference to FIGS. 27 to 24. Description thereof will be omitted in order to avoid redundancy.

Figure 31:
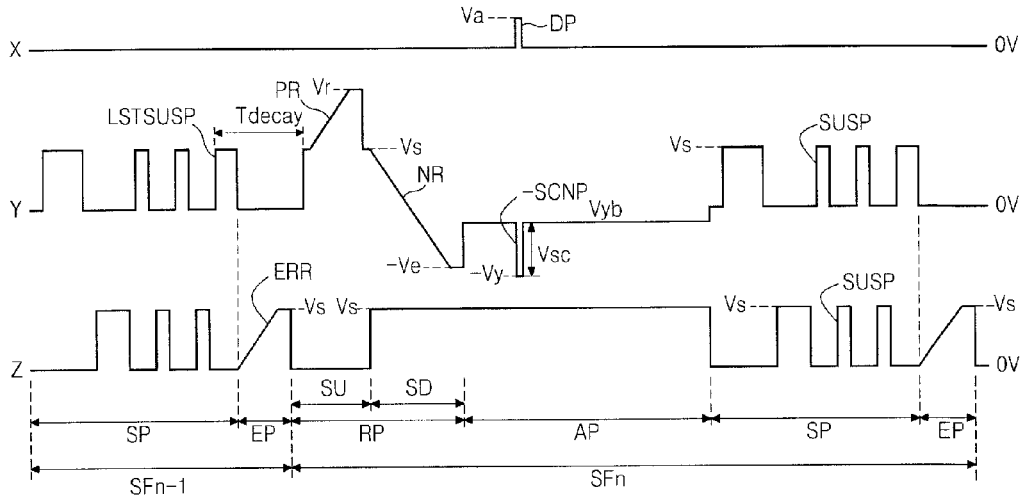
FIG. 31 is a waveform illustrating an example of a driving method of a plasma display apparatus according to a second embodiment of the present invention.

FIG. 31 is a waveform illustrating an example of a driving method of a plasma display apparatus according to a second embodiment of the present invention.

The driving waveform of FIG. 31 can be applied to a three-electrode AC surface-discharge type PDP.

Referring to FIG. 31, each of sub-fields (SFn−1, SFn) includes a reset period (RP) for initializing discharge cells of the entire screen, an address period (AP) for selecting a discharge cell, a sustain period (SP) for sustaining a discharge of a selected discharge cell, and an erase period (EP) for erasing wall charges within a discharge cell.

Figure 5:
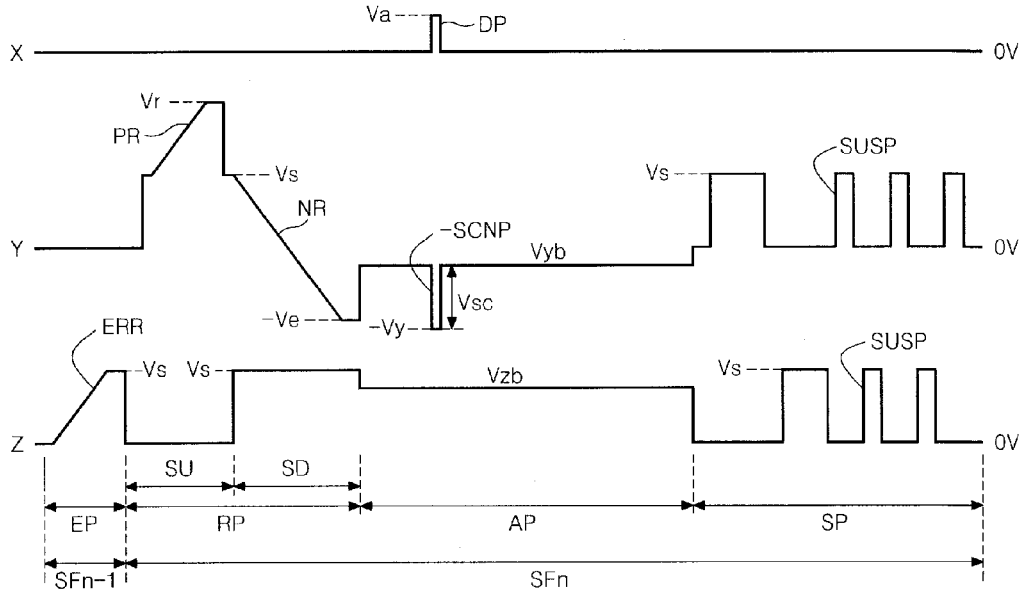
Fig. 5 Prior Art
FIG. 5 is a waveform showing an example of a driving waveform of a general PDP.

The reset period (RP), the address period (AP) and the sustain period (SP) are substantially the same as the driving waveform of FIG. 5. Description thereof will be omitted.

In an example of the method of driving the plasma display apparatus according to a second embodiment of the present invention, a spatial charge decay period (Tdecay) for inducing decay of spatial charges under high temperature environment of 40° C. or higher is set between a rising time point of a last sustain pulse (LSTSUSP) of the $(n-1)^{th}$ sub-field (SFn−1) and a rising time point of a positive ramp waveform (PR) where the reset period (RP) of the $n^{th}$ sub-field (SFn) begins.

The spatial charge decay period (Tdecay) is set to be long under high temperature environment of 40° C. or higher in comparison with normal temperature environment. The time is approximately 300 μs±50 μs. During the spatial charge decay period (Tdecay), spatial charges, which are generated in a sustain discharge of the $(n-1)^{th}$ sub-field (SFn−1), are decay due to recombination among them and recombination with wall charges. After such decay of the spatial charges, during the reset period (RP) of the $n^{th}$ sub-field (SFn), a set-up discharge and a set-down discharge are consecutively generated. As a result, soon after the reset period (RP) of the $n^{th}$ sub-field (SFn), each discharge cell is initialized to optimal wall charge distribution conditions for an address discharge almost without the spatial charges as in FIG. 6*c*.

During the erase period (EP) existing within the spatial charge decay period (Tdecay), an erase ramp waveform (ERR) for inducing an erase discharge within the discharge cell is applied to the sustain electrodes Z. The erase ramp waveform (ERR) is a positive ramp waveform whose voltage gradually rises from 0V to a positive sustain voltage (Vs). The erase ramp waveform (ERR) causes the erase discharge to be generated between the scan electrodes Y and the sustain electrodes Z within on-cells in which the sustain discharge has occurred, thus erasing wall charges.

Figure 32:
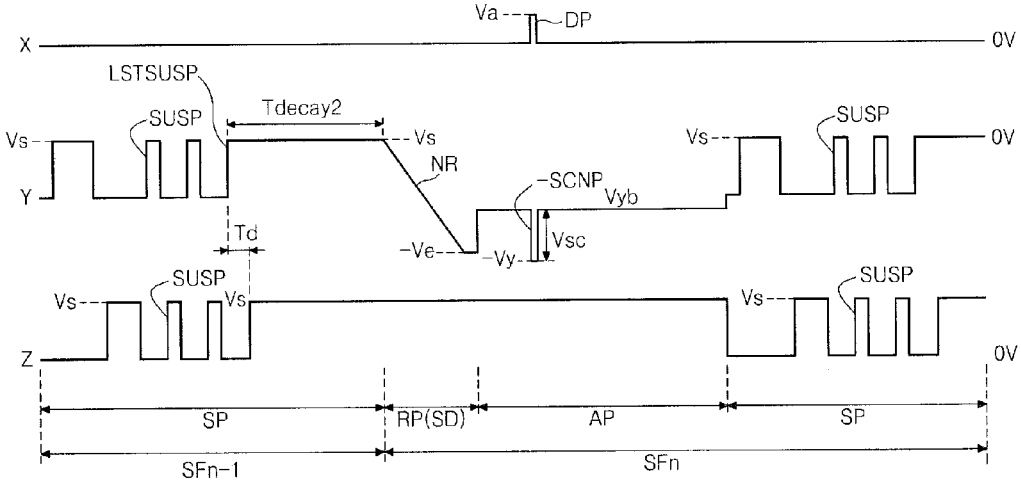
FIG. 32 is a waveform illustrating another example of a driving method of a plasma display apparatus according to a second embodiment of the present invention.

FIG. 32 is a waveform illustrating another example of a driving method of a plasma display apparatus according to a second embodiment of the present invention.

The driving waveform of FIG. 32 can be applied to a PDP in which discharge cells can be initialized, i.e., a PDP in which the degree of uniformity is high in discharge cells and driving margin is wide only through a last sustain discharge in a previous sub-field and a set-down discharge in a sub-field subsequent to the sub-field without a set-up discharge.

Referring to FIG. 32, a $(n-1)^{th}$ sub-field (SFn−1) includes a reset period (RP), an address period (AP) and a sustain period (SP). A $n^{th}$ sub-field (SFn) includes a reset period (RP) having only a set-down period without a set-up period, an address period (AP), a sustain period (SP) and an erase period (EP).

The address period (AP) and the sustain period (SP) are substantially the same as the driving waveform of FIG. 5 and the embodiment of FIG. 31. Description thereof will be omitted.

In another example of the method of driving the plasma display apparatus according to a second embodiment of the present invention, a spatial charge decay period (Tdecay2) for inducing decay of spatial charges under high temperature environment is set between a rising time point of a last sustain pulse (LSTSUSP2) of the $(n-1)^{th}$ sub-field (SFn−1) and a rising time point of a positive ramp waveform (PR) where the reset period (RP) of the $n^{th}$ sub-field (SFn) begins.

Figure 6A:
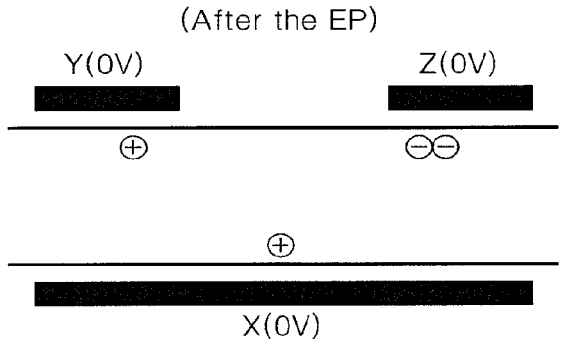
Fig. 6a Prior Art
FIGS. 6*a* to 6*e* are views showing, step by step, the distribution of wall charges within a discharge cell, which is varied according to the driving waveform as shown in FIG. 5.
Figure 6B:
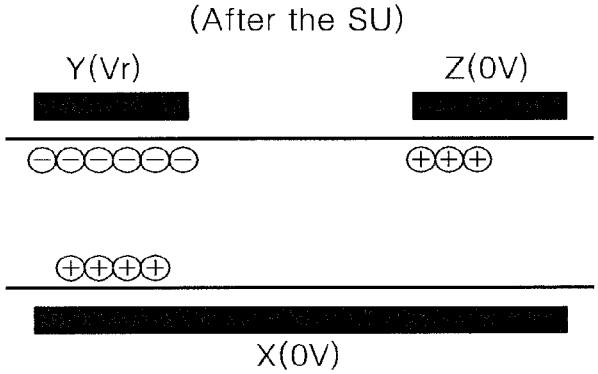
Fig. 6b Prior Art

The spatial charge decay period (Tdecay2) is the same as a pulse width of the last sustain pulse, and is set to be long under high temperature environment of 40° C. or higher in comparison with normal temperature environment. The spatial charge decay period (Tdecay2) is approximately 300 μs±50 μs at high temperature. During the spatial charge decay period (Tdecay2), a last sustain pulse (LSTSUSP) of a sustain voltage (Vs) is applied to the scan electrodes Y and the sustain voltage (Vs) is kept therein. The sustain voltage (Vs) is supplied to the sustain electrodes Z after a predetermined time (Td) since the last sustain pulse (LSTSUSP) is applied to the scan electrodes Y. This voltage causes negative spatial charges to be accumulated on the scan electrodes Y and positive spatial charges to be accumulated on the address electrodes X during the spatial charge decay period (Tdecay2). Therefore, soon after the spatial charge decay period (Tdacay2), each discharge cell is initialized to the distribution of wall charges, which is similar to an existing set-up discharge result, i.e., the distribution of wall charges in which most spatial charges are erased in each discharge cell, which is similar to FIG. 6*b*.

Figure 6C:
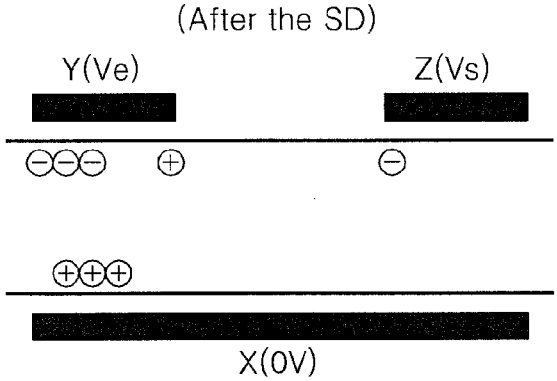
Fig. 6c Prior Art
Figure 6D:
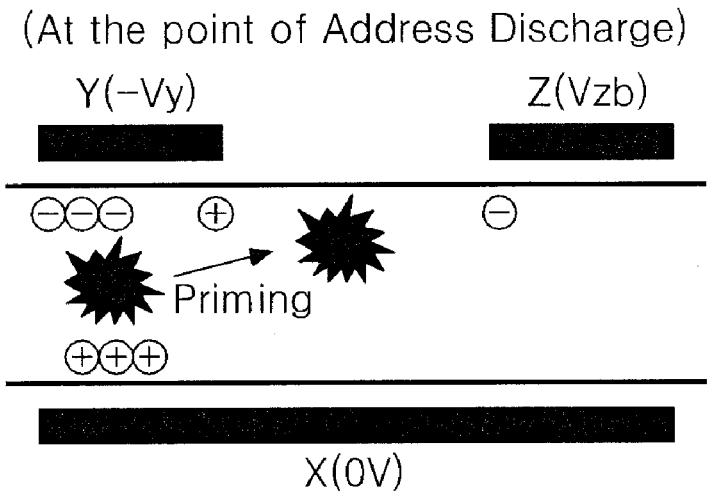
Fig. 6d Prior Art
Figure 6E:
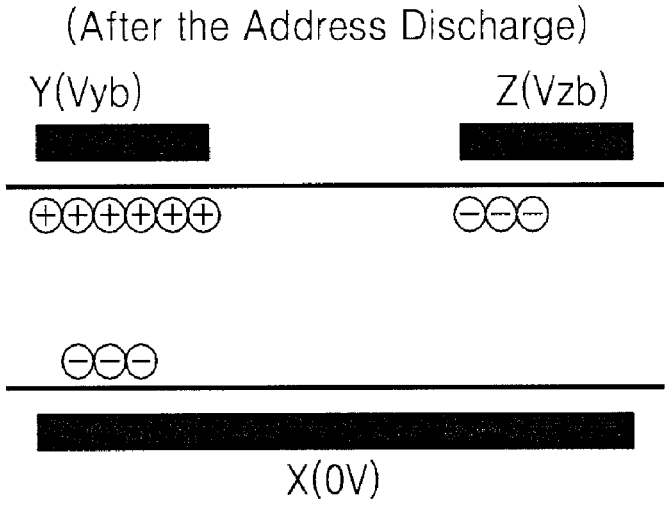
Fig. 6e Prior Art

In a reset period (RP(SD)) of the $n^{th}$ sub-field (SFn) subsequently to the spatial charge decay period (Tdecay2), a negative ramp waveform (NR) is applied to the scan electrodes Y. During the reset period (RP(SD)), a positive sustain voltage (Vs) is applied to the sustain electrodes Z and 0V is applied to the address electrodes X. The negative ramp waveform (NR) causes a voltage on the scan electrodes Y to gradually falls from the positive sustain voltage (Vs) up to a negative erase voltage (Ve). The negative ramp waveform (NR) generates a dark discharge between the scan electrodes Y and the address electrodes X within the entire discharge cells of the screen and generates a dark discharge between the scan electrodes Y and the sustain electrodes Z. As a result of the dark discharge of the set-down period (SD), the distribution of wall charges within each discharge cells is changed to an optima address condition as shown in FIG. 6*c*.

Figure 33:
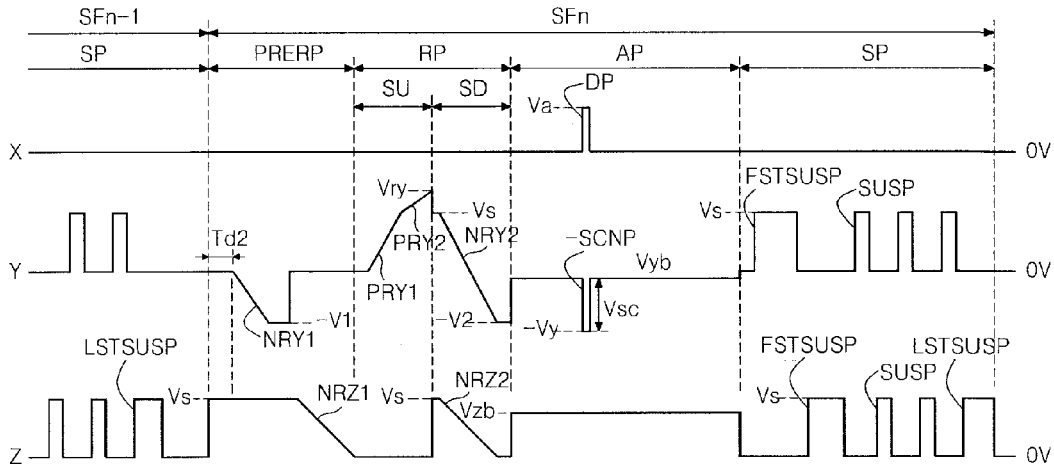
FIG. 33 is a waveform illustrating further another example of a driving method of a plasma display apparatus according to a second embodiment of the present invention.

FIG. 33 is a waveform illustrating further another example of a driving method of a plasma display apparatus according to a second embodiment of the present invention. FIGS. 34*a* to 34*e* are views showing, step by step, the distribution of wall charges within a discharge cell, which is varied according to the driving waveform as shown in FIG. 33.

The driving waveform of FIG. 33 will be described in connection with the distribution of wall charges of FIGS. 34*a* to 34*e*.

Referring to FIG. 33, under high temperature environment, at least one sub-field, e.g., a first sub-field is driven with it being time divided into a pre-reset period (PRERP) for forming positive wall charges on the scan electrodes Y and negative wall charges on the sustain electrodes Z, a reset period (RP) for initializing the discharge cells of the entire screen using the distribution of wall charges formed in the pre-reset period (PRERP), an address period (AP), and a sustain period (SP) for sustaining a discharge of a selected discharge cell. An erase period may be included between the sustain period (SP) and a reset period of a next sub-field.

In the pre-reset period (PRERP), after a positive sustain voltage (Vs) is applied to the entire sustain electrodes Z, a first Y negative ramp waveform (NRY1) whose voltage drops from 0V or a ground voltage (GND) to a negative −V1 voltage is applied to the entire scan electrodes Y after a predetermined time (Td2) elapses. In this case, the predetermined time (Td2) may be varied depending on a panel characteristic. While the voltage of the sustain electrodes Z is sustained, the voltage of the scan electrodes Y drops and is then kept to −V1 voltage for a predetermined time. During the pre-reset period (PRERP), 0V is applied to the address electrodes X.

Figure 34A:
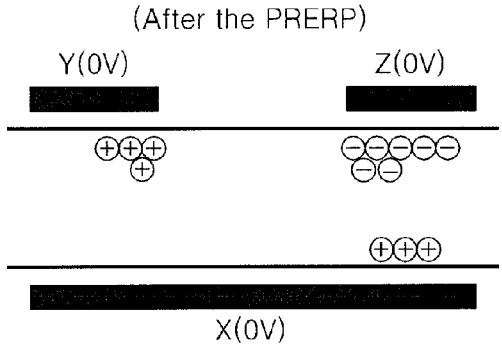
FIGS. 34*a* to 34*e* are views showing, step by step, the distribution of wall charges within a discharge cell, which is varied according to the driving waveform as shown in FIG. 33.

During an initial predetermined time (Td2) of the pre-reset period (PRERP), negative spatial charges within the discharge cell are accumulated on the scan electrodes Y and ten changed to wall charges, due to a difference between the sustain voltage (Vs) applied to the sustain electrodes Z and 0V applied to the scan electrodes Y. Positive spatial charges within the discharge cell are accumulated on the sustain electrodes Z and then changed to wall charges. After the spatial charges are erased, the sustain voltage (Vs) applied to the sustain electrodes Z and the first Y negative ramp waveform (NRY1) applied to the scan electrodes Y generate a dark discharge between the scan electrodes Y and the sustain electrodes Z and between the sustain electrodes Z and the address electrodes X over the entire discharge cells. As a result of the discharge, immediately after the pre-reset period (PRERP), positive wall charges are accumulated on the scan electrodes Y and negative wall charges are accumulated on the sustain electrodes Z within the entire discharge cells, as shown in FIG. 34*a*. The wall charge distribution of FIG. 34*a* causes a sufficiently high positive gap voltage to be formed between the scan electrodes Y and the sustain electrodes Z within the entire discharge cells and an electric field to be formed in a direction from the scan electrodes Y to the sustain electrode Z within each of the discharge cells.

Figure 34B:
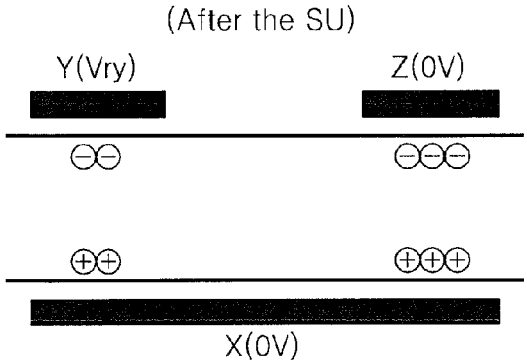

In a set-up period (SU) of the reset period (RP), a first Y positive ramp waveform (PRY1) and a second Y positive ramp waveform (PRY2) are continuously applied to the entire scan electrodes Y, and 0V is applied to the sustain electrodes Z and the address electrodes X. A voltage of the first Y positive ramp waveform (PRY1) rises from 0V to the positive sustain voltage (Vs) and a voltage of the second Y positive ramp waveform (PRY2) rises from the positive sustain voltage (Vs) to a positive Y reset voltage (Vry) higher than the positive sustain voltage (Vs). A tilt of the second Y positive ramp waveform (PRY2) is smaller than that of the first Y positive ramp waveform (PRY1). Meantime, the first Y positive ramp waveform (PRY1) and the second Y positive ramp waveform can be set to have the same tilt depending on a panel characteristic. As the first Y positive ramp waveform (PRY1) and a voltage of an electric field formed between the scan electrodes Y and the sustain electrodes Z within a discharge cell are added, a dark discharge is generated between the scan electrodes Y and the sustain electrodes Z and between the scan electrodes Y and the address electrodes X within the entire discharge cells. As a result of the discharge, while negative wall charges are accumulated on the scan electrodes Y within the entire discharge cells immediately after the set-up period (SU), as shown in FIG. 34*b*, the wall charges are negatively inverted in polarity. Therefore, more positive wall charges than negative wall charges are accumulated on the address electrodes X. While the negative wall charges that have been accumulated on the sustain electrodes Z are shifted toward the scan electrodes Y, they are kept to the negative polarity although partially being reduced in amount.

Figure 3:
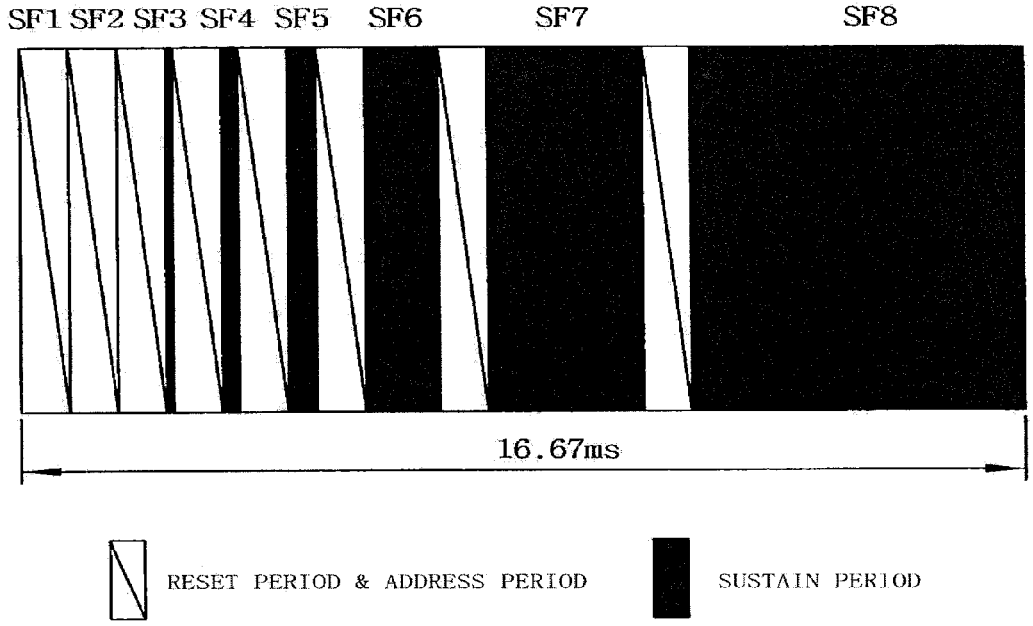
Fig. 3 Prior Art
FIG. 3 is a view illustrating a method of implementing gray levels of an image of a plasma display apparatus in the related art.
Figure 4:
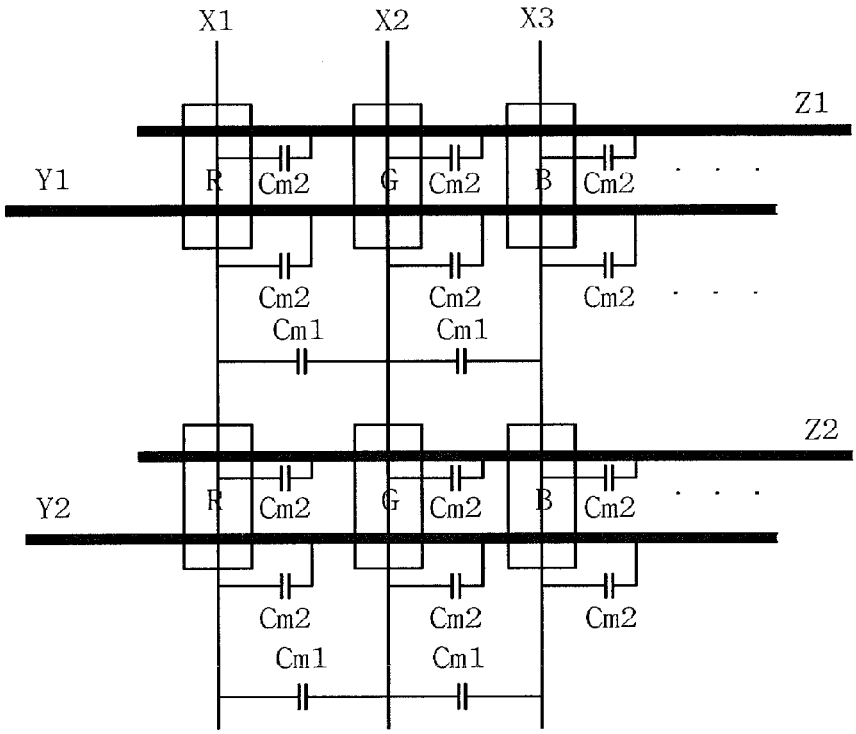
Fig. 4 Prior Art
FIG. 4 is a view illustrating equivalent capacitance (C) of a PDP.

Meanwhile, before the dark discharge is generated in the set-down period (SU) by the wall charge distribution immediately after the pre-reset period (PRERP), a Y reset voltage (Vr) is lower than the prior reset voltage (Vr) of FIG. 3 since the positive gap voltage within the entire discharge cells is sufficiently high. In addition, as positive wall charges are sufficiently accumulated on the address electrodes X through the pre-reset period (PRERP) and the set-up period (SU), an absolute value of an external applied voltage necessary for an address discharge, i.e., an absolute values of a data voltage (Va) and a scan voltage (−Vy) can be lowered.

Figure 34C:
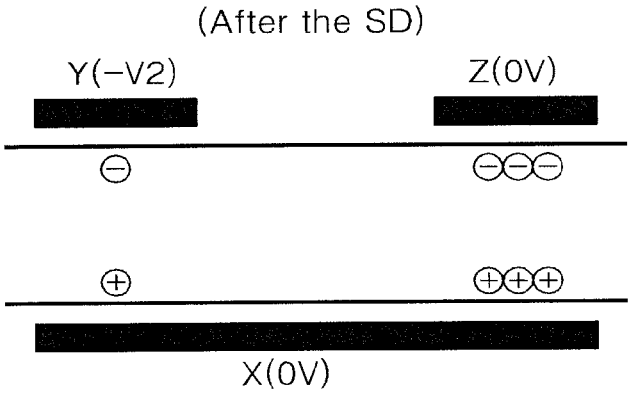

In the set-down period (SD) of the reset period (RP) subsequently to the set-up period (SU), while a second Y negative ramp waveform (NRY2) is applied to the scan electrodes Y, a second Z negative ramp waveform (NRZ2) is applied to the sustain electrodes Z. A voltage of the second Y negative ramp waveform (NRY2) drops from the positive sustain voltage (Vs) to a negative voltage (−V2). A voltage of the second Z negative ramp waveform (NRZ2) falls from the positive sustain voltage (Vs) to 0V or a base voltage. The voltage (−V2) can be set to be the same as or different from the voltage (−V1) of the pre-reset period (PRERP). During the set-down period (SD), the voltages of the scan electrodes Y and the sustain electrodes Z fall at the same time. Therefore, a discharge is not generated between the scan electrodes Y and the sustain electrodes Z, whereas a dark discharge is generated between the scan electrodes Y and the address electrodes X. The dark discharge causes excessive wall charges of the negative wall charges, which have been accumulated on the scan electrodes Y, to be erased and excessive wall charges of the positive wall charges, which have been accumulated on the address electrodes X, to be erased. As a result of the discharge, the entire discharge cells have a uniform wall charge distribution as shown in FIG. 34*c*. In the wall charge distribution of FIG. 34*c*, the negative wall charges are sufficiently accumulated on the scan electrodes Y and the positive wall charges are sufficiently accumulated on the address electrodes X. Therefore, a gap voltage between the scan electrodes Y and the address electrodes X is raised close to the firing voltage (Vf). Therefore, the wall charge distribution of the entire discharge cells is changed to have an optimal address condition immediately after the set-down period (SD).

Figure 34D:
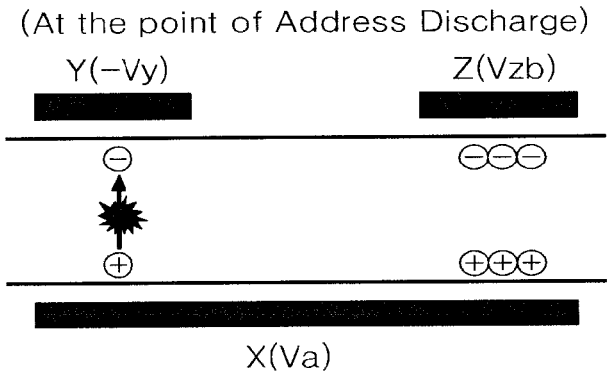
Figure 34E:
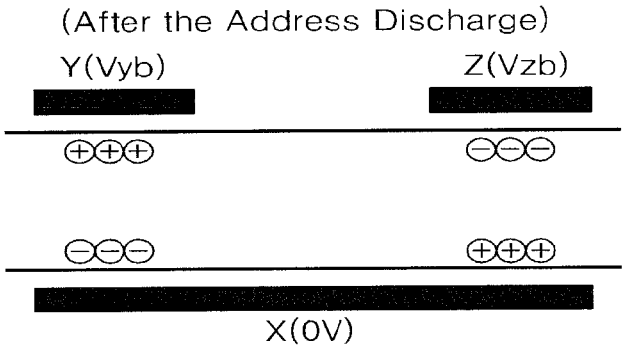

In the address period (AP), while negative scan pulses (−SCNP) are sequentially applied to the scan electrodes Y, a positive data pulse (DP) is applied to the address electrodes X in synchronization with the scan pulse (−SCNP). A voltage of the scan pulse (SCNP) is a scan voltage (Vsc), which drops from 0V or a negative scan bias voltage (Vyb) close to 0V to a negative scan voltage (−Vy). during the address period (AP), a positive Z bias voltage (Vzb) lower than the positive sustain voltage (Vs) is applied to the sustain electrodes Z. In a state where the gap voltage of the whole discharge cells is adjusted to an optimal address condition immediately after the reset period (RP), a gap voltage between the scan electrodes Y and the address electrodes X exceeds the firing voltage (Vf) within on-cells to which the scan voltage (Vsc) and the data voltage (Va) are applied. Therefore, an address discharge is generated only between the electrodes Y and X. The wall charge distribution within the on-cells where the address discharge is generated is shown in FIG. 34*d*. Immediately after the address discharge, the wall charge distribution of the on-cells is changed to that shown in FIG. 34E as positive wall charges are accumulated on the scan electrodes Y and negative wall charges are accumulated on the address electrodes X by the address discharge.

Meanwhile, off-cells in which 0V or a base voltage is applied to the address electrodes X or 0V or the scan bias voltage (Vyb) is applied to the scan electrodes Y have a gap voltage less than the firing voltage. Therefore, off-cells in which an address discharge is not generated have a wall charge distribution, which is substantially the same as that shown in FIG. 34*c*.

In the sustain period (SP), sustain pulses (FISRTSUSP, SUSP and LSTSUSP) of the positive sustain voltage (Vs) are alternately applied to the scan electrodes Y and the sustain electrodes Z. during the sustain period (SP), 0V or a base voltage is applied to the address electrodes X. A pulse width of the sustain pulse (FSTSUSP), which is firstly applied to each of the scan electrodes Y and the sustain electrodes Z, is set to be wider than that of a normal sustain pulse (SUSP) in order to stabilize sustain discharge initiation. Furthermore, the last sustain pulse (LSTSUSP) is applied to the sustain electrodes Z. At an initial state of the set-up period (SU), a pulse width of the last sustain pulse (LSTSUSP) is set to be wider than that of the normal sustain pulse (SUSP) so as to sufficiently accumulate negative wall charges on the sustain electrodes Z. during the sustain period, on-cells selected by an address discharge generate a sustain discharge between the scan electrodes Y and the sustain electrodes Z every sustain pulse (SUSP) owing to the wall charge distribution of FIG. 34*e*. To the contrary, an initial wall charge distribution of the sustain period (SP) in off-cells is the same as that of FIG. 34*c*. Although the sustain pulses (FIRSTSUSP, SUSP and LSTSUSP) are applied to the off-cells, the gap voltage of the sustain pulses is kept less than the firing voltage (Vf), so that a discharge is not generated in the off-cells.

To reduce the amount of spatial charges generated in the sustain discharge, a rising period and a falling period of each of the sustain pulses (FIRSTSUSP, SUSP and LSTSUSP) is set to be relatively long, from 320 ns to 360 ns.

The driving waveform of FIG. 33 is not limited only to the first sub-field, but can be applied to several initial sub-fields comprising the first sub-field and can also be applied to the entire sub-fields included in one frame period.

Figure 35:
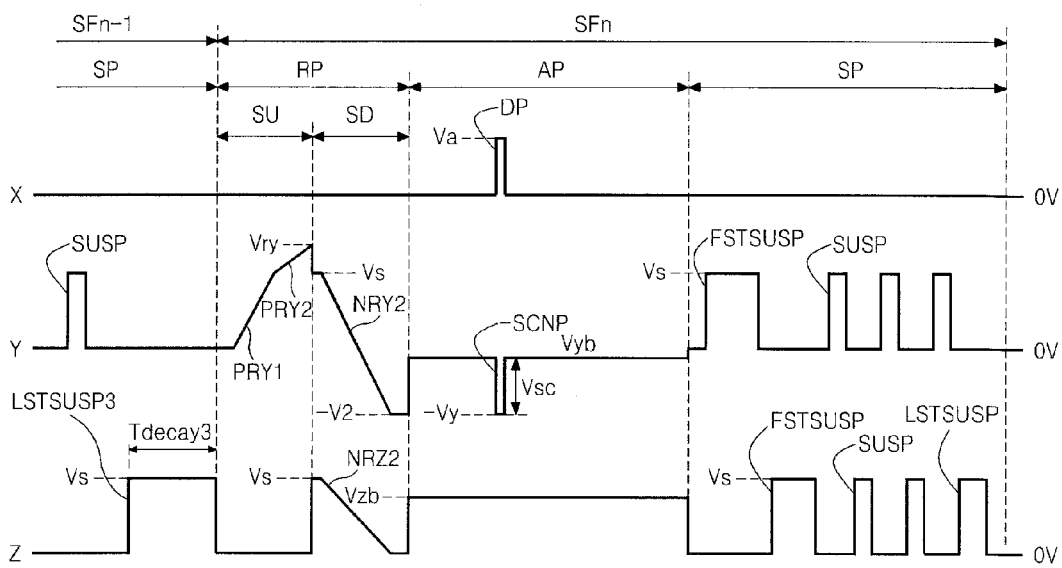
FIG. 35 is a waveform showing a driving waveform of the remaining sub-field periods other than a first sub-field period in further another example of the method of driving the plasma display apparatus according to a second embodiment of the present invention.

FIG. 35 is further another example of the method of driving the plasma display apparatus according to a second embodiment of the present invention and shows a driving waveform during a sustain period (SP) of a $(n-1)^{th}$ (where n is a positive integer greater than 2) sub-field (SFn−1) and a $n^{th}$ sub-field (SFn).

Figure 36:
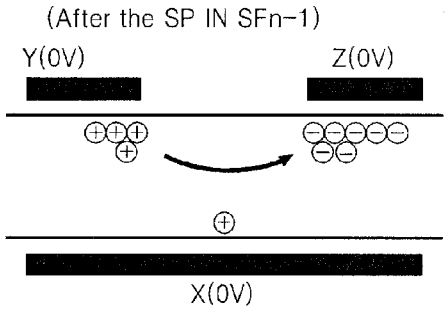
FIG. 36 is a view showing the distribution of wall charges formed within a discharge cell soon after a sustain period by means of the driving waveform shown in FIG. 35.
Figure 37:
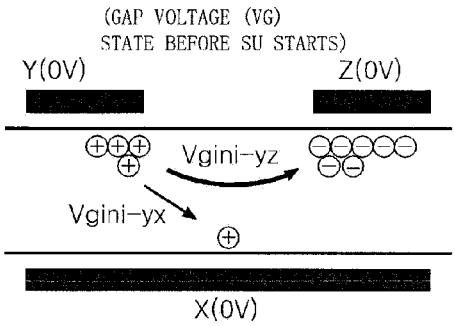
FIG. 37 is a view illustrating the distribution of wall charges and a gap voltage within a discharge cell, which are formed prior to a set-up period according to the driving waveform shown in FIGS. 33 and 35.

FIG. 36 shows the distribution of wall charges formed within a discharge cell soon after a sustain period by means of the driving waveform shown in FIG. 35. FIG. 37 is a view illustrating the distribution of wall charges and a gap voltage within a discharge cell, which are formed prior to a set-up period according to the driving waveform shown in FIGS. 33 and 35.

The driving waveform of FIG. 35 will be described in conjunction with the wall charge distribution of FIGS. 36 and 37.

Referring to FIG. 35, in the $n^{th}$ sub-field (SFn), the entire cells of the PDP are initialized using a wall charge distribution formed immediately after the sustain period in the $(n-1)^{th}$ sub-field (SFn−1), e.g., the first sub-field.

Each of the $(n-1)^{th}$ sub-field (SFn−1) and the $n^{th}$ sub-field (SFn) includes a reset period (RP) for initializing the whole cells owing to a wall charge distribution in which negative wall charges are sufficiently accumulated on the sustain electrodes Z, an address period (AP) for selecting cells and a sustain period (SP) for sustaining the discharge of selected cells.

In a sustain period of the $(n-1)^{th}$ sub-field (SFn−1), a last sustain pulse (LSTSUSP3) is applied to the sustain electrodes Z. At this time, 0V or a base voltage is applied to the scan electrodes Y and the address electrodes X. A spatial charge decay period (Tdecay3) corresponding to a pulse width of the last sustain pulse (LSTSUSP3) is set to have an enough time of the degree in which spatial charges can be changed to wall charges, thus inducing a sustain discharge within on-cells and also erasing spatial charges within the discharge cells prior to the reset period (RP) of the $n^{th}$ sub-field (SFn). To this end, the spatial charge decay period (Tdecay3) in which the last sustain pulse (LSTSUSP3) is kept to a sustain voltage (Vs) is set to approximately 300 μs±50 μs.

Positive wall charges are sufficiently accumulated on the scan electrodes Y and negative wall charges are accumulated on the sustain electrodes Z almost without spatial charges as shown in FIG. 36 due to the discharge generated between the scan electrodes Y and the sustain electrodes Z by the last sustain pulse (LSTSUSP3).

In a set-up period (SU) of the $n^{th}$ sub-field (SFn), the wall charge distribution of FIG. 36 is used to generate a dark discharge in the whole cells, thus initializing the whole cells with the wall charge distribution as shown in FIG. 34*b*. A set-up period (SU), and a set-down initialization, address and sustain operations thereafter are substantially the same as those of the driving waveform of FIG. 33.

In further another example of the plasma display apparatus and driving method thereof according to a second embodiment of the present invention, spatial charges are changed to wall charges under a high-temperature environment to stably initialize a wall charge distribution under a high-temperature environment. A set-up period of a next sub-field just follows a last sustain discharge of a previous sub-field, without an erase period for erasing wall charges between a sustain period of a previous sub-field and a reset period of a next sub-field. Since a sustain discharge is a strong glow discharge, it can sufficiently accumulate lots of wall charges on the scan electrodes Y and the sustain electrodes Z and can stably sustain the polarities of positive wall charges on the scan electrodes Y and negative wall charges on the sustain electrodes Z.

FIG. 37 shows a cell gap voltage state of a cell, which is formed by a last sustain discharge or the discharge of the pre-reset period (PRERP).

Referring to FIG. 37, a discharge is generated between the scan electrodes Y and the sustain electrode Z by means of the last sustain pulse (LSTSUSP) or the waveforms (NRY1, PRZ and NRZ1) of the pre-reset period (PRERP). Therefore, immediately before the set-up period (SU), an inter-Y-Z initial gap voltage (Vgini−yz) is formed within a cell by an electric field directing from the scan electrodes Y to the sustain electrodes Z. An inter-Y-X initial gap voltage (Vgini−yx) is formed within the cell by an electric field directing from the scan electrodes Y to the address electrodes X.

The inter-Y-Z initial gap voltage (Vgini−yz) has already been formed in the discharge cell by the wall charge distribution of FIG. 37 before the set-up period (SU). If an external voltage is applied as much as a difference between the firing voltage (Vf) and the inter-Y-Z initial gap voltage (Vgini−yz), a dark discharge is generated in the discharge cell during the set-up period (SU). This can be expressed in the following Equation 5.

$$Vyz = Vf - (Vgini-yz) \quad \text{[Equation 5]}$$

where Vyz is an external voltage (hereinafter, referred to as "inter-Y-Z external voltage") applied to the scan electrodes Y and the sustain electrodes Z during the set-up period (SU). The voltage Vyz indicates a voltage of the positive ramp waveforms (PRY1, PRY2) applied to the scan electrodes and 0V applied to sustain electrodes Z, in the driving waveforms of FIGS. 33 and 35.

Figure 38:
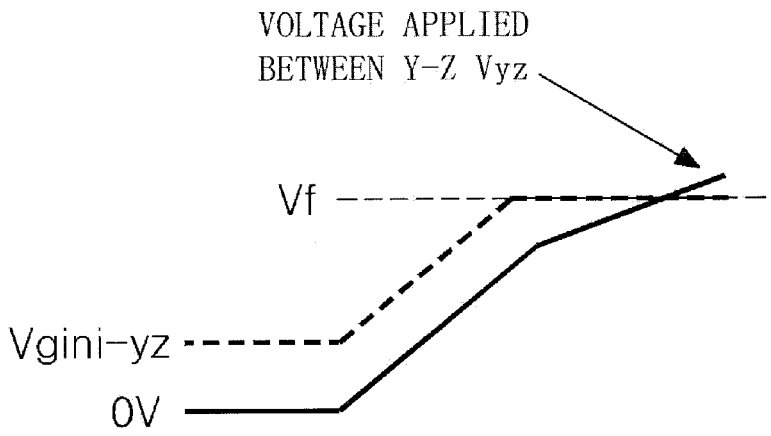
FIG. 38 is a view illustrating variation in an externally applied voltage and a gap voltage within a discharge cell between the scan electrodes and the sustain electrodes in the set-up period when the PDP is driven according to the driving waveform as shown in FIGS. 33 and 35.

FIG. 38 is a view illustrating variation in an externally applied voltage and a gap voltage within a discharge cell between the scan electrodes and the sustain electrodes in the set-up period when the plasma display panel is driven according to the driving waveform as shown in FIGS. 33 and 35.

As can be seen from Equation 5 and FIG. 38, if the inter-Y-Z external voltage (Vyz) is sufficiently higher than a difference between the firing voltage (Vf) and the inter-Y-Z initial gap voltage (Vgini−yz) during the set-up period (SU), a dark discharge can be stably generated in discharge cells due to wide driving margin.

In further another example of the plasma display apparatus according to a second embodiment of the present invention, the amount of light emission generated during the reset period every sub-field is very small in comparison to the related art. This is because the number of discharge times, which is generated in a cell during the reset period of each sub-field, more particularly, the number of surface discharge, is less than that of the related art.

Figure 39:
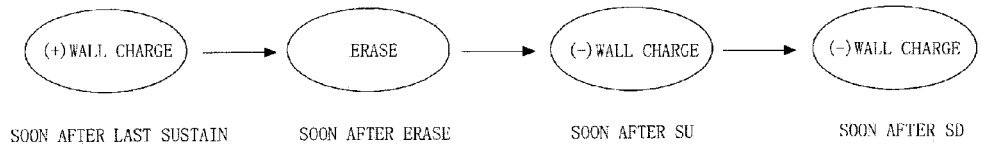
FIG. 39 is a view illustrating a change in the polarity of wall charges on the sustain electrodes during an erase period and a reset period by means of the example of the driving waveform in the related art as shown in FIG. 5.

FIG. 39 is a view illustrating a change in the polarity of wall charges on the sustain electrodes during an erase period and a reset period by means of the example of the driving waveform in the related art as shown in FIG. 5.

Figure 40:
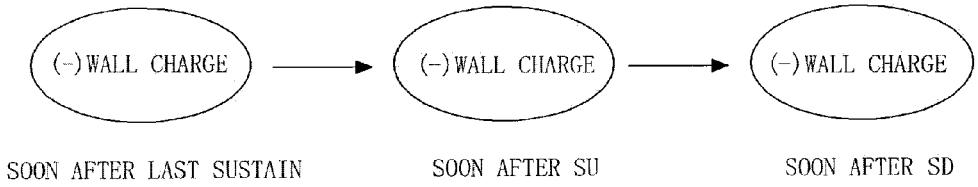
FIG. 40 is a view illustrating a change in the polarity of wall charges on the sustain electrodes a reset period by means of the driving waveform as shown in FIGS. 33 and 35.

FIG. 40 is a view illustrating a change in the polarity of wall charges on the sustain electrodes a reset period by means of the driving waveform as shown in FIGS. 33 and 35.

In the conventional plasma display apparatus, the polarity of wall charges on the sustain electrodes Z is changed in order of a positive polarity, erase & negative polarity (FIG. 6*a*), a positive polarity (FIG. 6*b*) and a negative polarity (FIG. 6*c*) from immediately after the last sustain discharge of the $(n-1)^{th}$ sub-field (SFn−1) to immediately after the dark discharge of the set-down period (SD) of the $n^{th}$ sub-field (SFn), as shown in FIG. 39. To the contrary, in the plasma display apparatus of the present invention, the polarity of wall charges on the sustain electrodes Z is kept to a negative polarity from immediately after the last sustain discharge of the $(n-1)^{th}$ sub-field (SFn−1) to immediately after a dark discharge of the set-down period (SD) of the $n^{th}$ sub-field (SFn), as shown in FIG. 40. In other words, in the plasma display apparatus of the present invention, the address period (AP) begins while the polarity of the wall charges on the sustain electrodes X is constantly kept to a negative polarity in the initialization process, as shown in FIGS. 34*a*, 10*b* and 10*c*.

Figure 41:
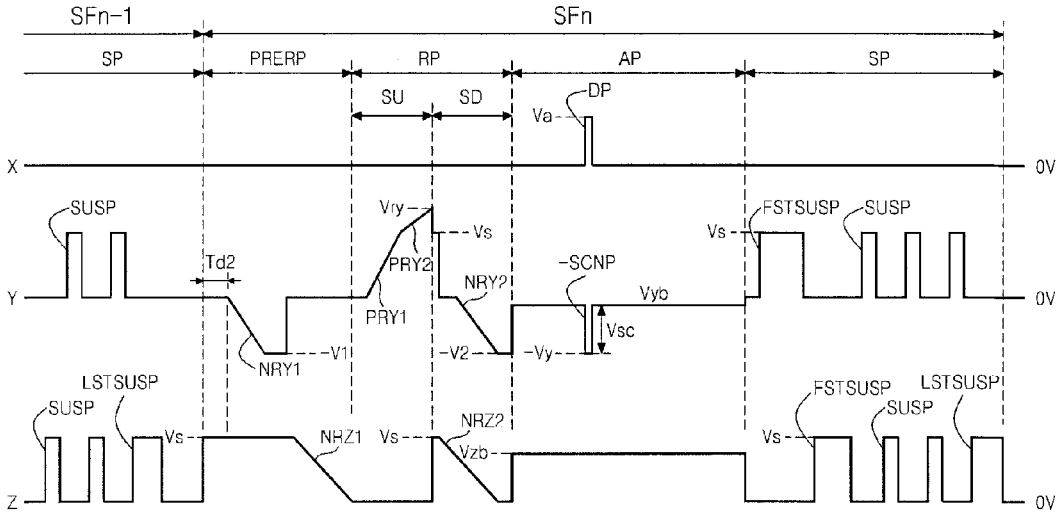
FIG. 41 is a waveform showing a driving waveform of a first sub-field period in a driving method of a plasma display apparatus depending on further another example of the method of driving the plasma display apparatus according to a second embodiment of the present invention.

FIG. 41 shows a driving waveform of a first sub-field period in further another example of the method of driving the plasma display apparatus according to a second embodiment of the present invention.

Figure 42:
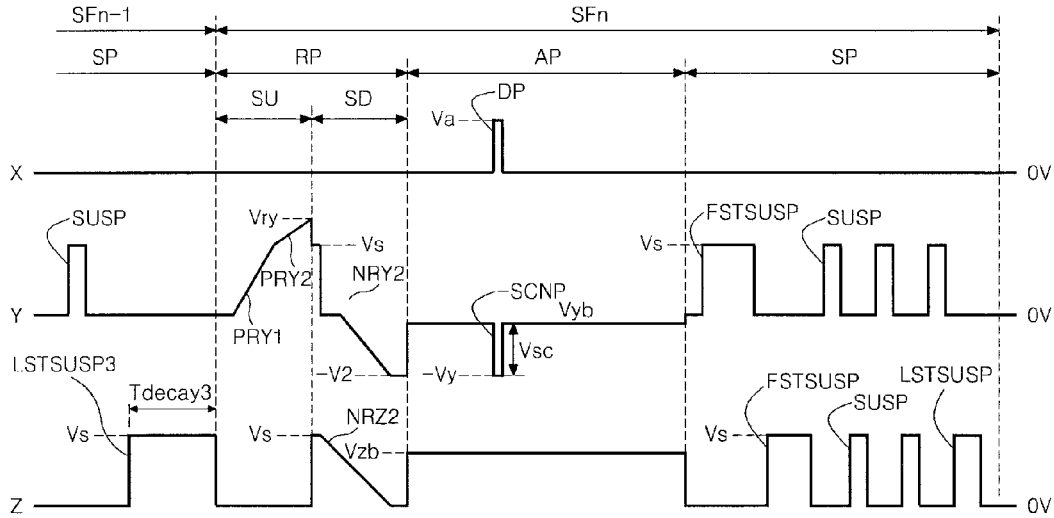
FIG. 42 is a waveform showing driving waveforms of the remaining sub-field periods other than the first sub-field period in a driving method of a plasma display apparatus depending on further another example of the method of driving the plasma display apparatus according to a second embodiment of the present invention.

FIG. 42 shows a driving waveform during a sustain period (SP) of a $(n-1)^{th}$ (where n is a positive integer greater than 2) sub-field (SFn−1) and a $n^{th}$ sub-field (SFn) in further another example of the method of driving the plasma display apparatus according to a second embodiment of the present invention.

Referring to FIGS. 41 and 42, in further another example of the method of driving the plasma display apparatus according to a second embodiment of the present invention, in each sub-field, a voltage that falls from 0V or a based voltage (GND) is applied to scan electrodes Y during a set-down period (SD), thus making uniform the wall charge distribution of the entire discharge cells that are initialized at a set-up period (SU).

A first sub-field includes a pre-reset period (PRERP), a reset period (RP), an address period (AP) and a sustain period (SP), as shown in FIG. 41. The remaining sub-fields (SFn) include a reset period (RP), an address period (AP) and a sustain period (SP), as shown in FIG. 42.

To change spatial charges to wall charges to thereby erase the spatial charges and also form a wall charge distribution as shown in FIG. 34*a* in each discharge cell, during the pre-reset period (PRERP) of the first sub-field, after a positive sustain voltage (Vs) is applied to the entire sustain electrodes Z, a first Y negative ramp waveform (NRY1) whose voltage falls from 0V or the ground voltage (GND) to a negative voltage (−V1) is applied to the entire scan electrodes Y after a predetermined time (Td2) elapses.

A last sustain pulse (LSTSUSP3), which is applied to the sustain electrodes Z before the reset period (RP) of the $n^{th}$ sub-field other than the first sub-field, is kept to the positive sustain voltage (Vs) during a spatial charge decay period (Tdecay3) of approximately 300 μs±50 μs. during the spatial charge decay period (Tdecay3), spatial charges are changed to wall charges and then erased.

In the set-down period (SD) of the reset period (RP) of each of the sub-fields (SFn−1, SFn), while a second Y negative ramp waveform (NRY2) is applied to the scan electrodes, a second Z negative ramp waveform (NRZ2) is applied to the sustain electrodes Z. A voltage of the second Y negative ramp waveform (NRY2) drops from 0V or a ground voltage (GND) to a negative voltage (−V2) unlike the above-described embodiments. A voltage of the second Z negative ramp waveform (NRZ2) falls from a positive sustain voltage (Vs) up to 0V or the ground voltage. During the set-down period (SD), the voltages of the scan electrodes Y and the sustain electrodes Z concurrently drop. Therefore, a discharge is not generated between the scan electrodes Y and the sustain electrodes Z, whereas a dark discharge is generated between the scan electrodes Y and the address electrodes X. The dark discharge causes excessive wall charges of the negative wall charges, which have been accumulated on the scan electrodes Y, to be erased and excessive wall charges of the positive wall charges, which have been accumulated on the address electrodes X, to be erased. Meanwhile, the second Z negative ramp waveform (NRZ2) can be omitted.

If the voltage of the second Y negative ramp waveform (NRY2) drops from 0V or the ground voltage, the set-down period (SD) becomes short compared with the above-mentioned embodiments. Furthermore, although a voltage of the second Y negative ramp waveform (NRY2) drops from 0V or the ground voltage, a voltage difference between the scan electrodes Y and the sustain electrodes Z is small. Therefore, the plasma display apparatus of the present invention can stabilize initialization while effectively suppressing a discharge between the scan electrodes Y and the sustain electrodes Z. Therefore, the present embodiment can secure a more driving time due to the reduction of the set-down period (SD) and can stabilize an initialization operation of the set-down period (SD).

To reduce the amount of spatial charges generated in a sustain discharge, a rising period and a falling period of each of the sustain pulses (FIRSTSUSP, SUSP, LSTSUSP) is set to approximately 300 μs±50 μs, which is relatively long.

Figure 43:
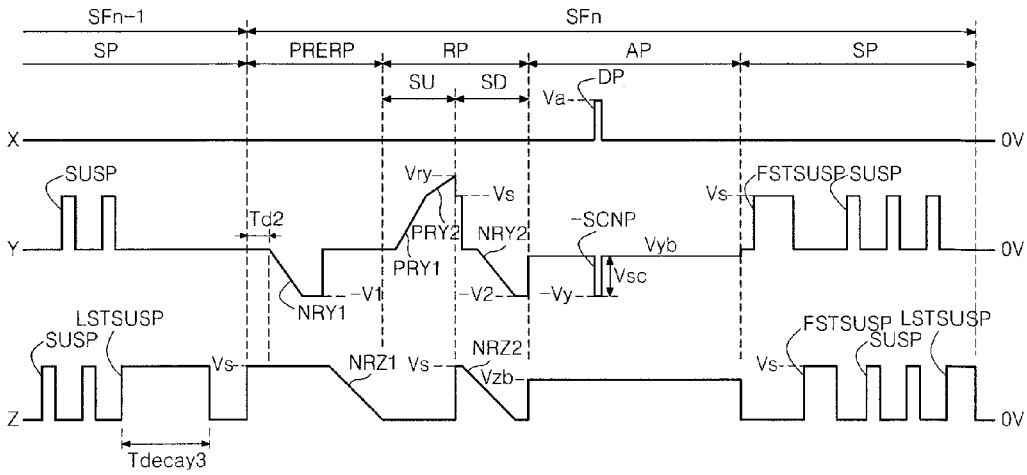
FIG. 43 is a waveform showing a driving method of a plasma display apparatus depending on further another example of the method of driving the plasma display apparatus according to a second embodiment of the present invention.

FIG. 43 shows a waveform illustrating further another example of the method of driving the plasma display apparatus according to a second embodiment of the present invention, and shows a driving waveform applied under high temperature environment.

Referring to FIG. 43, in the method of driving the plasma display apparatus according to the present invention, during the latter period of a $(n-1)^{th}$ sub-field (SFn−1), a last sustain pulse (LSTSUSP), which is kept to a positive sustain voltage during the spatial charge decay period (Tdecay3) of approximately 300 μs±50 μs, is applied to the sustain electrodes Z. 0V or a ground voltage (GND) is then applied to sustain electrodes Z.

Furthermore, in the method of driving the plasma display apparatus according to the present invention, after the positive sustain voltage (Vs) is applied to the entire sustain electrodes Z, the first Y negative ramp waveform (NRY1), which drops from 0V or the ground voltage (GND) to the negative voltage (−V1), is applied to the entire scan electrodes Y after a predetermined time (Td2) elapses. Therefore, in a state where the voltage of the sustain electrodes Z is kept to the sustain voltage (Vs), the first Y negative ramp waveform (NRY1) is applied to the scan electrodes Y. In the method of driving the plasma display apparatus according to the present invention, after 0V or the ground voltage (GND) is applied to the scan electrodes Y, the first Z negative ramp waveform (NRZ1), which gradually drops from the sustain voltage (Vs) to 0V or the ground voltage (GND), is applied to the sustain electrodes.

To reduce the amount of spatial charges generated in the sustain discharge, a rising period and a falling period of each of sustain pulses (FIRSTSUSP, SUSP, LSTSUSP) can be set to approximately 340 μs±30 μs, which is relatively long.

Spatial charges, which are generated under a high-temperature environment by a series of these driving waveforms, are almost erased or changed to wall charges prior to the $n^{th}$ sub-field (SFn). Each of discharge cells is initialized to have a wall charge distribution as shown in FIG. 34*a*.

Figure 44:
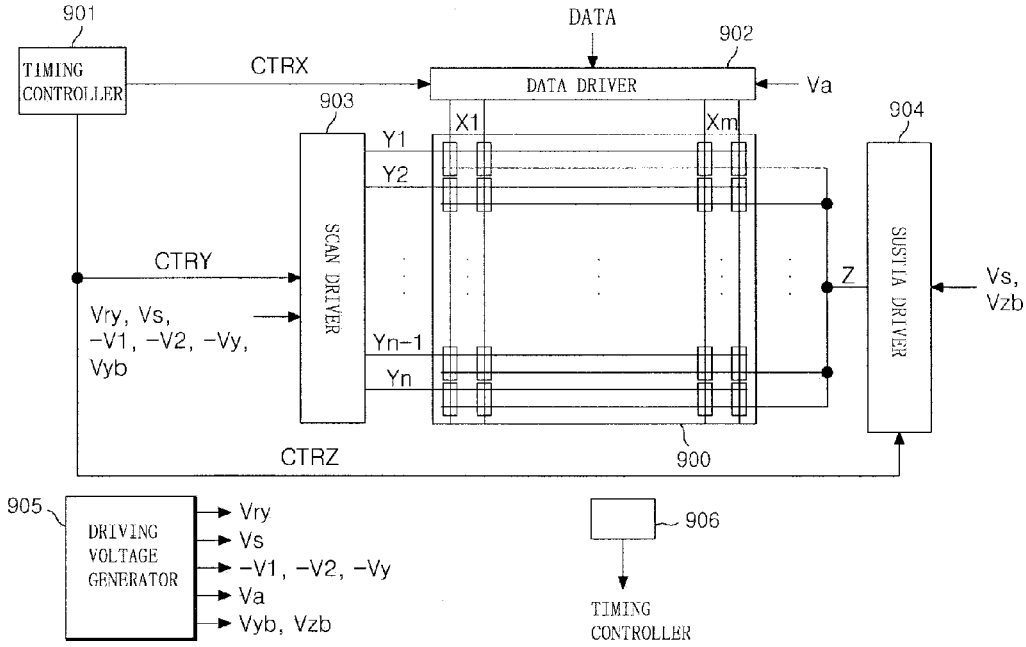
FIG. 44 is a block diagram showing the construction of a plasma display apparatus according to an embodiment of the present invention.

FIG. 44 is a block diagram showing the construction of a plasma display apparatus according to an embodiment of the present invention.

Referring to FIG. 44, the plasma display apparatus according to an embodiment of the present invention comprises a PDP 900, a temperature sensor 906 for sensing the temperature of the PDP 900, a data driver 902 for supplying data to address electrodes X1 to Xm of the PDP 900, a scan driver 903 for driving scan electrodes Y1 to Yn of the PDP 900, a sustain driver 904 for driving sustain electrodes Z of the PDP 900, a driving pulse controller 901 for controlling the respective drivers 902, 903 and 904 depending on the temperature of the PDP 900, and a driving voltage generator 905 for generating driving voltages necessary for the respective drivers 902, 903 and 904.

The temperature sensor 906 senses the temperature of the PDP to generate a sense voltage, converts the sense voltage into a digital signal and supplies the digital signal to the driving pulse controller 901.

The data driver 902 are supplied with data, which undergo inverse gamma correction, erroneous diffusion, etc. through an inverse gamma correction circuit (not shown), an error diffusion circuit (not shown), etc., and are then mapped to predetermined sub-field patterns by a sub-field mapping circuit. As shown in FIGS. 7, 8, 9, 11, 17, 18 and 19, the data driver 902 applies 0V or the ground voltage to the address electrodes X1 to Xm during the pre-reset period (PRERP), the reset period (RP) and the sustain period (SP). Furthermore, the data driver 902 samples and latches data during the address period (AP) of each of sub-fields and then supplies the data voltage (Va) to the address electrodes X1 to Xm, under the control of the driving pulse controller 901.

The scan driver 903 applies the ramp-up waveform (Ramp-up) and the ramp-down waveform (Ramp-down) to the scan electrodes Y during the reset period. Furthermore, the scan driver 903 sequentially applies the scan pulse (Sp) of the negative scan voltage (−Vy) to the scan electrodes Y during the address period and the sustain pulse (SUS) to the scan electrodes Y during the sustain period.

The scan driver 903 supplies the ramp waveforms (NRY1, PRY1, PRY2, NRY2) to the scan electrodes Y1 to Yn in order to initialize the entire discharge cells during the pre-reset period (PRERP) and the reset period (RP), and then sequentially supplies the scan pulses (SCNP) to the scan electrodes Y1 to Yn in order to select a scan line to which data are supplied during the address period (AP), under the control of the driving pulse controller 901. When the PDP has a high temperature, the scan driver 903 supplies the sustain pulses (FSTSUSP, SUSP) whose rising period and falling period are approximately 340 ns±60 ns to the scan electrodes Y1 to Yn in order to generate a sustain discharge in selected on-cells during the sustain period (SP).

The sustain driver 904 applies the negative sustain bias voltage (Vzb) to the sustain electrodes Z during a period where the ramp-down waveform (Ramp-down) is generated and the address period, and applies the sustain pulse (SUS) to the sustain electrodes Z during the sustain period while alternately operating with the scan driver 903.

The sustain driver 904 supplies the ramp waveforms (NRZ1, NRZ2) to the sustain electrodes Z in order to initialize the entire discharge cells during the pre-reset period (PRERP) and the reset period (RP), and then supplies the Z bias voltage (Vzb) to the sustain electrodes Z during the address period (AP), under the control of the driving pulse controller 901. The sustain driver 904 operates alternately with the scan driver 903 to supply the sustain pulses (FSTSUSP, SUSP, LSTSUSP) to the sustain electrodes Z during the sustain period (SP). When the PDP has a high temperature, a pulse width of the last sustain pulse (LSTSUSP) generated in the sustain driver 904 is set to be long, 1 μs to 1 ms. A rising period and a falling period of each of the sustain pulses (FSTSUSP, SUSP, LSTSUSP) is set to be approximately 340 ns±60 ns.

The driving pulse controller 901 generates a timing control signal for controlling an operating timing and synchronization of the data driver 902, the scan driver 903 or the sustain driver 904 in the address period and the sustain period, and applies the timing control signal to the data driver 902, the scan driver 903 or the sustain driver 904, thus controlling the data driver 902, the scan driver 903 or the sustain driver 904. More particularly, the driving pulse controller 901 controls the above-described scan driver 903 so that the scan electrodes Y are scanned according to one of a plurality of scan types in which the order of scanning the scan electrodes Y is different. That is, the scan driver 903 scans the scan electrodes Y using one of the plurality of scan types in the address period, and applies the scan pulse (Sp) of the negative scan voltage (−Vy) to the scan electrodes Y in the address period.

The driving pulse controller 901 receives vertical/horizontal synchronization signals and a clock signal to generate timing control signals (CTRX, CTRY, CTRZ) necessary for the respective drivers 902, 903 and 904. The driving pulse controller 901 supplies the timing control signals (CTRX, CTRY, CTRZ) to corresponding drivers 902, 903 and 904, thus controlling the respective drivers 902, 903 and 904. The timing control signal (CTRX) supplied to the data driver 902 includes a sampling clock for sampling data, a latch control signal, and a switching control signal for controlling an on/off time of an energy recovery circuit and a driving switch element. The timing control signal (CTRY) applied to the scan driver 903 includes a switching control signal for controlling an on/off time of an energy recovery circuit and a driving switch element within the scan driver 903. The timing control signal (CTRZ) applied to the sustain driver 904 includes a switching control signal for controlling an on/off time of an energy recovery circuit and a driving switch element within the sustain driver 904.

Furthermore, the driving pulse controller 901 receives an output voltage from the temperature sensor 906, when the PDP 900 has a high temperature, controls the scan driver 903 and the sustain driver 904 so that a pulse width of the last sustain pulse (LSTSUSP) becomes long, approximately 1 μs to 1 ms, and also controls the scan driver 903 and the sustain driver 904 so that a rising period and a falling period of each of the sustain pulses (FSTSUSP, SUSP, LSTSUSP) become about 340 ns±160 ns. Furthermore, the driving pulse controller 901 controls the scan driver 903 and the sustain driver 904 so that the positive sustain voltage (Vs) is applied to the sustain electrodes Z prior to the first Y negative ramp waveform (NRY1).

The driving voltage generator 905 generates the voltages (Vry, Vs, −V1, −V2, −Vy, Va, Vyb, Vzb, etc.) applied to the PDP 900. These driving voltages may be varied depending on a discharge characteristic or the composition of a discharge gas, which is varied depending on the resolution, model and so on of the PDP 900.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus, comprising:

a plasma display panel comprising a plurality of scan electrodes, a plurality of sustain electrodes, and a plurality of data electrodes intersecting the plurality of scan electrodes and the plurality of sustain electrodes; and a controller for scanning the scan electrodes using one of a plurality of scan types in which the order of scanning the plurality of scan electrodes is different in an address period, for applying a data pulse to the data electrodes corresponding to one scan type, and for controlling a difference between an application time point of a last sustain pulse, which are applied to the scan electrodes or the sustain electrode in a sustain period subsequent to the address period, and an application time point of a reset pulse, which is applied to the scan electrodes in a reset period of a next sub-field, to be more than a difference between application time points of the two sustain pulses, in at least one of the sub-fields of a frame.

2. The plasma display apparatus as claimed in claim 1, wherein when the temperature of the plasma display panel or an ambient temperature around the panel is high, the controller sets the width of the last sustain pulse to be wider than the width of the last sustain pulse at room temperature.

3. The plasma display apparatus as claimed in claim 1, further comprising:

a pre-reset driver that initializes a discharge cell by applying a negative ramp waveform whose voltage gradually decreases to the scan electrodes with a positive voltage being applied to the sustain electrodes;

a reset driver that applies, during a reset period, a positive ramp waveform whose voltage gradually increases to the scan electrodes and a second negative ramp waveform whose voltage gradually decreases to the scan electrodes;

an address driver that selects a discharge cell by applying a scan pulse to the scan electrodes and a data pulse to the address electrodes during an address period; and a sustain driver that generates a discharge in the selected discharge cell by alternately applying a sustain pulses to the scan electrodes and the sustain electrodes during a sustain period.

4. The plasma display apparatus as claimed in claim 3, wherein the controller controls the width of the last sustain pulse to be wider than the width of the other sustain pulses when the temperature of the plasma display panel or an ambient temperature around the plasma display panel is high.

5. The plasma display apparatus as claimed in claim 1, wherein the controller calculates a displacement current corresponding to each of the plurality of the scan types corresponding to input image data and performs scanning the scan electrodes using one scan type having the lowest displacement current among the plurality of the scan types.

6. The plasma display apparatus as claimed in claim 4, wherein the scan electrodes include first and second scan electrodes that are separated by a predetermined number of scan electrodes depending on the scan types, wherein the data electrodes include a first and a second data electrodes, wherein a first and a second discharge cell are disposed at the intersections of the first scan electrode and the first and second data electrodes, and a third and a fourth discharge cell are disposed at the intersections of the second scan electrode and the first and second data electrodes, and wherein the controller calculates a first result in which data of the first discharge cell and data of the second discharge cell have been compared with each other, a second result in which data of the first discharge cell and data of the third discharge cell have been compared with each other and a third result in which data of the third discharge cell and data of the fourth discharge cell have been compared with each other, determines a calculation equation of the displacement current according to a combination of the first to third results, and sums the displacement current calculated using the decided calculation equation to calculate a total of the displacement current of the first discharge cell.

7. The plasma display apparatus as claimed in claim 4, wherein the controller calculates the displacement current for the plurality of the scan types in each sub-field of a frame, and scans the scan electrodes using a scan type that makes the displacement current to be minimized in every sub-field.

8. The plasma display apparatus as claimed in claim 4, wherein the controller calculates a displacement current corresponding to each of the plurality of the scan types corresponding to received picture data, and scans the scan electrodes using at least one of the scan types, in which the displacement current is less than a critical displacement current.

9. The plasma display apparatus as claimed in claim 5, wherein the scan types comprise a first scan type in which scanning is performed with the scan electrodes being divided into a plurality of groups, and the controller consecutively scans the scan electrodes, which belong to the same group, with the first scan type when the first scan type makes the displacement current to be minimized.

10. The plasma display apparatus as claimed in claim 1, wherein the scan electrodes are applied with the last sustain pulse and the initialization signal, and the sustain electrodes are applied with an erase signal having a ramp-up waveform during a period between the last sustain pulse and the initialization signal.

11. The plasma display apparatus as claimed in claim 10, wherein when the erase signal is applied to the sustain electrode, a ground level voltage is applied to the scan electrodes.

12. The plasma display apparatus as claimed in claim 1, wherein the scan electrodes or the sustain electrodes are applied with a signal of a ramp-down waveform whose voltage gradually decreases subsequent to the application of the last sustain pulse.

13. The plasma display apparatus as claimed in claim 1, wherein a difference between an end time point of the last sustain pulse application and an application time point of a reset pulse, which is applied to the scan electrodes in a reset period of a next sub-field, ranges from 100 μs to 1 ms.

14. The plasma display apparatus as claimed in claim 1, wherein the width of the last sustain pulse ranges from 1 μs to 1 ms.

15. The plasma display apparatus as claimed in claim 1, wherein after the last sustain pulse is applied to the scan electrodes or the sustain electrode, a voltage of the scan electrodes or the sustain electrode is maintained at a ground level (GND) voltage.

16. The plasma display apparatus as claimed in claim 15, wherein the length of a period in which the voltage of the scan electrodes or the sustain electrode is maintained at a ground level (GND) voltage ranges from 100 μs to 1 ms.

17. A plasma display apparatus, comprising:

a plasma display panel comprising a plurality of scan electrodes, a plurality of sustain electrodes parallel with the scan electrodes, and the data electrodes intersecting the scan electrodes and the sustain electrodes; and a controller that scans the scan electrodes with a scan sequence of the plurality of scan electrodes being different from a first data pattern, in a second data pattern different from the first data pattern of data patterns of picture data that are input in an address period, applies a data pulse to the data electrodes corresponding to the scan sequence of the plurality of scan electrodes, and controls a difference between an application time point of a last sustain pulse of sustain pulses, which are applied to the scan electrodes or the sustain electrode in a sustain period subsequent to the address period, and an application time point of a reset pulse, which is applied to the scan electrodes in a reset period of a next sub-field, to be more than a difference between application time points of the two sustain pulses, in at least one of sub-fields of a frame.

18. The plasma display apparatus as claimed in claim 17, wherein when the temperature of the plasma display panel or an ambient temperature around the plasma display panel is high, the controller controls the width of the last sustain pulse to be wider than the width of the last sustain pulse at room temperature.

19. The plasma display apparatus as claimed in claim 17, further comprising:

a pre-reset driver that initializes a discharge cell by applying a negative ramp waveform whose voltage gradually decreases to the scan electrodes with a positive voltage being applied to the sustain electrodes;

a reset driver that applies a positive ramp waveform whose voltage gradually increases and a second negative ramp waveform whose voltage gradually decreases to the scan electrodes during a reset period;

an address driver that selects a discharge cell by applying a scan pulse to the scan electrodes and data pulse to the address electrodes during an address period; and a sustain driver that generates a discharge in the selected discharge cell by alternately applying a sustain pulses to the scan electrodes and the sustain electrodes during a sustain period.

20. A method of driving a plasma display apparatus comprising a plurality of scan electrodes, a plurality of sustain electrodes and a plurality of data electrodes intersecting the plurality of scan electrodes and the sustain electrodes; the method comprising:

scanning the scan electrodes using one of a plurality of scan types in which the order of scanning the plurality of scan electrodes is different in an address period, applying a data pulse to the data electrodes corresponding to one scan type, and controlling a difference between an application time point of a last sustain pulse, which are applied to the scan electrodes or the sustain electrode in a sustain period subsequent to the address period, and a application time point of a reset pulse, which is applied to the scan electrodes in a reset period of a next sub-field, to be more than a difference between the application time points of the two sustain pulses, in at least one of sub-fields of a frame.

* * * * *